US011472193B2

(12) United States Patent
Netsu et al.

(10) Patent No.: US 11,472,193 B2
(45) Date of Patent: Oct. 18, 2022

(54) PRINTER

(71) Applicant: SEIKO EPSON CORPORATION, Tokyo (JP)

(72) Inventors: Takahiro Netsu, Nagano (JP); Takuma Usuda, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/200,952

(22) Filed: Mar. 15, 2021

(65) Prior Publication Data

US 2021/0291544 A1 Sep. 23, 2021

(30) Foreign Application Priority Data

Mar. 17, 2020 (JP) ..... JP2020-046231

(51) Int. Cl.
*B41J 2/175* (2006.01)

(52) U.S. Cl.
CPC .. *B41J 2/17566* (2013.01); *B41J 2002/17573* (2013.01)

(58) Field of Classification Search
CPC ..... B41J 2/17566; B41J 2002/17573
See application file for complete search history.

(56) References Cited

U.S. PATENT DOCUMENTS 5,132,711 A 7/1992 Shinada et al.
5,652,610 A 7/1997 Kawai et al.
5,655,032 A 8/1997 Ohsawa et al.
5,689,290 A 11/1997 Saito et al.
5,691,760 A 11/1997 Hosier et al.
5,757,390 A 5/1998 Gragg et al.
6,086,178 A 7/2000 Kawashima et al.
6,098,029 A 8/2000 Takagi et al.
6,249,655 B1 6/2001 Baek et al.
6,337,959 B1 1/2002 Kwak et al.
6,390,590 B1 5/2002 Hansburg
6,513,892 B2 2/2003 Inoue et al.
6,520,612 B1 2/2003 Merz et al.
6,729,711 B1 5/2004 Hashimoto et al.
7,049,622 B1 5/2006 Weiss
7,234,787 B2 6/2007 Grady et al.
7,522,308 B2 4/2009 Ueda
7,753,500 B2 7/2010 Nishida
7,872,746 B2 1/2011 Gao et al.
7,984,980 B2 7/2011 Kachi
8,123,317 B2 2/2012 Ikeda
(Continued)

FOREIGN PATENT DOCUMENTS

CN 201597251 U 10/2010
CN 102145585 A 8/2011
(Continued)

*Primary Examiner* — Justin Seo
(74) *Attorney, Agent, or Firm* — Global IP Counselors, LLP

(57) ABSTRACT

A printer includes an ink tank, a print head performing printing by using ink in the ink tank; a light source irradiating an inside of the ink tank with light; a sensor detecting light incident from the ink tank during a period in which the light source emits light; and a processing section detecting an amount of ink in the ink tank based on an output of the sensor. The light source is turned on by an amount of light based on a result of the sensor detecting light reflected from an area where the ink does not exist.

15 Claims, 32 Drawing Sheets

(56) References Cited

U.S. PATENT DOCUMENTS

| | | | |
|---|---|---|---|
| 8,348,363 | B2 | 1/2013 | Yamamoto |
| 8,926,052 | B2 * | 1/2015 | Kusaka ..... G01F 23/2922 347/19 |
| 8,937,743 | B1 | 1/2015 | Kasuya |
| 9,279,711 | B1 | 3/2016 | Guldalian |
| 9,415,601 | B1 | 8/2016 | Tsukida |
| 10,065,426 | B2 | 9/2018 | Hayashi et al. |
| 2001/0035887 | A1 | 11/2001 | Altfather et al. |
| 2002/0003579 | A1 | 1/2002 | Inagaki |
| 2002/0008722 | A1 | 1/2002 | Imanaka et al. |
| 2002/0140750 | A1 * | 10/2002 | Yoshiyama ..... B41J 2/17566 347/7 |
| 2002/0175979 | A1 | 11/2002 | Morita et al. |
| 2003/0007024 | A1 | 1/2003 | Fujimori |
| 2004/0017445 | A1 | 1/2004 | Kojima et al. |
| 2004/0057097 | A1 | 3/2004 | Huang et al. |
| 2004/0109039 | A1 | 6/2004 | Kojima et al. |
| 2005/0156984 | A1 | 7/2005 | Uejima et al. |
| 2006/0152539 | A1 | 7/2006 | Zhang et al. |
| 2007/0040858 | A1 | 2/2007 | Campbell et al. |
| 2007/0115314 | A1 | 5/2007 | Kondo et al. |
| 2007/0229626 | A1 | 10/2007 | Yano |
| 2008/0198188 | A1 | 8/2008 | Umeda |
| 2009/0040251 | A1 | 2/2009 | Motominami et al. |
| 2009/0115804 | A1 | 5/2009 | Cai et al. |
| 2009/0128839 | A1 | 5/2009 | Mori |
| 2009/0153846 | A1 | 6/2009 | Gan et al. |
| 2010/0182637 | A1 | 7/2010 | Tamura |
| 2011/0112472 | A1 | 5/2011 | Jacobson et al. |
| 2012/0097567 | A1 | 4/2012 | Zhao et al. |
| 2013/0293624 | A1 | 11/2013 | Lester et al. |
| 2013/0300786 | A1 | 11/2013 | Muyskens et al. |
| 2014/0022292 | A1 | 1/2014 | Jones et al. |
| 2014/0043384 | A1 | 2/2014 | Nakano et al. |
| 2014/0125007 | A1 | 5/2014 | Sakano et al. |
| 2014/0368564 | A1 | 12/2014 | Aznoe et al. |
| 2015/0256701 | A1 | 9/2015 | Kimura et al. |
| 2015/0365555 | A1 | 12/2015 | Kinoshita et al. |
| 2016/0279962 | A1 | 9/2016 | Ishida et al. |
| 2016/0298997 | A1 | 10/2016 | Tence et al. |
| 2017/0057240 | A1 | 3/2017 | Munakata |
| 2017/0234717 | A1 | 8/2017 | Tsuboi et al. |
| 2018/0126744 | A1 | 5/2018 | Moriyama et al. |
| 2018/0201492 | A1 | 7/2018 | Jung et al. |
| 2019/0009532 | A1 | 1/2019 | Koyano et al. |
| 2019/0391018 | A1 | 12/2019 | Dann |
| 2020/0034672 | A1 | 1/2020 | Konishi et al. |
| 2020/0122995 | A1 | 4/2020 | Chernov et al. |
| 2020/0171836 | A1 | 6/2020 | Gardner et al. |
| 2020/0240826 | A1 | 7/2020 | Vaughan et al. |
| 2020/0254754 | A1 | 8/2020 | Netsu |
| 2020/0254768 | A1 | 8/2020 | Netsu |
| 2020/0254770 | A1 | 8/2020 | Netsu |
| 2020/0254771 | A1 | 8/2020 | Netsu et al. |
| 2020/0254772 | A1 | 8/2020 | Netsu |
| 2020/0254773 | A1 | 8/2020 | Netsu |
| 2020/0254774 | A1 | 8/2020 | Netsu |
| 2020/0254775 | A1 | 8/2020 | Netsu |
| 2021/0053355 | A1 | 2/2021 | Usuda et al. |
| 2021/0053356 | A1 | 2/2021 | Netsu et al. |
| 2021/0053357 | A1 | 2/2021 | Netsu et al. |
| 2021/0053358 | A1 | 2/2021 | Netsu et al. |

FOREIGN PATENT DOCUMENTS

| | | | |
|---|---|---|---|
| EP | 2 815 884 | A1 | 12/2014 |
| JP | H07-237300 | A | 9/1995 |
| JP | 2001-105627 | A | 4/2001 |
| JP | 2002-292892 | A | 10/2002 |
| JP | 2005-186388 | A | 7/2005 |
| WO | 2009/016614 | A2 | 2/2009 |

* cited by examiner

PRINTER

The present application is based on, and claims priority from JP Application Serial Number 2020-046231, filed Mar. 17, 2020, the disclosure of which is hereby incorporated by reference herein in its entirety.

BACKGROUND

1. Technical Field

The present disclosure relates to a printer or the like.

2. Related Art

In the related art, there is known a method for determining a presence or absence of ink in an ink container in a printer performing printing by using ink. For example, in JP-A-2001-105627, an ink supply apparatus that detects a liquid level of ink by receiving light emitted from a light emitter and passing through an ink bottle by using a light receiver is disclosed.

Further improvement of a printer is required. For example, the accuracy of the ink amount detection processing may decrease due to a change in the characteristic of the light source that irradiates the ink tank with light, but methods in the related art such as JP-A-2001-105627 do not disclose a method coping with the change.

SUMMARY

According to an aspect of the present disclosure, there is provided a printer including: an ink tank; a print head performing printing by using ink in the ink tank; a light source irradiating an inside of the ink tank with light; a sensor detecting light incident from the ink tank during a period in which the light source emits light; and a processing section detecting an amount of ink in the ink tank based on an output of the sensor, in which the light source is turned on by an amount of light based on a result of the sensor detecting light reflected from an area where the ink does not exist.

DESCRIPTION OF EXEMPLARY EMBODIMENTS

Hereinafter, the present embodiments will be described. The present embodiments described below do not unduly limit the content described in claims. Also, not all configurations described in the present embodiment are essential configuration requirements. The plurality of embodiments described below may be combined with each other or interchanged.

Figure 1:
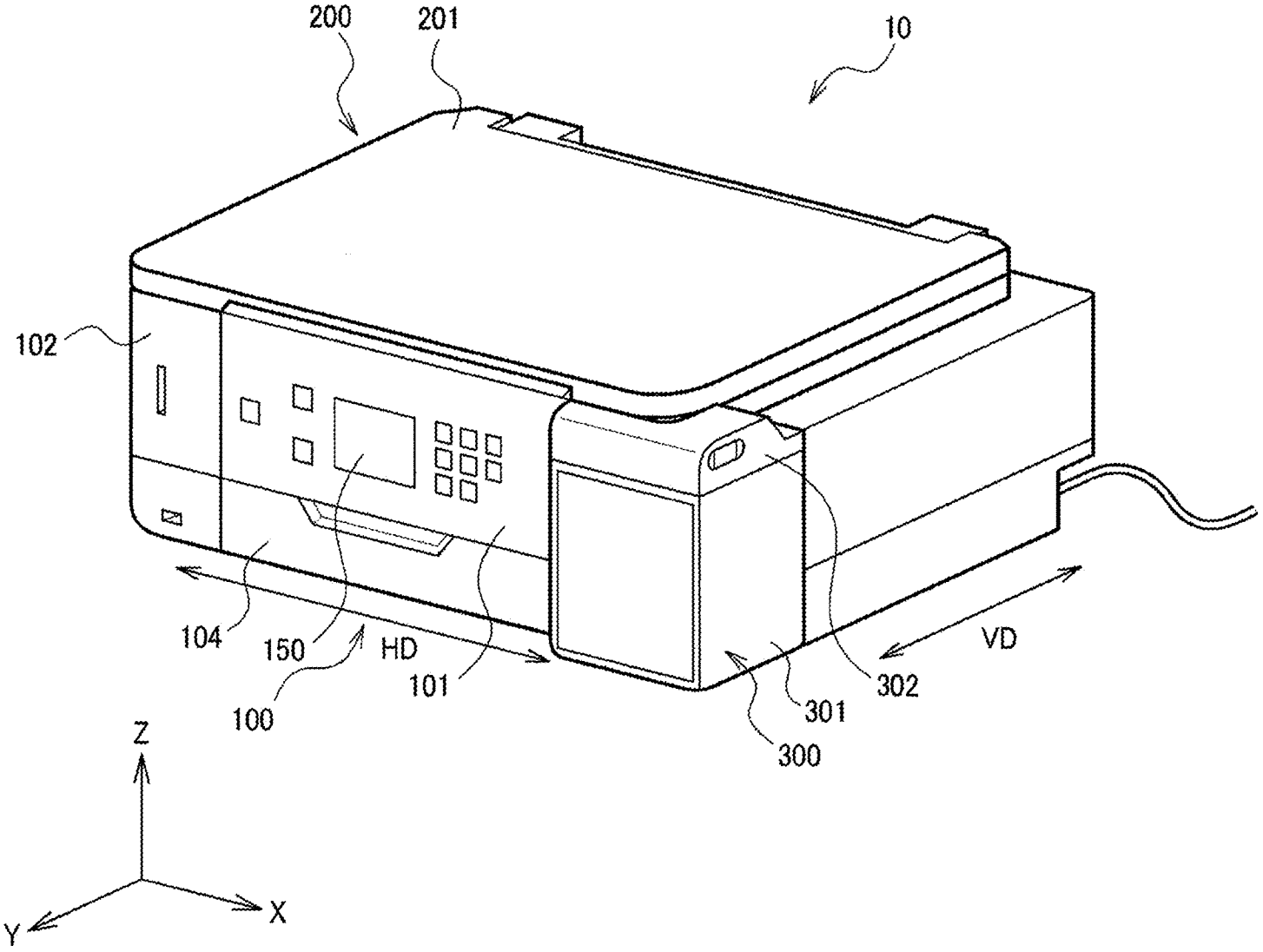
FIG. 1 is a perspective diagram illustrating a configuration of an electronic apparatus.

1. Configuration Example of Electronic Apparatus 1.1 Basic Configuration of Electronic Apparatus FIG. 1 is a perspective diagram of an electronic apparatus 10 according to the present embodiment. The electronic apparatus 10 is a multifunction peripheral (MFP) including a printer unit 100 and a scanner unit 200. The electronic apparatus 10 may have other functions such as a facsimile function in addition to a printing function and a scanning function. Alternatively, only the printing function may be provided. The electronic apparatus 10 includes an ink tank unit 300 that accommodates ink tanks 310. The printer unit 100 is an ink jet printer which executes printing by using ink supplied from the ink tanks 310. Hereinafter, the description of the electronic apparatus 10 can be appropriately replaced with a printer.

FIG. 1 shows a Y-axis, an X-axis orthogonal to the Y-axis, and a Z-axis orthogonal to the X-axis and the Y-axis. In each of the XYZ axes, a direction of an arrow indicates a positive direction, and a direction opposite to the direction of the arrow indicates a negative direction. Hereinafter, the positive direction of the X-axis is described as +X direction and the negative direction is described as −X direction. The same applies to the Y-axis and the Z-axis. The electronic apparatus 10 is disposed on a horizontal plane defined by the X-axis and the Y-axis in a use state, and the +Y direction is the front of the electronic apparatus 10. The Z-axis is an axis orthogonal to the horizontal plane, and −Z direction is vertically downward direction.

The electronic apparatus 10 has an operation panel 101 as a user interface section. The operation panel 101 is provided with buttons for performing, for example, an ON/OFF operation of a power supply of the electronic apparatus 10, an operation related to printing using the printing function, and an operation related to reading of a document using the scanning function. The operation panel 101 is also provided with a display section 150 for displaying an operating state of the electronic apparatus 10 and a message or the like. Further, the display section 150 displays the ink amount detected by the method described later. Further, the operation panel 101 may be provided with a reset button for the user to replenish ink in the ink tank 310 to execute reset processing.

1.2 Printer Unit and Scanner Unit

A printer unit 100 performs printing on a printing medium P such as printing paper by ejecting ink. The printer unit 100 has a case 102 which is an outer shell of the printer unit 100. On a front side of the case 102, a front cover 104 is provided. Here, the "front" represents a surface on which the operation panel 101 is provided and represents a surface in +Y direction of the electronic apparatus 10. The operation panel 101 and the front cover 104 are rotatable around the X-axis with respect to the case 102. The electronic apparatus 10 includes a paper cassette (not illustrated), and the paper cassette is provided in the −Y direction with respect to the front cover 104. The paper cassette is coupled to the front cover 104 and detachably attached to the case 102. A paper discharge tray (not illustrated) is provided in the +Z direction of the paper cassette, and the paper discharge tray can be expanded and contracted in the +Y direction and the −Y direction. The paper discharge tray is provided in the −Y direction with respect to the operation panel 101 in the state illustrated in FIG. 1, and exposed to the outside by the rotation of the operation panel 101.

The X-axis is a main scanning axis HD of a print head 107, and the Y-axis is a sub-scanning axis VD of the printer unit 100. A plurality of printing media P are placed in a stacked state on the paper cassette. The printing media P placed on the paper cassette are supplied one by one into the case 102 along the sub-scanning axis VD, printed by the printer unit 100, discharged along the sub-scanning axis VD, and placed on the paper discharge tray.

The scanner unit 200 is mounted on the printer unit 100. The scanner unit 200 has a case 201. The case 201 constitutes the outer shell of the scanner unit 200. The scanner unit 200 is of a flat bed type and has a document table formed of a transparent plate-like member such as glass and an image sensor. The scanner unit 200 reads an image or the like recorded on a medium such as paper as image data via an image sensor. The electronic apparatus 10 may be provided with an automatic document feeder (not illustrated). The scanner unit 200 sequentially feeds a plurality of stacked documents while reversing them one by one by the automatic document feeder, and reads them by using the image sensor.

1.3 Ink Tank Unit and Ink Tank

The ink tank unit 300 has a function of supplying ink IK to the print head 107 included in the printer unit 100. The ink tank unit 300 includes a case 301, and the case 301 has a lid 302. A plurality of ink tanks 310 are accommodated in the case 301.

Figure 2:
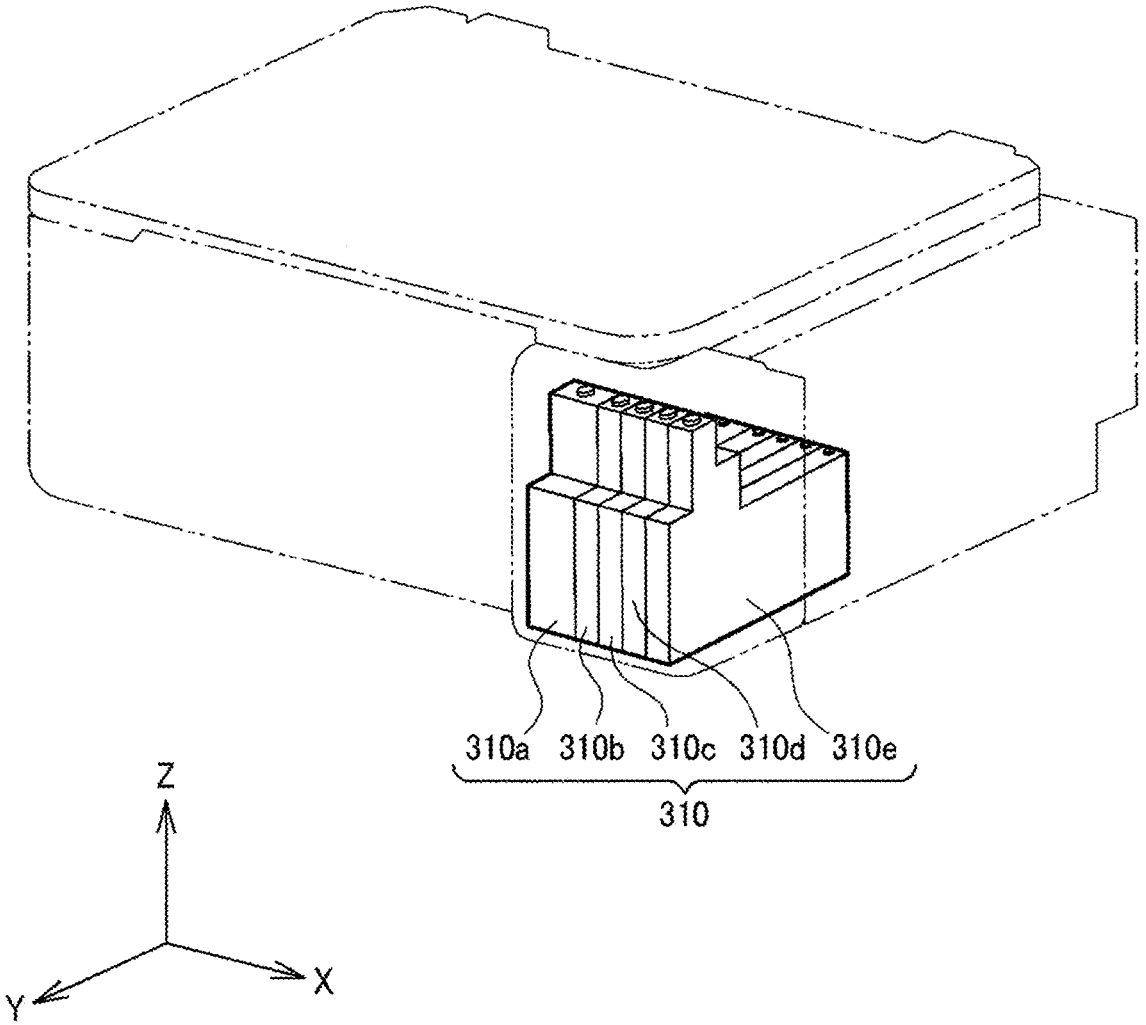
FIG. 2 is a diagram for explaining an arrangement of ink tanks in an electronic apparatus.

FIG. 2 is a diagram illustrating a state of the ink tanks 310 being accommodated. A portion indicated by a solid line in FIG. 2 represents the ink tanks 310. A plurality of inks IK of different kinds are individually accommodated in the plurality of ink tanks 310. That is, different kinds of inks IK are accommodated in the plurality of ink tanks 310 for each ink tank 310.

In the example illustrated in FIG. 2, the ink tank unit 300 accommodates five ink tanks 310*a*, 310*b*, 310*c*, 310*d*, and 310*e*. In the present embodiment, five kinds of inks are adopted, as the kinds of inks: two kinds of black inks, color inks of yellow, magenta, and cyan. Two kinds of black inks are pigment ink and dye ink. Ink IKa which is black pigment ink is accommodated in the ink tank 310*a*. The respective color inks IKb, IKc, and IKd of yellow, magenta, and cyan are accommodated in the ink tanks 310*b*, 310*c*, and 310*d*. Ink IKe which is a black dye ink is accommodated in an ink tank 310*e*.

The ink tanks 310*a*, 310*b*, 310*c*, 310*d*, and 310*e* are provided so as to be arranged in this order along the +X direction, and fixed in the case 301. Hereinafter, when the five ink tanks 310*a*, 310*b*, 310*c*, 310*d*, and 310*e* and the five kinds of inks IKa, IKb, IKc, IKd, and IKe are not distinguished, they are simply expressed as the ink tank 310 and the ink IK.

In the present embodiment, ink IK is configured to be able to be filled into the ink tank 310 from the outside of the electronic apparatus 10 for each of the five ink tanks 310. Specifically, the user of the electronic apparatus 10 fills to replenish ink IK accommodated in another container into the ink tank 310.

In the present embodiment, the capacity of the ink tank 310*a* is larger than the capacities of the ink tanks 310*b*, 310*c*, 310*d*, and 310*e*. The capacities of the ink tanks 310*b*, 310*c*, 310*d*, and 310*e* are the same as each other. In the printer unit 100, it is assumed that the black pigment ink IKa is consumed more than the color inks IKb, IKc, IKd, and the black dye ink IKe. The ink tank 310*a* accommodating the black pigment ink IKa is disposed at a position close to the center of the electronic apparatus 10 on the X-axis. By doing so, for example, when the case 301 has a window portion for allowing the user to visually recognize the side surface of the ink tank 310, the remaining amount of ink that is frequently used is easily confirmed. However, the arrangement order of the five ink tanks 310*a*, 310*b*, 310*c*, 310*d*, and 310*e* is not particularly limited. When any one of the other inks IKb, IKc, IKd, and IKe is consumed more than the black pigment ink IKa, the ink IK may be accommodated in the ink tank 310*a* of a large capacity.

Figure 3:
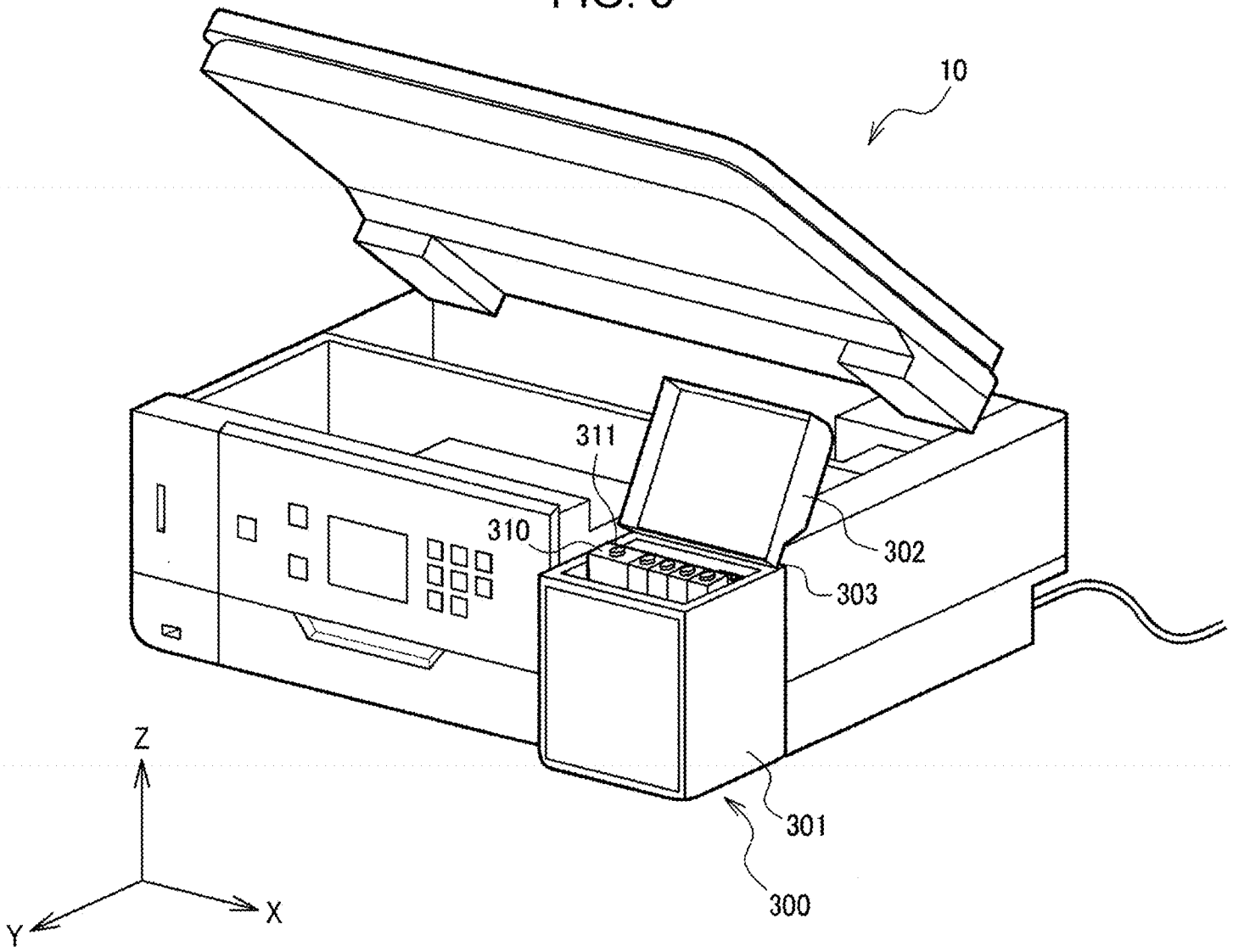
FIG. 3 is a perspective diagram of an electronic apparatus in a state where a lid of an ink tank unit is opened.

FIG. 3 is a perspective diagram of the electronic apparatus 10 in a state where the lid 302 of the ink tank unit 300 is opened. The lid 302 is rotatable with respect to the case 301 via a hinge portion 303. When the lid 302 is opened, five ink tanks 310 are exposed. More specifically, five caps corresponding to each ink tank 310 are exposed by opening the lid 302, and a portion of the ink tank 310 in the +Z direction is exposed by opening the caps. A portion of the ink tank 310 in the +Z direction is an area including an ink filling port 311 of the ink tank 310. When the ink IK is filled into the ink tank 310, the user accesses the ink tank 310 by rotating the lid 302 and opening it upward.

Figure 4:
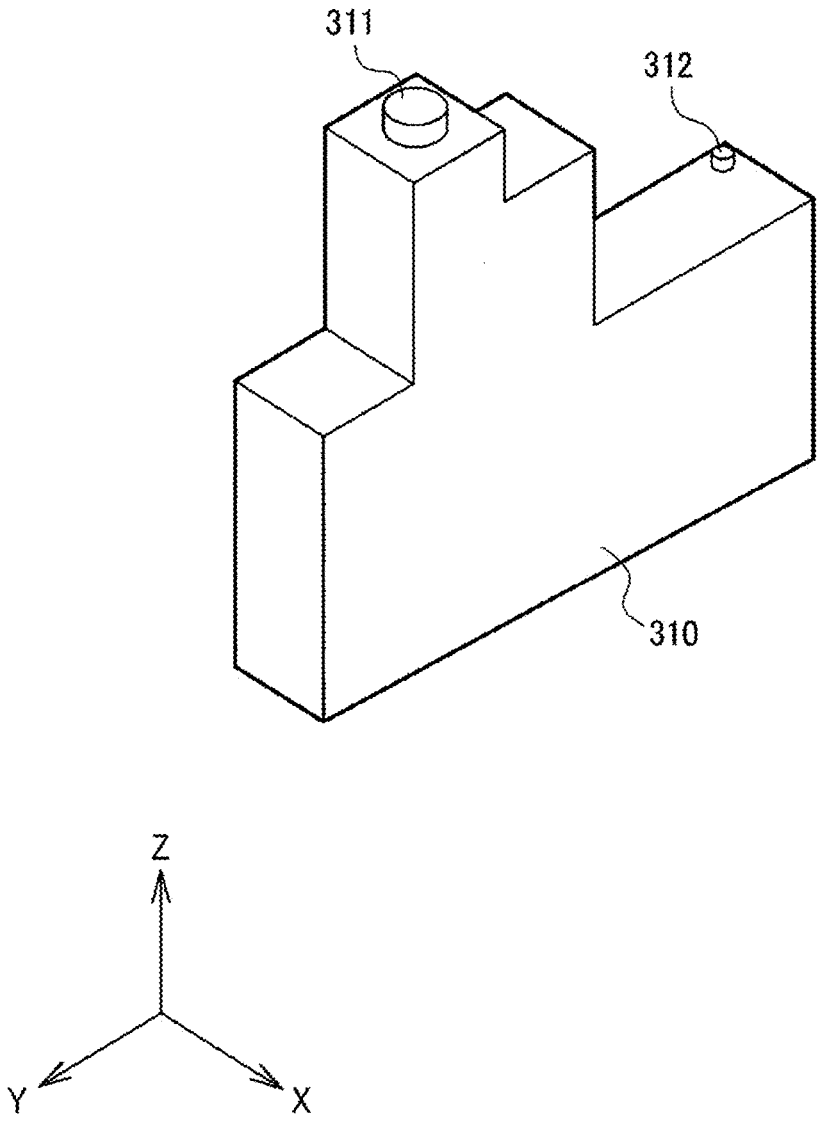
FIG. 4 is a perspective diagram illustrating a configuration of an ink tank.

FIG. 4 is a diagram illustrating the configuration of the ink tank 310. Each axis of X, Y, and Z in FIG. 4 represents an axis in a state where the electronic apparatus 10 is used in a normal posture and the ink tank 310 is appropriately fixed to the case 301. Specifically, the X-axis and the Y-axis are axes along the horizontal direction, and the Z-axis is an axis along a vertical direction. For each axis of XYZ, unless otherwise specified, the same shall apply in the following drawings. The ink tank 310 is a three-dimensional body in which the ±X direction is a short side direction and the ±Y direction is a longitudinal direction. Hereinafter, of the surfaces of the ink tank 310, a surface in the +Z direction is referred to as an upper surface, a surface in the −Z direction is referred to as a bottom surface, and surfaces in the ±X direction and ±Y direction are referred to as side surfaces. The side surface corresponds to the first ink tank wall 316 to the fourth ink tank wall 319, which will be described later.

The ink tank 310 is formed of a synthetic resin such as nylon or polypropylene, for example. Alternatively, the ink tank 310 may be formed of acrylic or the like having a high transmittance. Further, as will be described later with reference to FIG. 22, a background plate 330 may be provided inside the ink tank 310, and various modifications can be made to the specific material, shape, and configuration of the ink tank 310.

When the ink tank unit 300 includes a plurality of ink tanks 310 as described above, each of the plurality of ink tanks 310 may be configured separately or may be configured integrally. When the ink tank 310 is integrally configured, the ink tank 310 may be integrally formed, or a plurality of ink tanks 310 formed separately may be integrally bundled or coupled together.

The ink tank 310 includes a filling port 311 into which ink IK is filled by the user, and a discharging port 312 for discharging the ink IK toward the print head 107. In the present embodiment, the upper surface of the portion on the +Y direction side that is a front side of the ink tank 310 is higher than the upper surface of the portion on the −Y direction side that is a rear side. The filling port 311 for filling ink IK from the outside is provided on the upper surface of the portion on the front side of the ink tank 310. The filling port 311 is exposed by opening the lid 302 and the cap as described above with reference to FIG. 3. The ink IK of each color can be replenished to the ink tank 310 by filling the ink IK from the filling port 311 by the user. The ink IK for the user to replenish the ink tank 310 is accommodated and provided in a separate replenishing container. The discharging port 312 for supplying ink to the print head 107 is provided on the upper surface of the portion on the rear side of the ink tank 310. Since the filling port 311 is provided on the side close to the front of the electronic apparatus 10, filling of the ink IK can be facilitated.

1.4 Other Configurations of Electronic Apparatus

Figure 5:
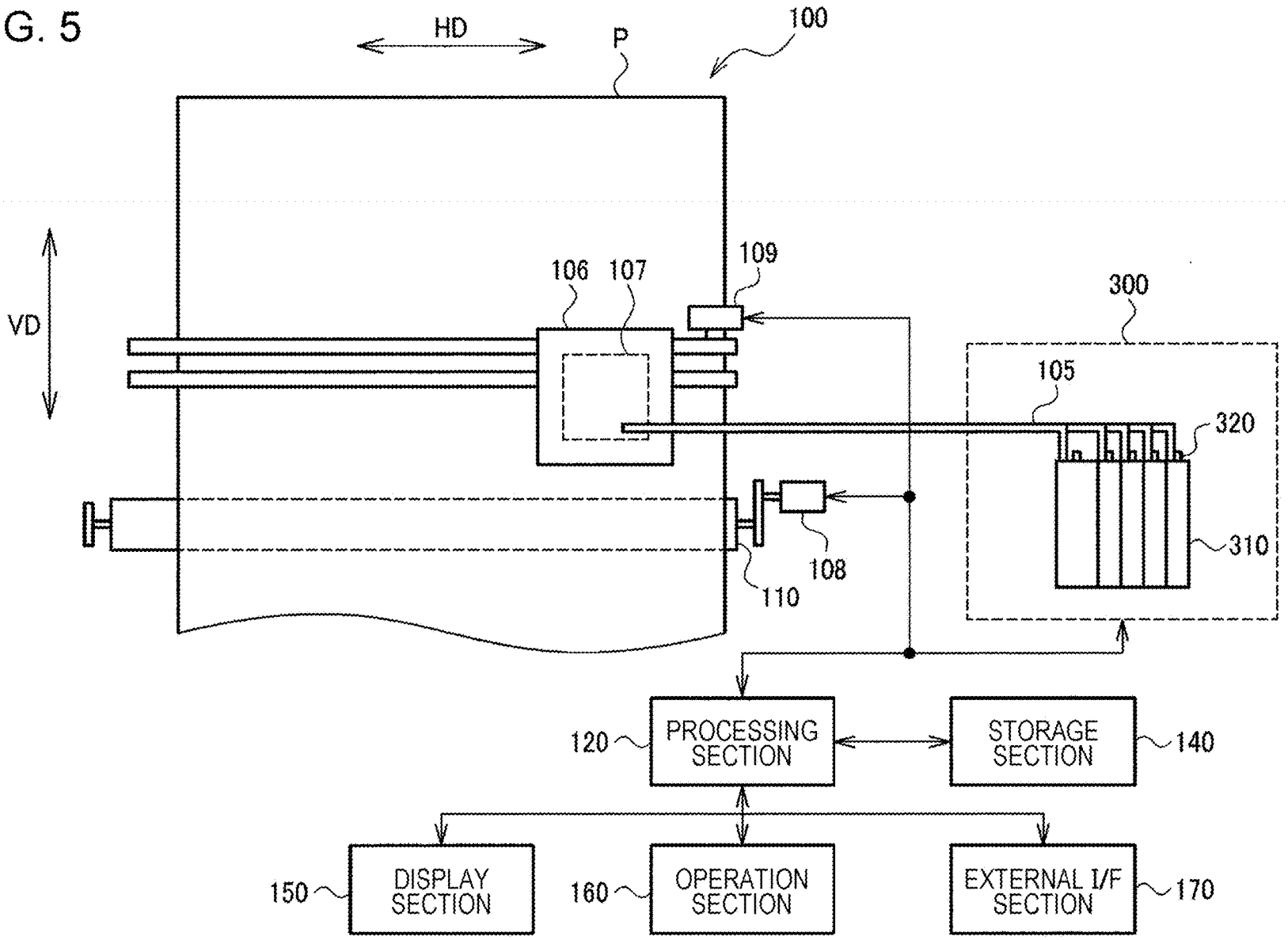
FIG. 5 is a diagram illustrating a configuration example of a printer unit and an ink tank unit.

FIG. 5 is a schematic configuration diagram of the electronic apparatus 10 according to the present embodiment. As illustrated in FIG. 5, the printer unit 100 according to the present embodiment includes a carriage 106, a paper feed motor 108, a carriage motor 109, a paper feed roller 110, a processing section 120, a storage section 140, a display section 150, an operation section 160, and an external I/F section 170. In FIG. 5, the specific configuration of the scanner unit 200 is omitted. FIG. 5 is a diagram exemplifying a coupling relationship between each part of the printer unit 100 and the ink tank unit 300, and does not limit the physical structure or the positional relationship of each part. For example, in the arrangement of members such as the ink tank 310, the carriage 106, and a tube 105 in the electronic apparatus 10, various embodiments can be considered.

A print head 107 is mounted on the carriage 106. The print head 107 has a plurality of nozzles for ejecting ink IK in the −Z direction on the bottom surface side of the carriage 106. The tube 105 is provided between the print head 107 and each ink tank 310. Each ink IK in the ink tank 310 is sent to the print head 107 via the tube 105. The print head 107 ejects each ink IK sent from the ink tanks 310 to the printing medium P from the plurality of nozzles as ink droplets.

The carriage 106 is driven by the carriage motor 109 to reciprocate along the main scanning axis HD on the printing medium P. The paper feed motor 108 rotationally drives the paper feed roller 110 to transport the printing medium P along the sub-scanning axis VD. The ejection control of the print head 107 is performed by the processing section 120 via a cable.

In the printer unit 100, printing is performed on the printing medium P by the carriage 106 ejecting the ink IK from the plurality of nozzles of the print head 107 to the printing medium P transported to the sub-scanning axis VD while moving along the main scanning axis HD, based on the control of the processing section 120.

One end portion of the carriage 106 on the main scanning axis HD in a moving area is a home position area where the carriage 106 stands by. In the home position area, for example, a cap or the like (not illustrated) for performing maintenance such as cleaning the nozzle of the print head 107 is disposed. Also, a waste ink box for receiving waste ink when flushing or cleaning of the print head 107 is performed is disposed in the moving area of the carriage 106. The flushing means that ink IK is ejected from each nozzle of the print head 107 regardless of printing during printing of the printing medium P. The cleaning means cleaning the inside of the print head by sucking the print head by a pump or the like provided in the waste ink box, without driving the print head 107.

Here, an off-carriage type printer in which the ink tank 310 is provided at a location different from the carriage 106 is assumed. However, the printer unit 100 may be an on-carriage type printer in which the ink tank 310 is mounted on the carriage 106 and moved along the main scanning axis HD together with the print head 107. The on-carriage type printer will be described later with reference to FIG. 17.

The operation section 160 and the display section 150 as a user interface section are coupled to the processing section 120. The display section 150 is for displaying various display screens and can be realized by, for example, a liquid crystal display or an organic EL display. The operation section 160 is for the user to perform various operations and can be realized by various buttons, GUI, or the like. For example, as illustrated in FIG. 1, the electronic apparatus 10 includes the operation panel 101, and the operation panel 101 includes a display section 150 and a button or the like as the operation section 160. The display section 150 and the operation section 160 may be integrally configured by a touch panel. When the user operates the operation panel 101, the processing section 120 operates the printer unit 100 and the scanner unit 200.

For example, in FIG. 1, the user operates the operation panel 101 to start operation of the electronic apparatus 10 after setting a document on a document table of the scanner unit 200. Then, the document is read by the scanner unit 200. Subsequently, based on the image data of the read document, the printing medium P is fed from the paper cassette into the printer unit 100, and printing is performed on the printing medium P by the printer unit 100.

An external device can be coupled to the processing section 120 via the external I/F section 170. The external device here is, for example, a personal computer (PC). The processing section 120 receives the image data from the external device via the external I/F section 170, and performs control for printing the image on the printing medium P by the printer unit 100. In addition, the processing section 120 controls the scanner unit 200 to read the document and transmit the image data as a reading result to the external device via the external I/F section 170, or to print the image data as the reading result.

The processing section 120 performs, for example, drive control, consumption calculation processing, ink amount detection processing, and ink type determination processing. The processing section 120 of the present embodiment is configured by the following hardware. The hardware can include at least one of a circuit for processing a digital signal and a circuit for processing an analog signal. For example, the hardware can be configured by one or more circuit devices mounted on the circuit substrate or one or more circuit elements. The one or more circuit devices are, for example, ICs or the like. The one or more circuit elements are, for example, resistances, capacitors, or the like.

The processing section 120 may be realized by the following processor. The electronic apparatus 10 of the present embodiment includes a memory that stores information, and a processor that operates based on information stored in the memory. The information is, for example, a program and various kinds of data. The processor includes hardware. As the processor, various processors such as a central processing unit (CPU), graphics processing unit (GPU), digital signal processor (DSP), or the like can be used. The memory may be semiconductor memory such as static random access memory (SRAM), dynamic random access memory (DRAM), or the like, and may be a register, or a magnetic storage device such as a hard disk device, or may be an optical storage device such as an optical disk device or the like. For example, the memory stores an instruction that can be read by a computer, and the function of each section of the electronic apparatus 10 is realized as processing by executing the instruction by the processor. The instruction here may be an instruction of an instruction set constituting the program or an instruction for instructing the operation to the hardware circuit of the processor.

The processing section 120 controls the carriage motor 109 to perform drive control for moving the carriage 106. Based on the drive control, the carriage motor 109 drives to move the print head 107 provided on the carriage 106.

The processing section 120 performs the consumption calculation processing of calculating a consumption of ink consumed by ejecting the ink IK from each nozzle of the print head 107. The processing section 120 starts the consumption calculation processing with the state where each ink tank 310 is filled with the ink IK as an initial value. More specifically, when the user replenishes the ink IK to the ink tank 310 and presses a reset button, the processing section 120 initializes a count value of the ink consumption with respect to the ink tank 310. Specifically, the count value of the ink consumption is set to 0. The processing section 120 starts the consumption calculation processing with the pressing operation of the reset button as a trigger.

The processing section 120 performs ink amount detection processing of detecting the amount of ink IK accommodated in the ink tank 310, based on the output of a sensor unit 320 provided corresponding to the ink tank 310. The processing section 120 performs ink type determination processing of determining the type of the ink IK accommodated in the ink tank 310, based on the output of the sensor unit 320 provided corresponding to the ink tank 310. Details of the ink amount detection processing and ink type determination processing are described later.

1.5 Detailed Configuration Example of Sensor Unit

Figure 6:
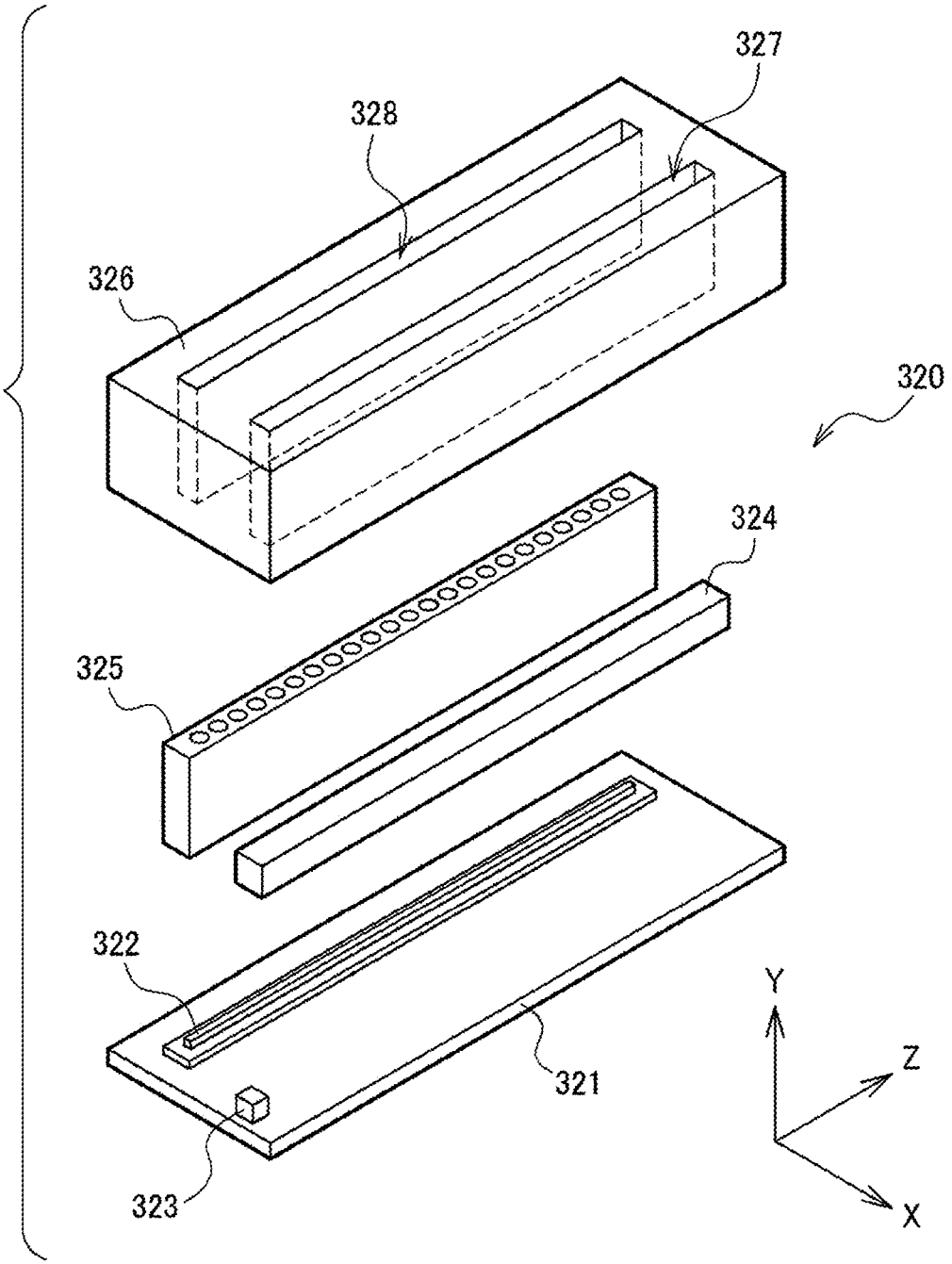
FIG. 6 is an exploded diagram of a sensor unit.

FIG. 6 is an exploded perspective diagram schematically showing the configuration of the sensor unit 320. The sensor unit 320 includes a substrate 321, a photoelectric conversion device 322, a light source 323, a light guide 324, a lens array 325, and a case 326.

The light source 323 and the photoelectric conversion device 322 are mounted on the substrate 321. The photoelectric conversion device 322 is a linear image sensor in which, for example, photoelectric conversion elements are arranged in a predetermined direction. The linear image sensor may be a sensor in which photoelectric conversion elements are arranged in one row or a sensor in which photoelectric conversion elements are arranged in two or more rows. The photoelectric conversion element is, for example, a photodiode (PD). A plurality of output signals based on a plurality of photoelectric conversion elements are acquired by using the linear image sensor. Therefore, not only the presence or absence of the ink IK but also a position of the liquid level can be estimated. Note that, the liquid level may be paraphrased as an interface.

The light source 323 has, for example, R, G, and B light emitting diodes (LED: Light emitting diode) and emits light sequentially while switching the R, G, and B light emitting diodes at high speed. The light emitting diode of R is represented as a red LED 323R, the light emitting diode of G is represented as a green LED 323G, and the light emitting diode of B is represented as a blue LED 323B. The light guide 324 is a rod-like member for guiding light, and the cross-sectional shape may be a square shape, a circular shape, or another shape. The longitudinal direction of the light guide 324 is a direction along the longitudinal direction of the photoelectric conversion device 322. Since light from the light source 323 goes out from the light guide 324, the light guide 324 and the light source 323 may be collectively referred to as a light source when it is not necessary to distinguish the light guide 324 and the light source 323.

The light source 323, the light guide 324, the lens array 325, and the photoelectric conversion device 322 are accommodated between the case 326 and the substrate 321. The case 326 is provided with a first opening portion 327 for a light source and a second opening portion 328 for a photoelectric conversion device. Light emitted from the light source 323 enters the light guide 324, thereby the entire light guide emits light. Light emitted from the light guide 324 is emitted to the outside of the case 326 through the first opening portion 327. Light from the outside is inputted to the lens array 325 through the second opening portion 328. The lens array 325 guides the input light to the photoelectric conversion device 322. Specifically, the lens array 325 is a Selfoc lens array (Selfoc is a registered trademark) in which many refractive index distribution type lenses are arranged.

Figure 7:
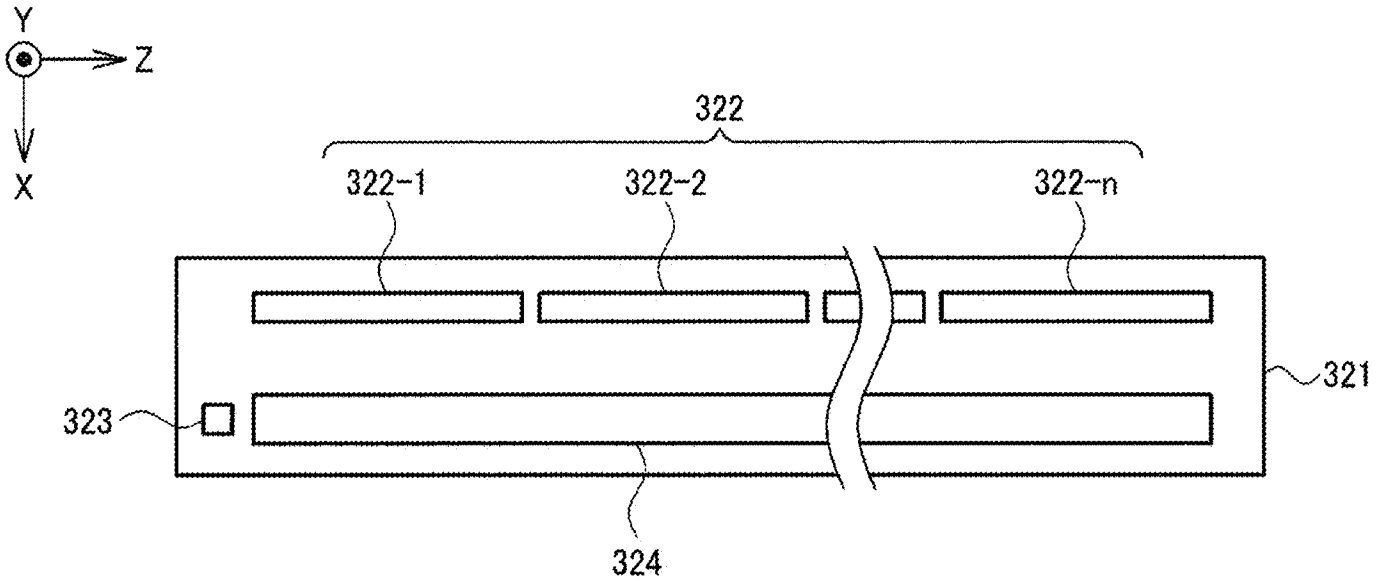
FIG. 7 is a diagram illustrating a positional relationship between a substrate, a photoelectric conversion device, and a light source.

FIG. 7 is a diagram schematically illustrating the arrangement of the photoelectric conversion devices 322. As illustrated in FIG. 7, n, n being an integer of 1 or more, photoelectric conversion devices 322 are arranged along a given direction on the substrate 321 side by side. Here, n may be 2 or more as illustrated in FIG. 7. That is, the sensor unit 320 includes a second linear image sensor provided on the longitudinal direction side of the linear image sensor. The linear image sensor is, for example, 322-1 in FIG. 7, and the second linear image sensor is 322-2. Each photoelectric conversion device 322 is a chip having many photoelectric conversion elements arranged side by side as described above. By using a plurality of photoelectric conversion devices 322, a range for detecting incident light is widened, thereby a target range for detecting the ink amount can be widened. However, the number of linear image sensors, that is, a setting of a target range for detecting the ink amount can be performed in various ways, and it is not prevented that there is only one linear image sensor.

Figure 8:
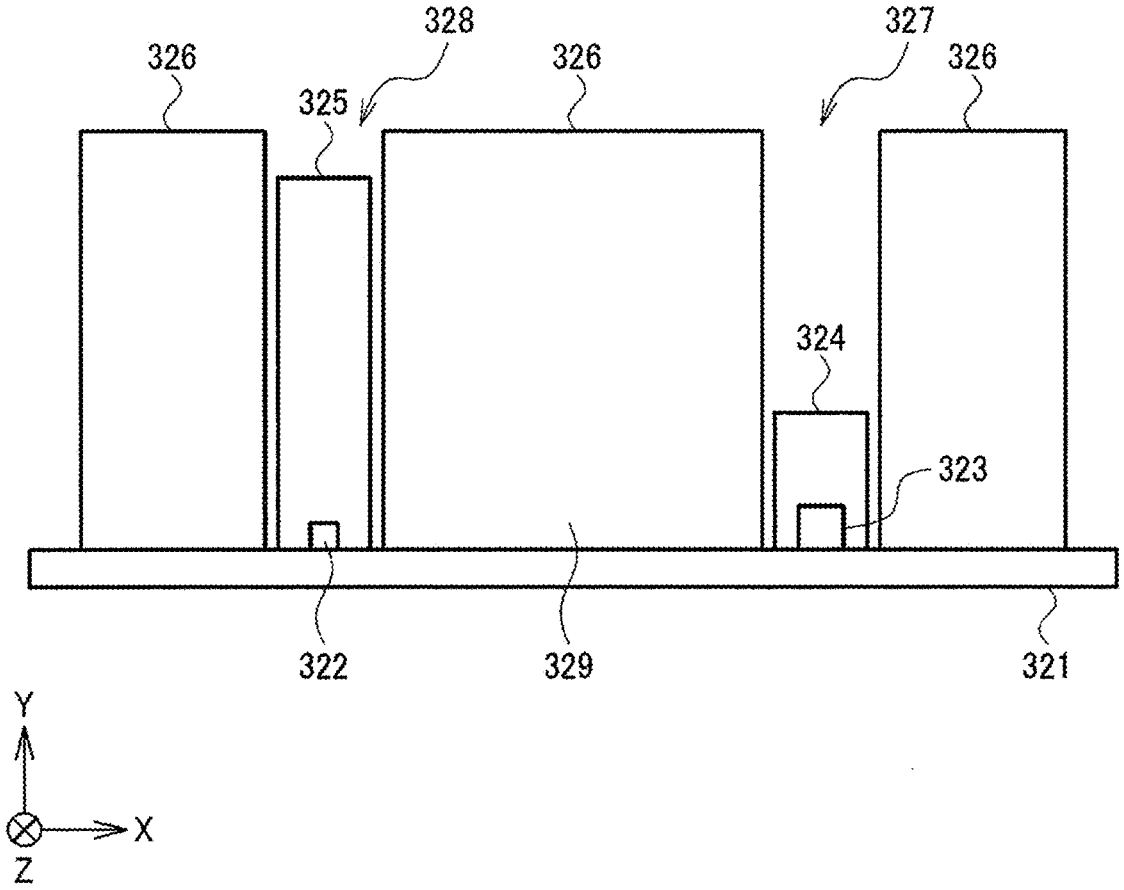
FIG. 8 is a cross-sectional diagram of a sensor unit.

FIG. 8 is a cross-sectional diagram schematically showing the arrangement of the sensor units 320. As can be seen from FIGS. 6 and 7, although the positions of the photoelectric conversion device 322 and the light source 323 do not overlap on the Z-axis, for convenience of describing the positional relationship with other members, the light source 323 is illustrated in FIG. 8. As illustrated in FIG. 8, the sensor unit 320 includes a light shielding wall 329 provided between the light source 323 and the photoelectric conversion device 322. The light shielding wall 329 is, for example, a portion of the case 326 and formed by extending a beam-like member between the first opening portion 327 and the second opening portion 328 to the substrate 321. The light shielding wall 329 shields direct light from the light source 323 toward the photoelectric conversion device 322. Since incidence of the direct light can be suppressed by providing the light shielding wall 329, detection accuracy of the ink amount can be enhanced. It is preferable that the light shielding wall 329 is capable of shielding direct light from the light source 323 toward the photoelectric conversion device 322, and the concrete shape is not limited to that in FIG. 8. A member separate from the case 326 is preferably used as the light shielding wall 329.

In consideration of the accurate detection of the ink amount, it is preferable that light emitted to the ink tank 310 be made to be approximately the same degree regardless of the position in the vertical direction. As will be described later, it is because, since the presence or absence of the ink IK appears as a difference in brightness, a variation in a light amount of the irradiation light leads to a reduction in an accuracy. Therefore, the sensor unit 320 has a light guide 324 disposed so that the longitudinal direction thereof is the vertical direction. The light guide 324 here is a rod-shaped light guide as described above. In consideration of uniformly illuminating the light guide 324, the light source 323 preferably enters the light guide 324 from the lateral direction, that is, the direction along the longitudinal direction of the light guide 324. Since the incident angle becomes large in this way, total reflection is easily generated.

Figure 9:
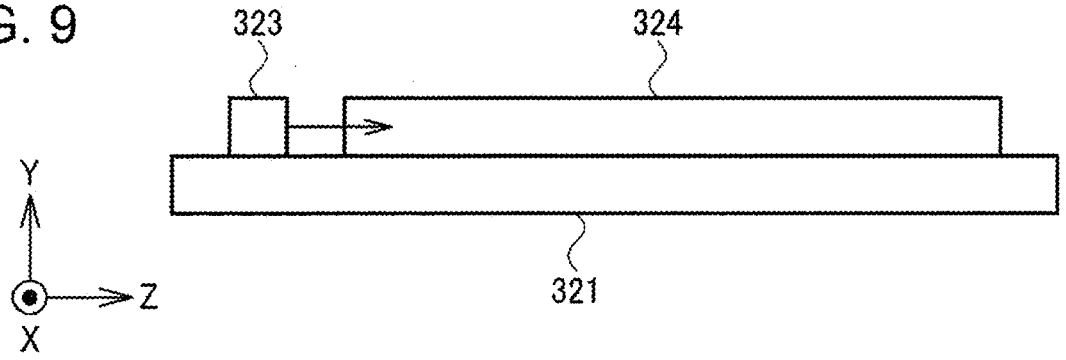
FIG. 9 is a diagram for explaining a positional relationship between a light source and a light guide.
Figure 10:
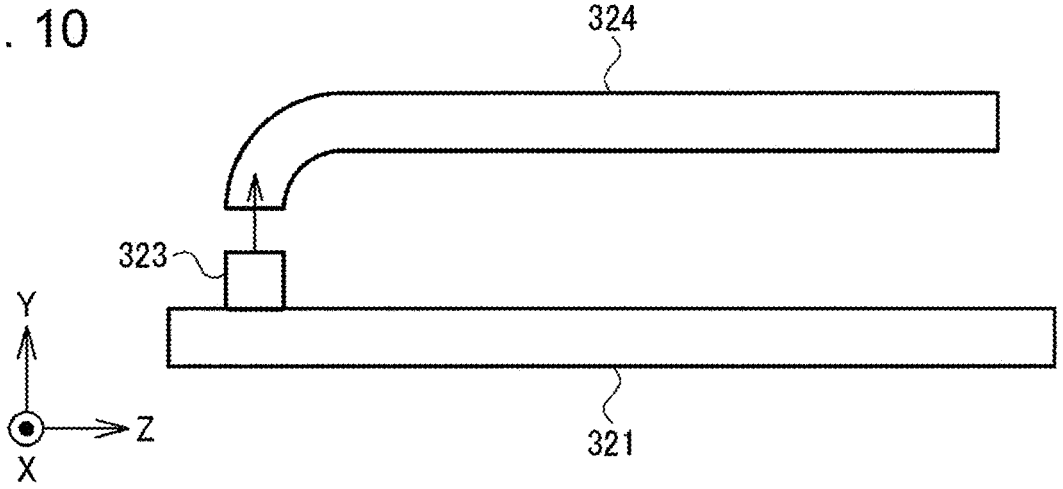
FIG. 10 is a diagram for explaining a positional relationship between a light source and a light guide.
Figure 11:
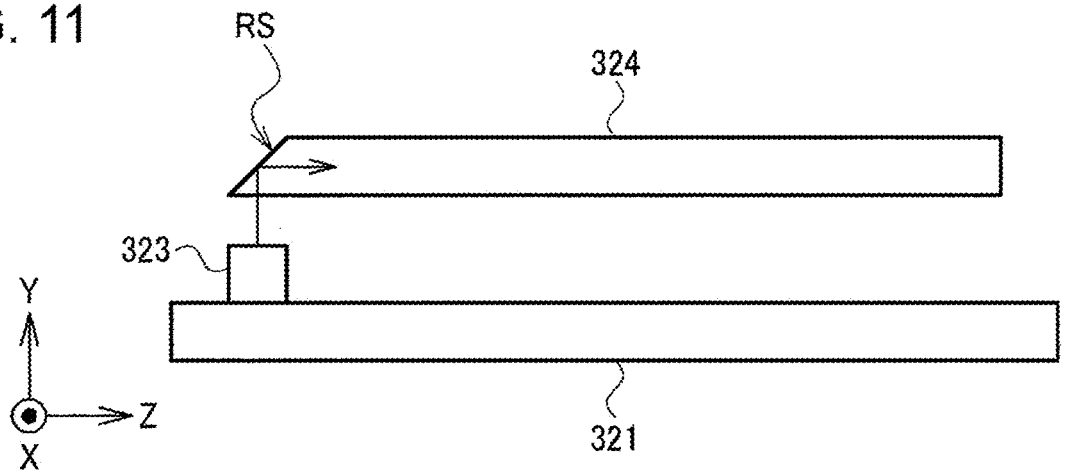
FIG. 11 is a diagram for explaining a positional relationship between a light source and a light guide.

FIGS. 9 to 11 are diagrams for explaining the positional relationship between the light source 323 and the light guide 324. For example, as illustrated in FIG. 9, the light source 323 and the light guide 324 may be provided so as to be arranged on the Z-axis. The light source 323 can guide light in the longitudinal direction of the light guide 324 by emitting light in the +Z direction. Alternatively, as illustrated in FIG. 10, the end of the light guide 324 on the light source side may be bent. In this way, the light source 323 can guide light in the longitudinal direction of the light guide 324 by emitting light in the direction perpendicular to the substrate 321. Alternatively, as illustrated in FIG. 11, a reflective surface RS may be provided at the end of the light guide 324 on the light source side. The light source 323 emits light in a direction perpendicular to the substrate 321. Light from the light source 323 is guided in the longitudinal direction of the light guide 324 by being reflected on the reflective surface RS. The light guide 324 according to the present embodiment can be widely applied to a known configuration such as providing a reflective plate on the −Y direction surface of the light guide 324 and changing the density of the reflective plate according to the position from the light source 323. The light source 323 may be provided in the +Z direction from the light guide 324, or the configuration of light sources 323 of the same color may be provided at both ends of the light guide 324, or the light source 323 and the light guide 324 may be variously modified.

Figure 12:
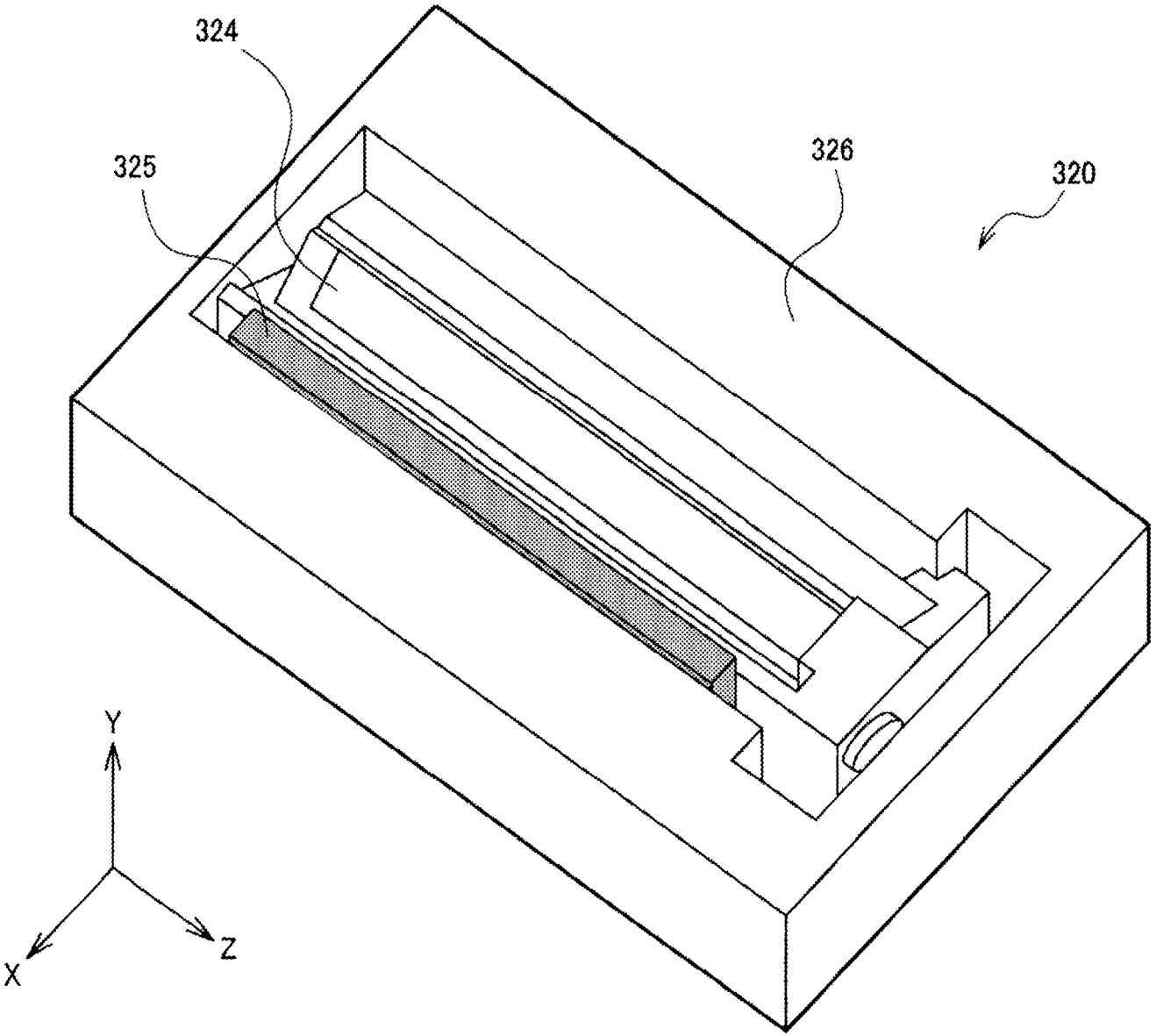
FIG. 12 is a perspective diagram illustrating another configuration of a sensor unit.
Figure 13:
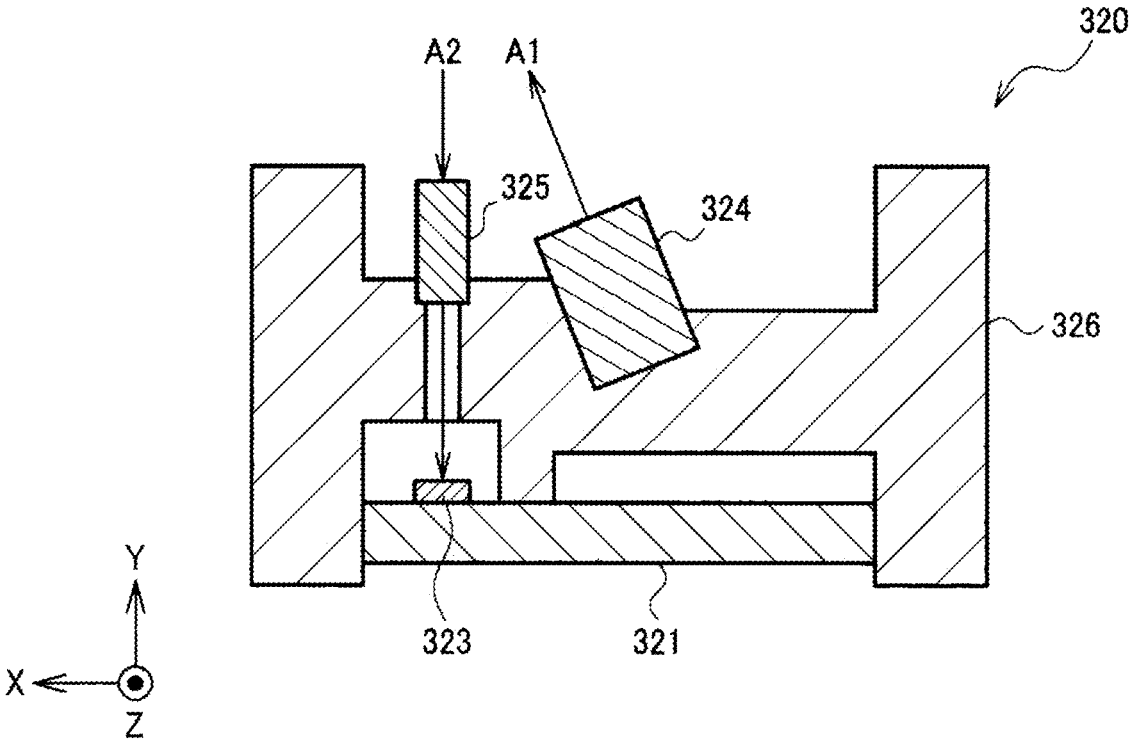
FIG. 13 is a cross-sectional diagram illustrating another configuration of a sensor unit.

FIG. 12 is a perspective diagram illustrating another configuration of a sensor unit 320. FIG. 13 is a cross-sectional diagram of the sensor unit 320 illustrated in FIG. 12. Similar to the example described above with reference to FIG. 6, the sensor unit 320 includes a substrate 321, a photoelectric conversion device 322, a light source 323, a light guide 324, a lens array 325, and a case 326.

As illustrated in FIGS. 12 and 13, the light irradiation surface of the light guide 324 may be provided obliquely with respect to the substrate surface of the substrate 321 on which the photoelectric conversion device 322 is provided. As illustrated in FIG. 13, the light guide 324 emits light from the light source 323 to a given range including a direction indicated by A1. The light emitted from the light guide 324 is reflected in the ink tank 310. As indicated by A2, the reflected light mainly in a direction orthogonal to the substrate surface of the substrate 321 is incident on the lens array 325, and the lens array 325 forms the reflected light on the photoelectric conversion device 322. In this way, it is possible to adjust the incident angle when the light from the light source 323 is incident on the ink tank 310. For example, in the embodiment in which the background plate 330 is provided inside the ink tank 310 as described later with reference to FIG. 22, the incident angle is set so that the light emitted from the light source 323 via the light guide 324 can reach the background plate 330.

Note that, the light source 323 is omitted in FIG. 12. For example, the light source 323 is provided on the substrate 321 and emits light in a direction orthogonal to the substrate surface of the substrate 321 as illustrated in FIG. 10 or FIG. 11. Alternatively, as illustrated in FIG. 9, the light source 323 and the light guide 324 may be provided so as to be arranged on the Z-axis, and the light source 323 may emit light in the +Z direction or the −Z direction. In this case, for example, a substrate for the light source 323 may be provided separately from the substrate 321.

1.6 Positional Relationship between Ink Tank and Sensor Unit

The sensor unit 320 may have a fixed relative positional relationship with, for example, the ink tank 310. For example, the sensor unit 320 is bonded to the ink tank 310. Alternatively, the fixing member may be provided on each of the sensor unit 320 and the ink tank 310, and the sensor unit 320 may be mounted on the ink tank 310 by the fixing members being fixed to each other by fitting or the like. Various modifications can be performed in the shape, material, or the like of the fixing member.

Figure 14:
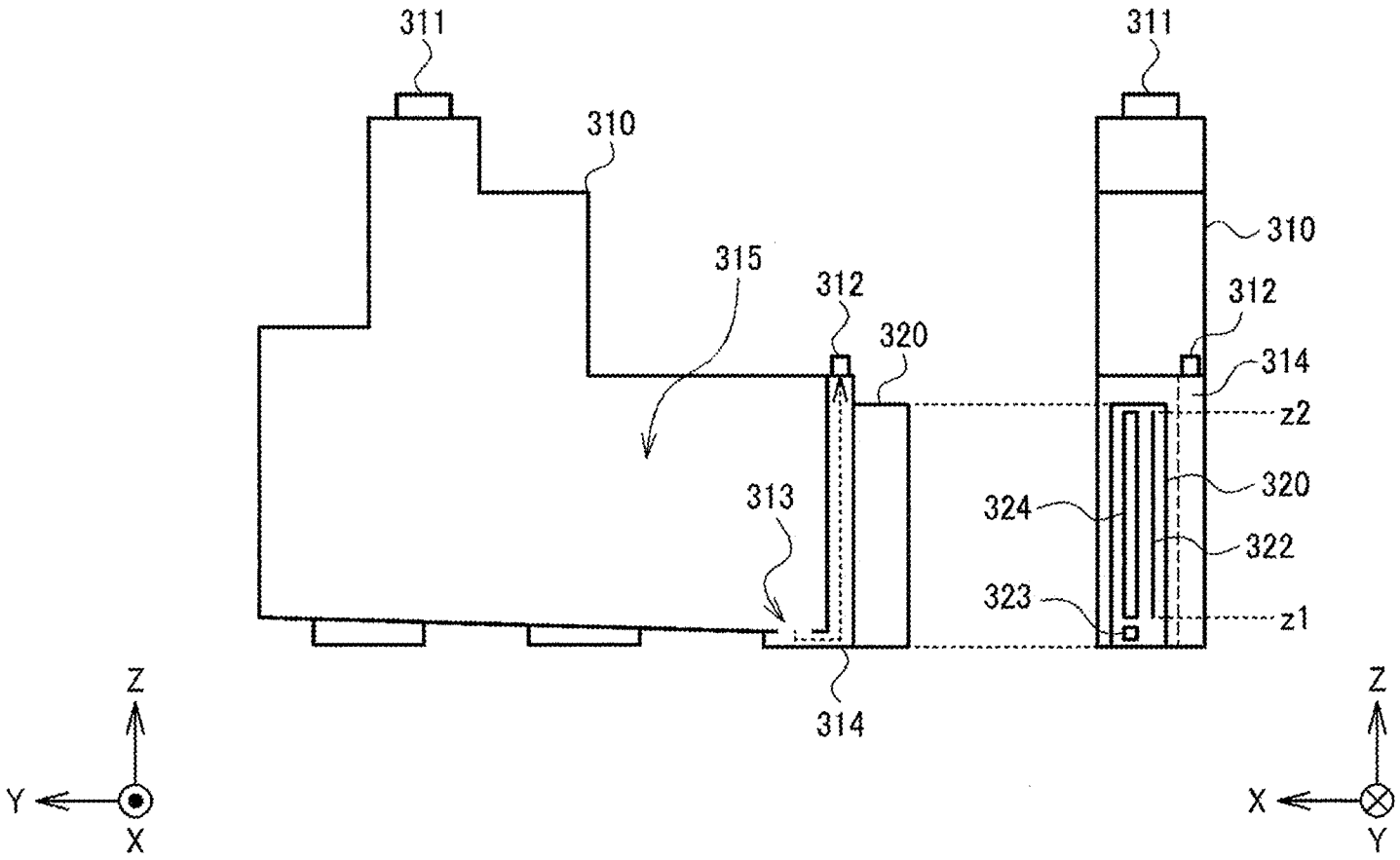
FIG. 14 is a diagram for explaining a positional relationship between an ink tank, a light source, and a photoelectric conversion device.

FIG. 14 is a diagram for explaining the positional relationship between the ink tank 310 and the sensor unit 320. As illustrated in FIG. 14, the sensor unit 320 is fixed to any wall surface of the ink tank 310 in such a posture that the longitudinal direction of the photoelectric conversion device 322 is the ±Z direction. That is, the photoelectric conversion device 322 as the linear image sensor is provided so that the longitudinal direction thereof is the vertical direction. Here, the vertical direction represents the gravity direction and the reverse direction when the electronic apparatus 10 is used in a proper attitude.

In the example illustrated in FIG. 14, the sensor unit 320 is fixed to the side surface of the ink tank 310 in the −Y direction. That is, the substrate 321 provided with the photoelectric conversion device 322 is closer to the discharging port 312 than the filling port 311 of the ink tank 310. Whether printing in the printer unit 100 can be executed depends on whether the ink IK is supplied to the print head 107. Therefore, by providing the sensor unit 320 on the discharging port 312 side, the ink amount detection processing can be performed for a position where the ink amount is particularly important in the ink tank 310.

As illustrated in FIG. 14, the ink tank 310 may include a main container 315, a second discharging port 313, and an ink flow path 314. The main container 315 is a portion of the ink tank 310 that is used for accommodating the ink IK. The second discharging port 313 is, for example, an opening provided at a position in the most −Z direction in the main container 315. However, various modifications can be performed for the position and shape of the second discharging port 313. For example, when suction by a suction pump or supply of pressurized air by a pressure pump is performed on the ink tank 310, ink IK accumulated in the main container 315 of the ink tank 310 is discharged from the second discharging port 313. The ink IK discharged from the second discharging port 313 is guided in the +Z direction by the ink flow path 314, and discharged from the discharging port 312 to the outside of the ink tank 310. In this case, as illustrated in FIG. 14, detection processing of the proper ink amount can be performed by setting the positional relationship in which the ink flow path 314 and the photoelectric conversion device 322 do not face each other. For example, the ink flow path 314 is provided at the end of the ink tank 310 in the −X direction, and the sensor unit 320 is provided in the +X direction from the ink flow path 314. In this way, the decrease in accuracy of the ink amount detection processing can be suppressed by the ink in the ink flow path 314. However, the discharging port 312 may be provided on the side surface or the bottom surface of the ink tank 310.

It is desirable that at least a portion of the inner wall of the ink tank 310 that faces the photoelectric conversion device 322 is higher in ink repellency than the outer wall of the ink tank 310. Of course, the entire inner wall of the ink tank 310 may be processed to enhance the ink repellency in comparison with the outer wall of the ink tank 310. The portion facing the photoelectric conversion device 322 may be the entire inner wall in the −Y direction of the ink tank 310 or a portion of the inner wall. Specifically, in the inner walls of the ink tank 310 in the −Y direction, the portion of the inner wall is an area including a portion where the position on the XZ plane overlaps the photoelectric conversion device 322. When an ink droplet adheres to the inner wall of the ink tank 310, the portion of the ink droplet becomes darker than a portion where no ink exists. Therefore, there is a possibility that the ink amount detection accuracy may be lowered due to the ink droplet. By enhancing the ink repellency of the inner wall of the ink tank 310, the adhesion of ink droplets can be suppressed.

The photoelectric conversion device 322 is provided in the range of z1 to z2, for example, in the Z-axis. The z1 and z2 are coordinate values on the Z-axis, and z1<z2. When the ink tank 310 is irradiated with light from the light source 323, absorption and scattering of light occur by the ink IK filled in the ink tank 310. Therefore, the portion of the ink tank 310 not filled with the ink IK becomes relatively bright, and the portion filled with the ink IK becomes relatively dark. For example, when the liquid level of the ink IK exists at the position of the coordinate value of z0 on the Z-axis, in the ink tank 310, the area of a Z coordinate value of z0 or less becomes dark and the area of a Z coordinate value of greater than z0 becomes bright.

As illustrated in FIG. 14, the position of the liquid level of the ink IK can be appropriately detected by providing the photoelectric conversion device 322 so that the longitudinal direction thereof is the vertical direction. Specifically, in the case of z1<z0<z2, the photoelectric conversion elements arranged at a position corresponding to the range of z1 to z0 out of the photoelectric conversion device 322 has a relatively small amount of light to be inputted. Therefore, the output value becomes relatively small. The photoelectric conversion elements arranged at a position corresponding to the range of z0 to z2 has a relatively large amount of light to be inputted, so that the output value becomes relatively large. That is, z0 which is the liquid level of the ink IK can be estimated based on the output of the photoelectric conversion device 322. It is possible to detect not only binary information related to whether the ink amount is equal to or more than a predetermined amount but also a specific liquid level position. When the position of the liquid level is known, the ink amount can be determined in units of milliliters or the like based on the shape of the ink tank 310. When the output value of the entire range of z1 to z2 is large, the liquid level can be determined to be lower than z1, and when the output value of the entire range of z1 to z2 is small, the liquid level can be determined to be higher than z2. The range where the ink amount can be detected is a range of z1 to z2 which is a range where the photoelectric conversion device 322 is provided. Therefore, the detection range can be easily adjusted by changing the number of photoelectric conversion devices 322 and the length per chip.

Note that, the ink tank 310 and the sensor unit 320 may have a positional relationship illustrated in FIG. 14 or a similar positional relationship when the ink amount detection processing is performed, and are not limited to those having a fixed positional relationship.

Figure 15:
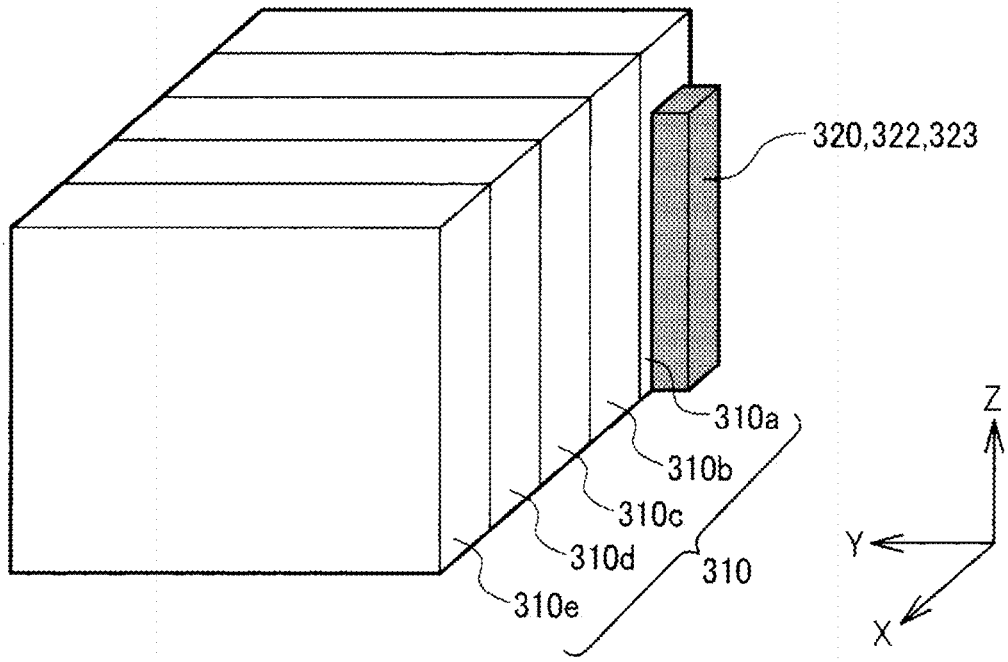
FIG. 15 is a diagram for explaining a positional relationship between a sensor unit an ink tank.
Figure 16:
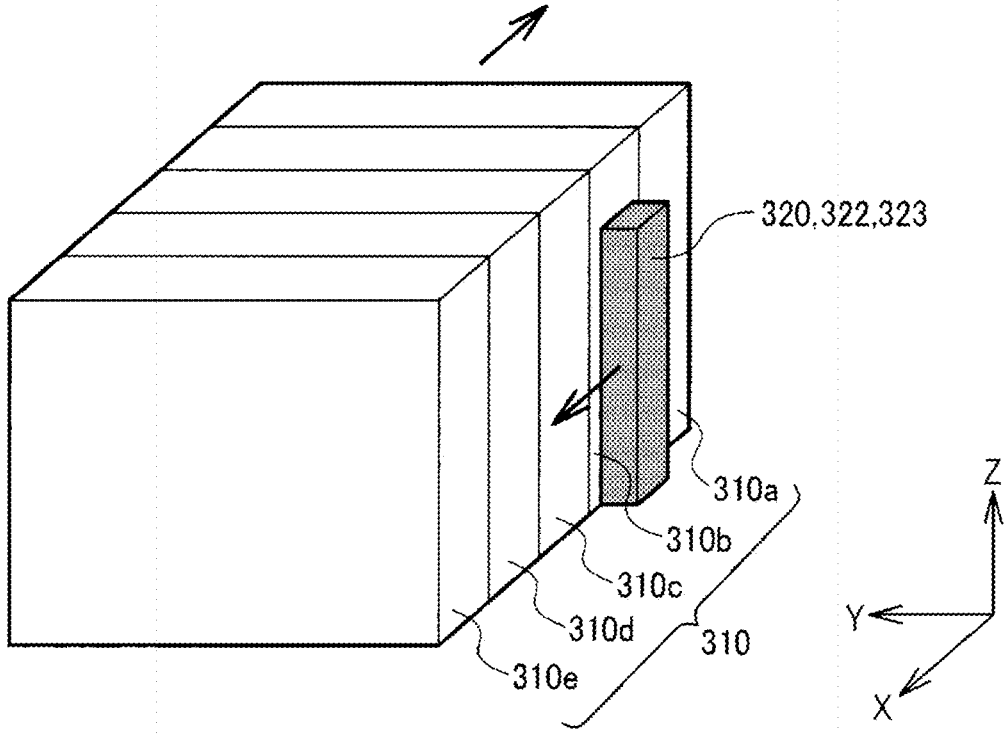
FIG. 16 is a diagram for explaining a positional relationship between a sensor unit and an ink tank.

FIGS. 15 and 16 are perspective diagrams for explaining the positional relationship between the ink tank 310 and the sensor unit 320 in the printer according to the present embodiment. As illustrated in FIGS. 15 and 16, a plurality of ink tanks 310 are arranged in the first direction. The first direction here is, for example, the ±X direction, which corresponds to the main scanning axis HD of the printer. Here, five ink tanks 310*a* to 310*e* are illustrated as the ink tanks 310. Here, as illustrated in FIGS. 15 and 16, the sensor unit 320 may move relatively to the ink tanks 310 in the first direction.

When the ink tank 310 and the sensor unit 320 can move relative to each other along the X-axis direction, it is possible to switch between a state in which the positions of the ink tank 310*a* and the sensor unit 320 on the X-axis overlap as illustrated in FIG. 15, and a state in which the positions of the ink tank 310*b* and the sensor unit 320 overlap on the X-axis as shown in FIG. 16. In the state illustrated in FIG. 15, the sensor unit 320 can detect an ink amount of ink IKa contained in the ink tank 310*a*. In the state illustrated in FIG. 16, the sensor unit 320 can detect an ink amount of ink IKb contained in the ink tank 310*b*. The same applies to other ink tanks 310 such as ink tanks 310*c* to 310*e*.

Therefore, by using a small number of sensor units 320, or in a narrow sense, one sensor unit 320, it is possible to execute ink amount detection processing and ink type determination processing for a plurality of ink tanks 310. Further, as will be described later with reference to FIGS. 28 and 29, when calibration is performed by using the end of the ink tank 310 or a reflective member 350 provided separately from the ink tank 310, data for calibration can be acquired by using the sensor unit 320 for detecting the ink amount. That is, it is not necessary to separately provide a sensor unit for calibration, and therefore, the configuration can be simplified.

Figure 17:
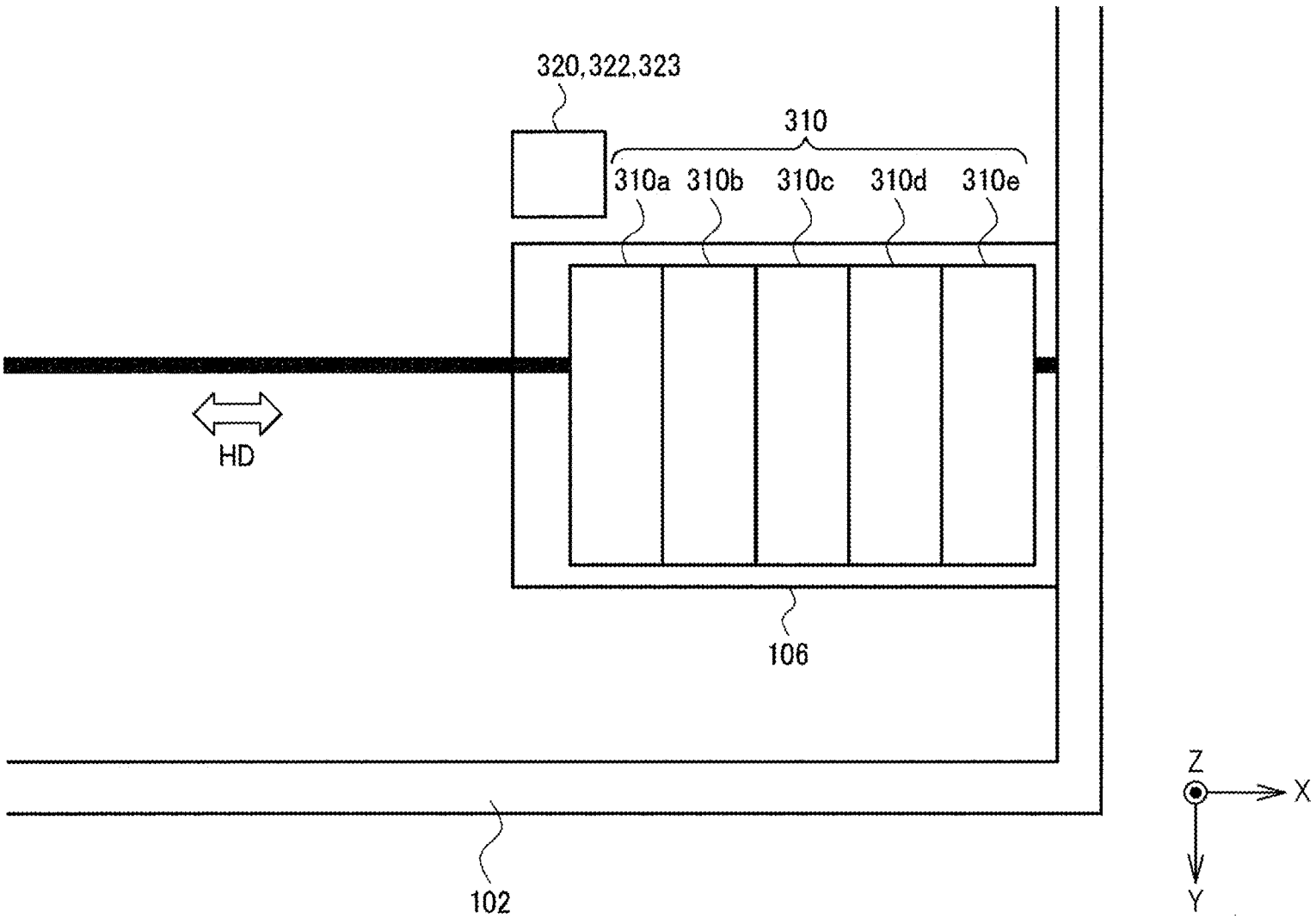
FIG. 17 is a diagram for explaining a positional relationship between a sensor unit and an ink tank in an on-carriage type printer.

FIG. 17 is a diagram for explaining a positional relationship of each portion when the ink tank 310 and the sensor unit 320 are observed from the +Z direction. As illustrated in FIG. 17, the printer includes a carriage 106 in which the ink tank 310 is mounted and that moves with respect to a housing. That is, the carriage 106 has an ink tank 310 and a print head 107, and can move in a main scanning direction with the ink tank 310 and the print head 107 mounted therein. The sensor unit 320 is fixed at a position outside the carriage 106. In this way, the positional relationship between the ink tank 310 and the sensor unit 320 can be adjusted by controlling the drive of the carriage 106. Note that, it is not prevented to drive both the carriage 106 and the sensor unit 320.

1.7 Detailed Configuration Example of Sensor Unit and Processing Section

Figure 18:
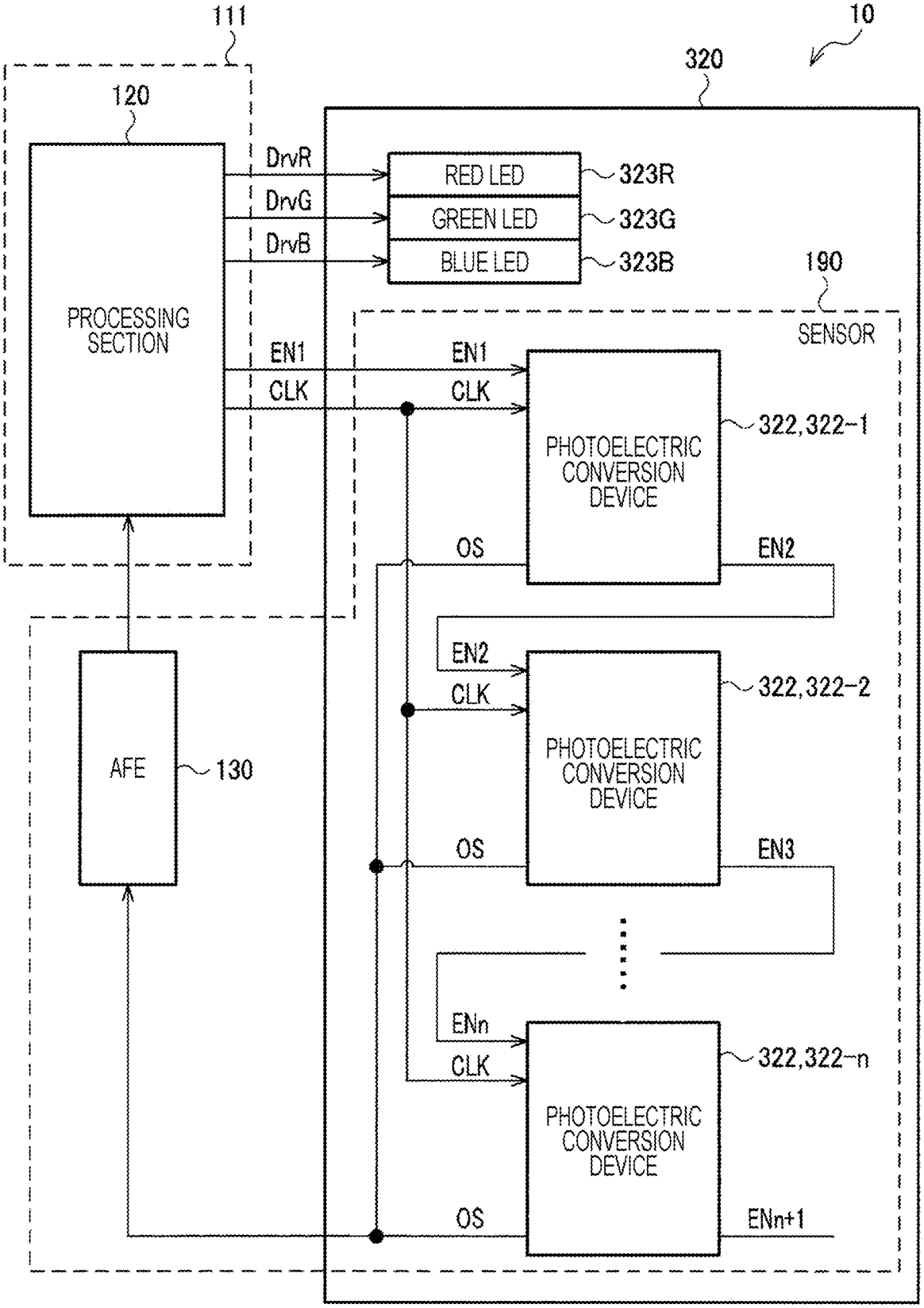
FIG. 18 is a diagram illustrating a configuration example of a sensor unit and a processing section.

FIG. 18 is a functional block diagram related to the sensor unit 320. The electronic apparatus 10 includes a processing section 120 and an analog front end (AFE) circuit 130. In the present embodiment, the photoelectric conversion device 322 and the AFE circuit 130 are referred to as a sensor 190. The processing section 120 is provided on a second substrate 111. The processing section 120 outputs a control signal for controlling the photoelectric conversion device 322 corresponding to the processing section 120 illustrated in FIG. 5. The control signal includes a clock signal CLK and a chip enable signal EN1 described later. The AFE circuit 130 is a circuit having at least a function of A/D converting an analog signal from the photoelectric conversion device 322. The second substrate 111 is, for example, a main substrate of the electronic apparatus 10, and the substrate 321 is a sub-substrate for a sensor unit.

In FIG. 18, the sensor unit 320 includes a red LED 323R, a green LED 323G, a blue LED 323B, and n photoelectric conversion devices 322. As described above, n is an integer of 1 or more. The red LED 323R, the green LED 323G, and the blue LED 323B are provided in the light source 323, and a plurality of photoelectric conversion devices 322 are arranged on a substrate 321. A plurality of red LEDs 323R, green LEDs 323G, and blue LEDs 323B may exist, respectively.

The AFE circuit 130 is realized by, for example, an integrated circuit (IC). The AFE circuit 130 includes a non-volatile memory (not illustrated). The non-volatile memory here is, for example, an SRAM. Note that, the AFE circuit 130 may be provided on the substrate 321 or may be provided on a substrate different from the substrate 321.

The processing section 120 controls the operation of the sensor unit 320. First, the processing section 120 controls operations of the red LED 323R, the green LED 323G, and the blue LED 323B. Specifically, the processing section 120 supplies a drive signal DrvR to the red LED 323R at a fixed period T for a fixed exposure time Δt and causes the red LED 323R to emit light. Similarly, the processing section 120 supplies the green LED 323G with a drive signal DrvG for the exposure time Δt at the period T to cause the green LED 323G to emit light, and supplies the blue LED 3238 with a drive signal DrvB for the exposure time Δt at the period T to cause the blue LED 323B to emit light. The processing section 120 causes the red LED 323R, the green LED 323G, and the blue LED 323B to emit light exclusively one by one in order during the period T.

Further, the processing section 120 controls an operation of the n photoelectric conversion devices 322 (322-1 to 322-*n*). Specifically, the processing section 120 supplies the clock signals CLK in common to the n photoelectric conversion devices 322. The clock signal CLK is an operation clock signal of the n photoelectric conversion devices 322, and each of the n photoelectric conversion devices 322 operates based on the clock signal CLK.

Each photoelectric conversion device 322-*j* (j=1 to n) generates and outputs an output signal OS based on light received by each photoelectric conversion element in synchronization with the clock signal CLK when receiving a chip enable signal ENj after the photoelectric conversion element receives light.

The processing section 120 causes the red LED 323R, the green LED 323G, or the blue LED 323B to emit light, generates a chip enable signal EN1 that is active only until the photoelectric conversion device 322-1 finishes outputting the output signal OS, and supplies it to the photoelectric conversion device 322-1.

The photoelectric conversion device 322-*j* generates a chip enable signal ENj+1 before the output of the output signal OS is finished. The chip enable signals EN2 to ENn are supplied to photoelectric conversion devices 322-2 to 322-*n*, respectively.

Thus, after the red LED 323R, the green LED 323G, or the blue LED 323B emits light, the n photoelectric conversion devices 322 sequentially output the output signals OS. Then, the sensor unit 320 outputs the output signal OS sequentially output by the n photoelectric conversion devices 322 from a terminal (not illustrated). The output signal OS is transferred to the AFE circuit 130.

The AFE circuit 130 sequentially receives the output signals OS outputted in order from the n photoelectric conversion devices 322, performs amplification processing and A/D conversion processing with respect to each output signal OS to convert into digital data including a digital value corresponding to the amount of light received by each photoelectric conversion element, and sequentially transmits each digital data to the processing section 120. The processing section 120 receives each digital data sequentially transmitted from the AFE circuit 130, and performs ink amount detection processing and ink type determination processing described later.

Figure 19:
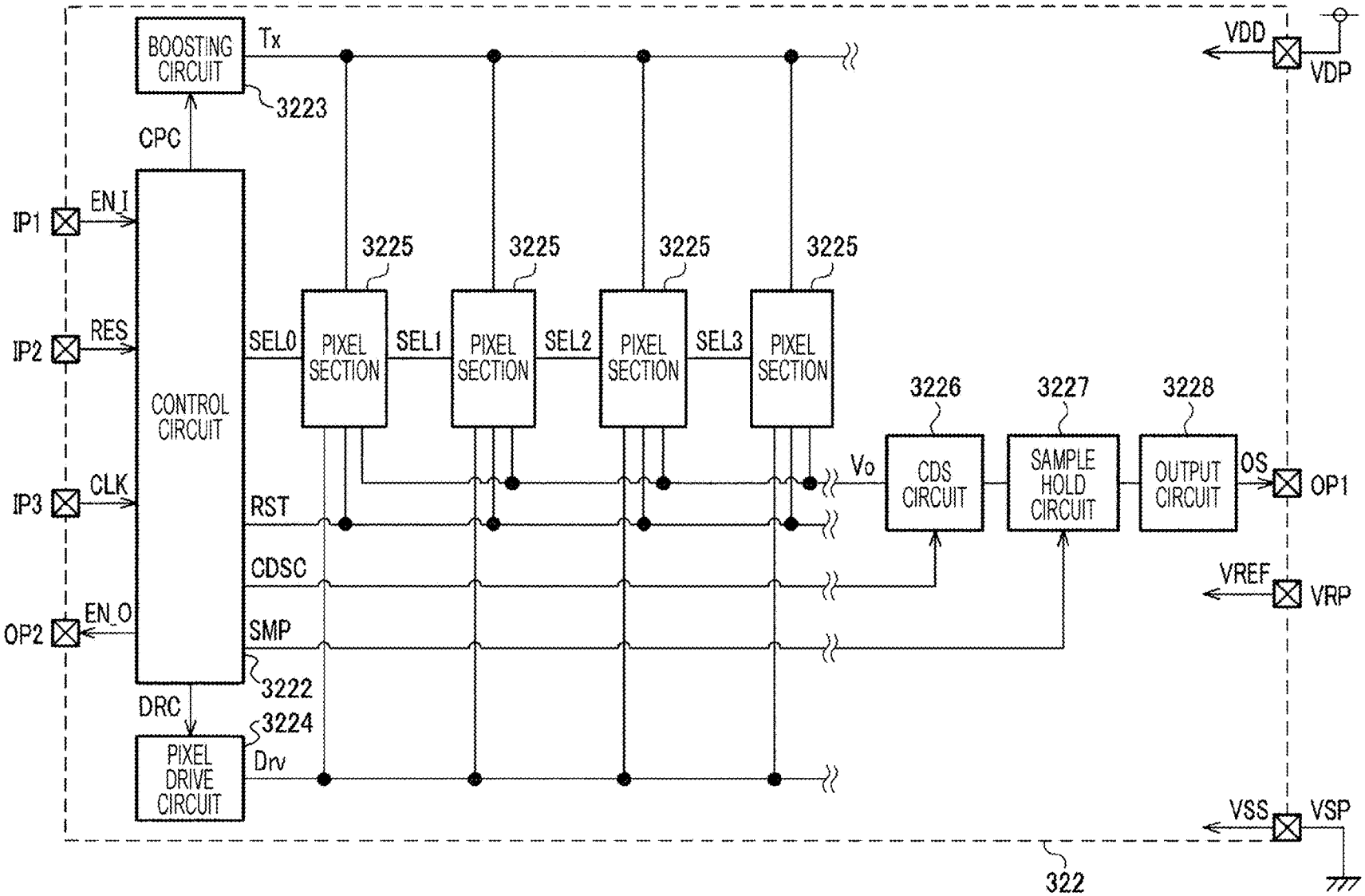
FIG. 19 is a diagram illustrating a configuration example of a photoelectric conversion device.

FIG. 19 is a functional block diagram of the photoelectric conversion device 322. The photoelectric conversion device 322 is provided with a control circuit 3222, a boosting circuit 3223, a pixel drive circuit 3224, p pixel sections 3225, a correlated double sampling (CDS) circuit 3226, a sample hold circuit 3227, and an output circuit 3228. Note that, the configuration of the photoelectric conversion device 322 is not limited to FIG. 19, and it is possible to carry out modifications such as omitting a part of the configuration. For example, the CDS circuit 3226, the sample hold circuit 3227, and the output circuit 3228 may be omitted, and processing corresponding to noise reduction processing, amplification processing, and the like may be performed in the AFE circuit 130.

The photoelectric conversion device 322 is supplied with a power supply voltage VDD and a power supply voltage VSS from the two power supply terminals VDP and VSP, respectively. The photoelectric conversion device 322 operates based on a chip enable signal EN_I, a clock signal CLK, and a reference voltage VREF supplied from a reference voltage supply terminal VRP. The power supply voltage VDD corresponds to a high potential side power supply, and is 3.3 V, for example. The VSS corresponds to a low potential side power supply, and is 0 V, for example. The chip enable signal EN_I is any one of chip enable signals EN1 to ENn in FIG. 18.

The chip enable signal EN_I and the clock signal CLK are inputted to the control circuit 3222. The control circuit 3222 controls operations of the boosting circuit 3223, the pixel drive circuit 3224, the p pixel sections 3225, the CDS circuit 3226, and the sample hold circuit 3227 based on the chip enable signal EN_I and the clock signal CLK. Specifically, the control circuit 3222 generates a control signal CPC that controls the boosting circuit 3223, a control signal DRC that controls the pixel drive circuit 3224, a control signal CDSC that controls the CDS circuit 3226, a sampling signal SMP that controls the sample hold circuit 3227, a pixel selection signal SEL0 that controls the pixel section 3225, a reset signal RST, and a chip enable signal EN_O.

The boosting circuit 3223 boosts the power supply voltage VDD based on the control signal CPC from the control circuit 3222, and generates a transfer control signal Tx that sets the boosted power supply voltage to a high level. The transfer control signal Tx is a control signal for transferring electric charges generated during exposure time Δt based on photoelectric conversion by the photoelectric conversion element and is commonly supplied to the p pixel sections 3225.

The pixel drive circuit 3224 generates a drive signal Dry for driving the p pixel sections 3225 based on the control signal DRC from the control circuit 3222. The p pixel sections 3225 are arranged side by side in a one-dimensional direction, and the drive signal Dry is transferred to the p pixel sections 3225. When the drive signal Dry is active and a pixel selection signal SELi−1 is active, an i-th, i being any one of 1 to p, pixel section 3225 activates a pixel selection signal SELi and outputs a signal. The pixel selection signal SELi is outputted to an i+1th pixel section 3225.

The p pixel sections 3225 include photoelectric conversion elements that receive light and perform photoelectric conversion, and based on the transfer control signal Tx, the pixel selection signal SEL (any one of SEL0 to SELp−1), the reset signal RST, and the drive signal Dry, output a signal having a voltage corresponding to light received by the photoelectric conversion element during the exposure time Δt, respectively. Signals outputted from the p pixel sections 3225 are sequentially transferred to the CDS circuit 3226.

The CDS circuit 3226 receives a signal Vo sequentially including the signals respectively output from the p pixel sections 3225, and operates based on the control signal CDSC from the control circuit 3222. The CDS circuit 3226 removes noise generated by the variation in the characteristics of the amplification transistors of the p pixel sections 3225 and superimposed on the signal Vo by correlated double sampling with the reference voltage VREF as a reference. That is, the CDS circuit 3226 is a noise reduction circuit for reducing noise included in the signals outputted from the p pixel sections 3225.

The sample hold circuit 3227 samples the signal from which noise is removed by the CDS circuit 3226 based on the sampling signal SMP, holds the sampled signal, and outputs it to the output circuit 3228.

The output circuit 3228 amplifies the signal outputted from the sample hold circuit 3227 to generate the output signal OS. As described above, the output signal OS is outputted from the photoelectric conversion device 322 via an output terminal OP1 and supplied to the AFE circuit 130.

The control circuit 3222 generates a chip enable signal EN_O which is a high pulse signal shortly before the output of the output signal OS from the output circuit 3228 is finished, and outputs it from an output terminal OP2 to a next-stage photoelectric conversion device 322. The chip enable signal EN_O here is any one of chip enable signals EN2 to ENn+1 in FIG. 18. Thereafter, the control circuit 3222 causes the output circuit 3228 to stop outputting the output signal OS and sets the output terminal OP1 to high impedance.

As described above, the sensor 190 of the present embodiment includes the photoelectric conversion device 322 and the AFE circuit 130 coupled to the photoelectric conversion device 322. In this way, it is possible to output appropriate pixel data based on the output signal OS output from the photoelectric conversion device 322. The output signal OS is an analog signal, and the pixel data is digital data. For example, the sensor 190 outputs the number of pieces of pixel data corresponding to the number of photoelectric conversion elements included in the photoelectric conversion device 322.

Figure 20:
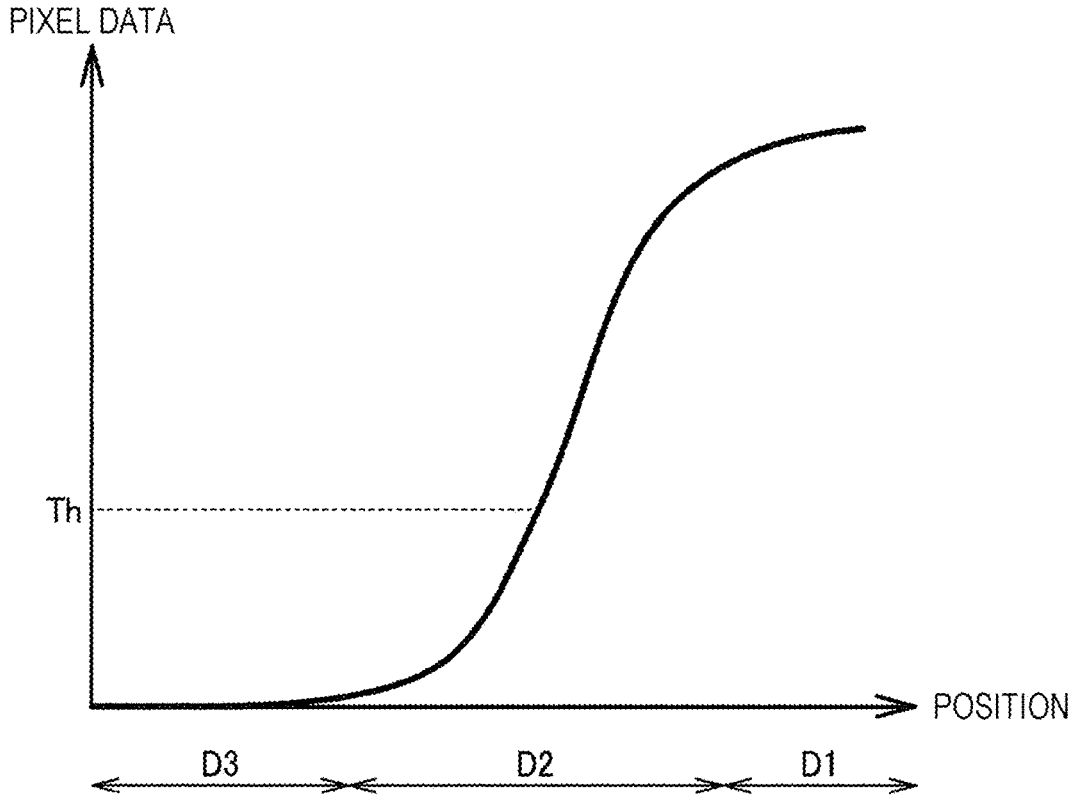
FIG. 20 is an example of pixel data which is an output of a sensor.

2. Ink Amount Detection Processing 2.1 Outline of Ink Amount Detection Processing FIG. 20 is a schematic diagram showing a waveform of pixel data which is an output of the sensor 190. As described above with reference to FIG. 18, the output signal OS of the photoelectric conversion device 322 is an analog signal, and pixel data as digital data is acquired by A/D conversion by the AFE circuit 130.

The horizontal axis of FIG. 20 represents a position of the photoelectric conversion device 322 in the longitudinal direction, and a vertical axis represents a value of pixel data corresponding to the photoelectric conversion element provided at the position. FIG. 20 illustrates a waveform representing any one of, for example, an R signal corresponding to the red LED 323R, a G signal corresponding to the green LED 323G, and a B signal corresponding to the blue LED 323B.

When the longitudinal direction of the photoelectric conversion device 322 is the vertical direction, the left direction of the horizontal axis corresponds to the −Z direction, and the right direction of the horizontal axis corresponds to the +Z direction. When the positional relationship between the photoelectric conversion device 322 and the ink tank 310 is known, it is possible to associate each photoelectric conversion element with the distance from the reference position of the ink tank 310. The reference position of the ink tank 310 is, for example, a position equivalent to an inner bottom surface of the ink tank 310. The inner bottom surface is a position assumed to be the lowest ink liquid level.

Further, the pixel data corresponding to one photoelectric conversion element is, for example, 8-bit data, and has a value in a range of 0 to 255. Note that, the value of the vertical axis may be data after calibration or the like described later with reference to FIG. 25 or the like. Further, the pixel data is not limited to 8 bits, and may be other bits such as 4 bits and 12 bits.

As described above, the photoelectric conversion element corresponding to the area where the ink IK does not exist has relatively large amount of light received, and the photoelectric conversion element corresponding to the area where the ink IK exists has relatively small amount of light received. In the example illustrated in FIG. 20, the value of pixel data is large in the range indicated by D1, and the value of pixel data is small in the range indicated by D3. Then, the value of the pixel data is greatly changed with respect to the change of the position in the range indicated by D2 between D1 and D3. That is, in the range of D1, there is a high probability that ink IK does not exist. In the range of D3, there is a high probability that ink IK exists. In the range of D2, it is highly probable that the liquid level, which is a boundary between the area where the ink IK exists and the area where the ink IK does not exist, is located.

The processing section 120 performs ink amount detection processing based on the pixel data output by the sensor 190. Specifically, the processing section 120 detects a position of a liquid level of ink IK based on the pixel data. As illustrated in FIG. 20, the liquid level of the ink IK is considered to exist at any position of D2. Therefore, the processing section 120 detects the liquid level of the ink IK based on a given threshold Th smaller than the value of the pixel data in D1 and greater than the value of the pixel data in D3.

In this way, the amount of ink contained in the ink tank 310 can be detected by using the photoelectric conversion device 322 which is a linear image sensor. Information obtained directly by using Th is a relative position of the ink liquid level with respect to the photoelectric conversion device 322. Therefore, the processing section 120 may perform calculation for obtaining the remaining amount of the ink IK based on the position of the liquid level.

When all the pixel data is larger than Th, the processing section 120 determines that ink IK does not exist in the target range of ink amount detection, that is, the liquid level is located at a position lower than the end point of the photoelectric conversion device 322 in the −Z direction. When all the pixel data is smaller than Th, the processing section 120 determines that the target range of ink amount detection is filled with ink IK, that is, the liquid level is at a position higher than the end point of the photoelectric conversion device 322 in the +Z direction. When it is not possible that the liquid level is located at a higher position than the end point of the photoelectric conversion device 322 in the +Z direction, it may be determined that an abnormality has occurred.

The ink amount detection processing is not limited to processing using the threshold Th in FIG. 20. For example, the processing section 120 performs processing for obtaining an inclination of the graph illustrated in FIG. 20. The inclination is specifically a differentiation value and more specifically, a differential value of adjacent pixel data. The processing section 120 detects a point where the inclination is larger than a predetermined threshold, more specifically, a position where the inclination becomes maximum, as the position of the liquid level. When the maximum value of the obtained inclination is a given inclination threshold or less, the processing section 120 determines that the liquid level is at a position lower than the end point of the photoelectric conversion device 322 in the −Z direction or a position higher than the end point of the photoelectric conversion device 322 in the +Z direction. Which side the liquid level exists can be identified from the value of the pixel data.

Note that, when the sensor 190 can receive a plurality of light having different wavelength bands, the ink amount detection processing may be performed based on the light reception result of any one of the light. For example, as will be described later with reference to FIG. 32 and the like, it may be determined which light-corresponding pixel data is used for ink amount detection processing, based on the characteristic of the pixel data in a meniscus portion. Alternatively, the processing section 120 may specify the position of the respective liquid levels using each pixel data, and determine the final position of the liquid level based on the specified position. For example, the processing section 120 determines, as the liquid level position, an average value or the like of a liquid level position obtained based on pixel data of R, a liquid level position obtained based on pixel data of G, and a liquid level position obtained based on pixel data of B. Alternatively, the processing section 120 may obtain composite data obtained by synthesizing three pixel data of RGB and obtain the position of the liquid level based on the composite data. The composite data is average data obtained by averaging pixel data of RGB at each point, for example.

Figure 21:
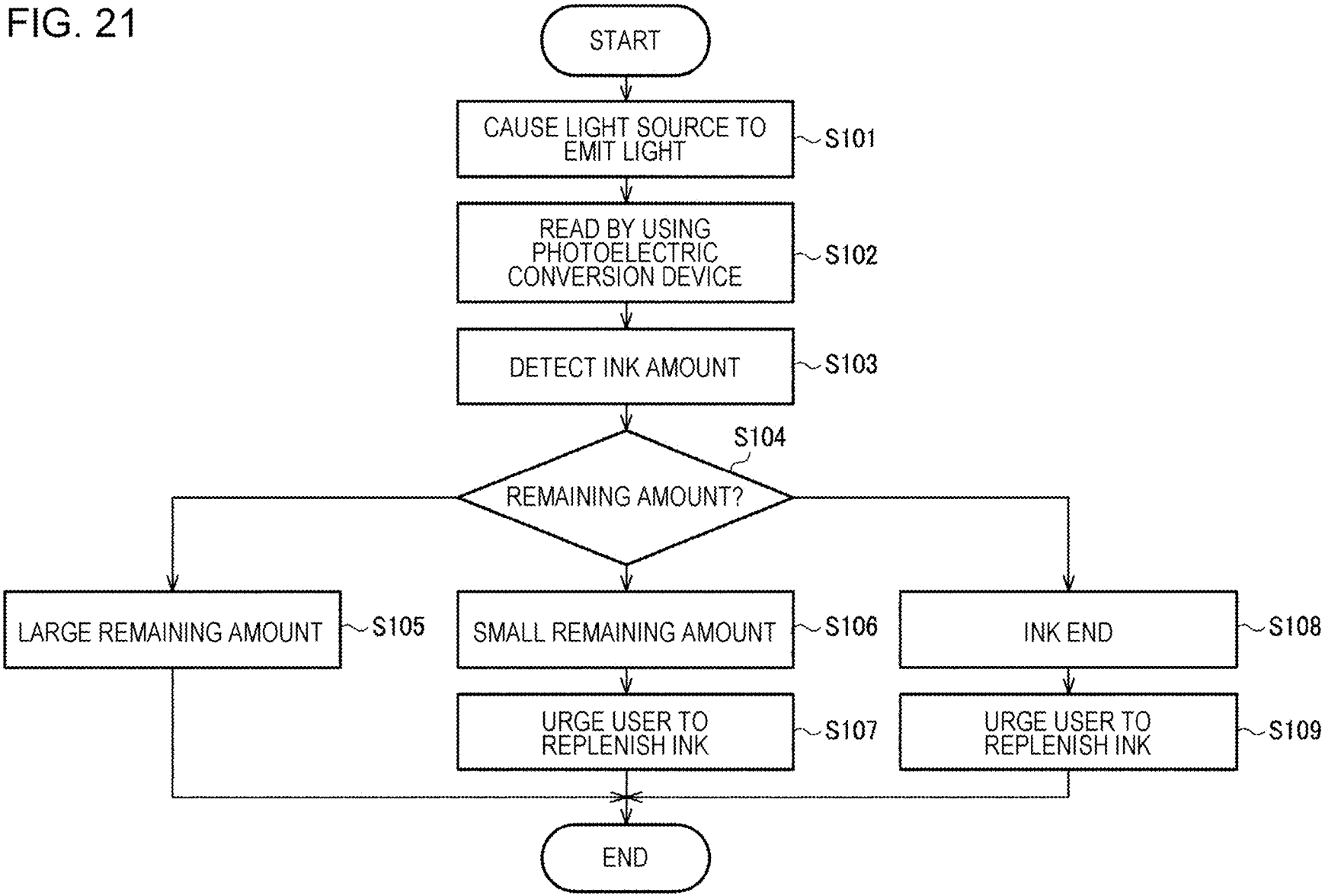
FIG. 21 is a flowchart for explaining ink amount detection processing.

FIG. 21 is a flowchart for explaining processing including the ink amount detection processing. When the processing is started, the processing section 120 performs control for causing the light source 323 to emit light (S101). Then, in the period during which the light source 323 emits light, reading processing using the photoelectric conversion device 322 is performed (S102). When the light source 323 includes a plurality of LEDs, the processing section 120 sequentially performs processing of S101 and S102 for each of the red LED 323R, the green LED 323G, and the blue LED 323B. Through the above processing, three pieces of pixel data of RGB are acquired.

Next, the processing section 120 performs ink amount detection processing based on the acquired pixel data (S103). As described above, the specific processing of S103 can be variously modified such as comparison processing with the threshold Th and detection processing of the maximum value of the inclination.

The processing section 120 determines the amount of the ink IK filled in the ink tank 310 based on the detected position of the liquid level (S104). For example, the processing section 120 sets ink amounts in three stages of "large remaining amount", "small remaining amount", and "ink end" in advance, and determines whether the current ink amount corresponds to which one of them. The large remaining amount represents a state in which a sufficient amount of the ink IK is left and no user action is required for continuing printing. The small remaining amount represents a state in which the continuation of printing itself is possible but the amount of ink is reduced and replenishment by the user is desirable. The ink end represents a situation where the ink amount is remarkably reduced and the printing operation should be stopped.

When it is determined that the remaining amount is large in processing of S104 (S105), the processing section 120 finishes the processing without performing notification or the like. When it is determined that the remaining amount is small in the processing of S104 (S106), the processing section 120 performs notification processing for urging the user to replenish the ink IK (S107). The notification processing is performed by displaying a text or an image on a display section 150, for example. However, the notification processing is not limited to display, and may be notification by emitting light from a light emitting section for notification, notification by sound using a speaker, or notification may be a combination of these. When the ink end is determined in the processing of S104 (S108), the processing section 120 performs notification processing of urging the user to replenish the ink IK (S109). The notification processing of S109 may be the same as the notification processing of S107. However, as described above, it is difficult to continue the printing operation in the ink end, which is a serious state as compared with the small remaining amount. Thus, the processing section 120 may perform notification processing different from that of S107 in S109. Specifically, the processing section 120 may execute processing of changing the text to be displayed to a content that strongly urges the user to replenish ink IK, increasing the light emission frequency, increasing the sound, or the like compared to the processing of S107, in S109. The processing section 120 may perform processing (not illustrated) such as printing operation stop control after the processing of S109.

The execution trigger of the ink amount detection processing illustrated in FIG. 21 can be set in various ways. For example, the execution start of a given print job may be used as the execution trigger or a lapse of a predetermined time may be used as the execution trigger.

The processing section 120 may store the ink amount detected in the ink amount detection processing in the storage section 140. The processing section 120 performs processing based on the time-series change of the detected ink amount. For example, the processing section 120 obtains an ink increase amount or an ink decrease amount based on a difference between the ink amount detected at a given timing and the ink amount detected at a timing before the given timing.

Since the ink IK is used for printing, head cleaning, or the like, the reduction of the ink amount is natural in consideration of the operation of the electronic apparatus 10. However, the amount of ink IK consumed per unit time in printing and the amount of ink IK consumed per head cleaning are determined to some extent, and when the amount of consumption is extremely large, there may be some abnormality such as ink leakage.

For example, the processing section 120 obtains a standard ink consumption assumed in printing or the like in advance. The standard ink consumption may be obtained based on the estimated ink consumption per unit time or based on the estimated ink consumption per job. The processing section 120 determines that there is an abnormality when the ink reduction amount obtained based on the time-series ink amount detection processing is equal to or larger than the standard ink consumption by a predetermined amount or more. Alternatively, the processing section 120 may perform consumption calculation processing of calculating the amount of ink consumption by counting the number of times of ejection of the ink IK. In this case, the processing section 120 determines that there is an abnormality when the ink decrease amount obtained based on the time-series ink amount detection processing is larger than the ink consumption calculated in the consumption calculation processing by a predetermined amount or more.

The processing section 120 sets an abnormality flag to ON when the abnormality is determined. In this way, when the ink amount is excessively reduced, some kind of error processing can be executed. Various processing is conceivable when the abnormality flag is set to ON. For example, the processing section 120 may re-execute the ink amount detection processing illustrated in FIG. 21 with the abnormality flag as a trigger. Alternatively, the processing section 120 may perform notification processing for urging the user to confirm the ink tank 310 based on the abnormality flag.

The ink amount increases by replenishing the ink IK by the user. However, it can be considered that the ink amount increases even when the ink IK is not replenished, for example, in a case of a temporary change of the liquid level due to shaking of the electronic apparatus 10, a backflow of ink IK from the tube 105, a detection error of the photoelectric conversion device 322, or the like. Therefore, when the ink increase amount is a given threshold or less, the processing section 120 determines that the ink IK is not replenished and the increase width is within an allowable error range. In this case, since it is determined that the change in the ink amount is in a normal state, no additional processing is performed.

On the other hand, when the ink increase amount is larger than the given threshold, the processing section 120 determines that the ink IK has been replenished and sets an ink replenishment flag to ON. The ink replenishment flag is used as a trigger for executing ink type determination processing which will be described later, for example. The ink replenishment flag may be used as a trigger for processing of resetting an initial value in the consumption calculation processing.

However, when the ink increase amount is larger than the given threshold, it cannot be denied that there is a possibility of an unacceptably large error due to some abnormality. Thus, the processing section 120 may perform notification processing for requesting the user to input whether the ink IK has been replenished, and determine whether to set the abnormality flag or the ink replenishment flag based on the input result of the user.

2.2 Example of Using Background Plate

As described above, for the ink tank 310, various materials such as polypropylene can be used. A transmittance of the ink tank 310 varies depending on a material of the ink tank 310 or a condition such as a temperature at which the ink tank 310 is molded. The transmittance here represents a ratio of an intensity of light incident on a given object to an intensity of light after passing through the object. For example, when a transmittance of a given object is 50%, it represents that a light intensity is attenuated in half by passing through the object. The transmittance of the ink tank 310 is, for example, the transmittance on one wall surface of the ink tank 310, and represents an intensity ratio of the light incident on the side surface of the ink tank 310 on the +Y direction side from the sensor unit 320 to the light transmitted through the side surface of the ink tank 310 on the +Y direction side and entering the inside of the ink tank 310.

For example, when polypropylene is used, the transmittance may be lowered due to light absorption and scattering caused by fine particles existing inside. When the transmittance is lower to some extent than 100%, the light incident on the ink tank 310 is reflected and scattered on the wall surface of the ink tank 310 or the inside of the wall of the ink tank 310. The wall surface here includes both the outer wall and the inner wall. Therefore, the ink tank 310 serves as a light guide, and a place of the ink tank 310 where the ink tank 310 is not exposed to light emits light. As described above, there is a difference that light is absorbed by the ink IK in the area where the ink IK exists, and light is not absorbed in the area where the ink IK does not exist. Due to the difference, the light from the ink tank 310 which is a light guide, has a characteristic that the amount of light from the area where the ink IK exists is small and the amount of light from the area where the ink IK does not exist is large.

Therefore, as described above, it is possible to detect the ink amount based on the pixel data.

However, when the transmittance is low, light is likely to be scattered on the ink tank wall. Therefore, the light from a given position in the ink tank 310 is diffused in the ±Z direction. As a result, in the vicinity of the liquid level, the area where the ink does not exist is observed to be dark to some extent, and the area where the ink exists is observed to be bright to some extent. For example, it is easy to understand when the ink tank wall is considered to be frosted glass, and the liquid level is observed in a blurred state via the ink tank wall.

As a result, as illustrated by D2 of FIG. 20, the area with a high probability of having a liquid level has a certain width in the ±Z direction. In other words, the inclination of the pixel data output from the sensor 190 becomes small. When the liquid level is determined based on the comparison processing with a given threshold Th, in a case where the inclination of the pixel data is small, the position of the liquid level, which is the determination result, changes greatly according to the setting of the threshold Th. For example, for a given type of ink IK, even when it is known that the threshold Th of about 50 to 100 is appropriate, there is a large difference in the liquid level position between a case where Th=50 and a case where Th=100. Therefore, it is necessary to strictly set the threshold Th in order to perform highly accurate liquid level detection. Alternatively, it becomes necessary to perform calibration described later with high accuracy.

On the other hand, by increasing the transmittance of the ink tank 310, it can be expected that the inclination of the pixel data will also increase. High transmittance means that the scattering and the absorption on the wall surface are unlikely to occur. Therefore, the diffusion of light is suppressed, and the light from the inside of the ink tank 310 easily reaches the lens array 325 and the photoelectric conversion device 322 while maintaining the position on the Z-axis.

However, when the transparency is high, the amount of reflected light may decrease. For example, when all the surfaces of the ink tank 310 are completely transparent, the light emitted from the sensor unit 320 passes through the area where the ink IK does not exist and is emitted from the side surface in the −Y direction or the like. In other words, the ink tank 310 does not emit light like the light guide. In this case, since the light does not return from the area where the ink IK does not exist, the pixel data in the area does not become large. The reflected light from the ink IK returns from the area where the ink IK exists, but the amount of light is small as described above by using FIG. 20 and the like. That is, when the transmittance of the ink tank 310 is simply increased, the value of the pixel data becomes small regardless of the presence or absence of the ink IK, which may make it difficult to detect the ink amount.

Figure 22:
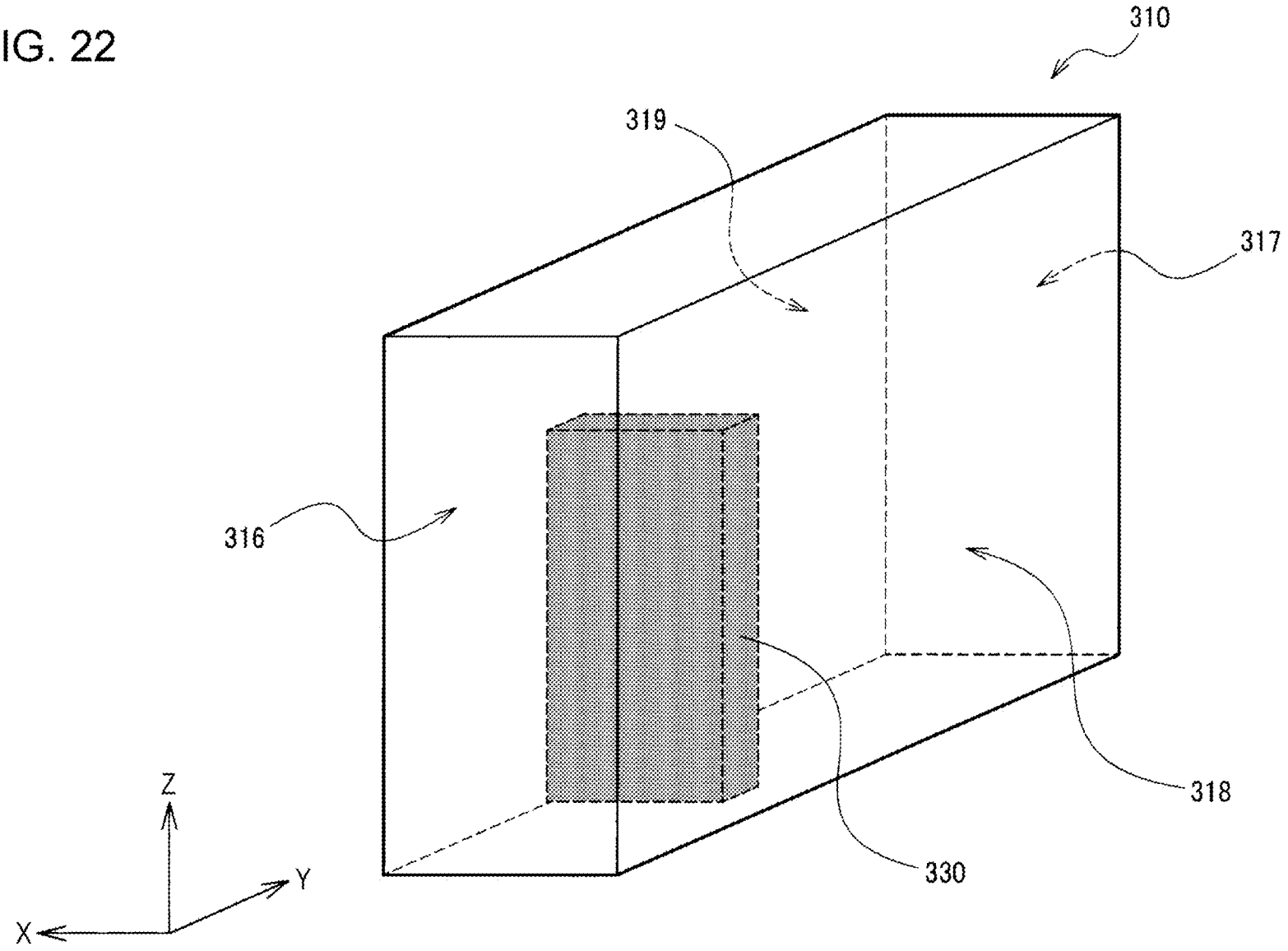
FIG. 22 is a diagram illustrating an example of an ink tank including a background plate.

FIG. 22 is a schematic diagram illustrating a configuration of the ink tank 310. Note that, in FIG. 22, an example in which the shape of the ink tank 310 is simplified and is a rectangular parallelepiped will be described. However, the ink tank 310 may have, for example, a shape illustrated in FIG. 4 or another shape. The ink tank 310 includes a first ink tank wall 316 corresponding to the sensor unit 320 and a second ink tank wall 317 corresponding to the first ink tank wall. For example, the first ink tank wall 316 is a side surface in the −Y direction, and the second ink tank wall 317 is a side surface in the +Y direction. Further, the ink tank 310 includes a third ink tank wall 318 which is a side surface on the right side when viewed from the sensor unit 320, and a fourth ink tank wall 319 which is a side surface on the left side when viewed from the sensor unit 320. The left and right direction here is a direction orthogonal to a direction in which ink tank 310 is viewed from the sensor unit 320 and a vertical direction. For example, the +X direction is the left side and the −X direction is the right side.

As illustrated in FIG. 22, the printer of the present embodiment may include a background plate 330 inside the ink tank 310. Specifically, the printer may include a background plate 330 provided between the first ink tank wall 316 and the second ink tank wall 317 and facing the light source 323 and the sensor 190. As described above, the first ink tank wall 316 is a side surface facing the light source 323 and the sensor 190. The second ink tank wall 317 is a side surface facing the first ink tank wall 316. The sensor 190 here is a photoelectric conversion device 322 in a narrow sense. The processing section 120 detects an amount of ink in the ink tank 310 based on the output of the sensor 190.

In this way, the light emitted from the light source 323 of the sensor unit 320 is reflected by the background plate 330, and the reflected light can reach the photoelectric conversion device 322 via the lens array 325. Therefore, it is possible to increase the transmittance of the ink tank 310.

Figure 23:
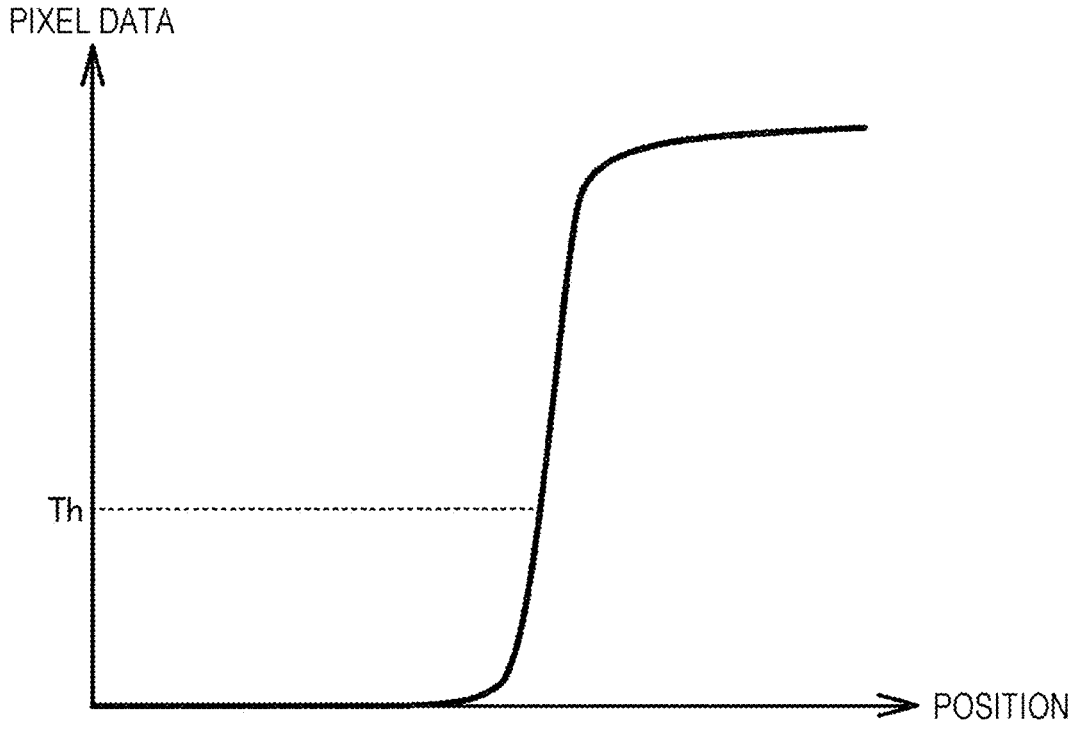
FIG. 23 is a diagram illustrating an example of pixel data when an ink tank including a background plate is used.

FIG. 23 is a diagram illustrating an example of pixel data when the transmittance of the ink tank 310 is higher than that of FIG. 20 and the background plate 330 is provided inside the ink tank 310. Similar to FIG. 20, in the area where the ink IK exists, the value of the pixel data becomes low due to the light being absorbed by the ink IK. Further, in the area where the ink IK does not exist, the light reflected by the background plate 330 is detected as described above, so that the value of the pixel data becomes sufficiently large. Further, since the transmittance of the ink tank 310 can be increased, the change in pixel data depending on the presence or absence of ink IK becomes steeper as compared with FIG. 20. Since the inclination of the graph is large, even when the threshold Th changes within a given range, the change in the ink liquid level position, which is the determination result, is suppressed. That is, even when there is some variation in the threshold setting, it is possible to accurately detect the ink liquid level.

Note that, an internal space of the ink tank 310 is divided into a space in the −Y direction and a space in the +Y direction from the background plate 330, and the space in the +Y direction on the filling port 311 side is defined as a front chamber and the space in the −Y direction on the discharging port 312 side is defined as a rear chamber. As described above, since the sensor unit 320 is configured to detect the reflected light from the background plate 330, the ink liquid level detected by the sensor unit 320 is the ink liquid level in the rear chamber. When the positions of the ink liquid level in the front chamber and the ink liquid level in the rear chamber are different, even when the ink liquid level position in the rear chamber can be detected, it is not possible to accurately estimate the amount of ink contained in the entire ink tank 310. That is, in order to realize an appropriate ink amount detection, it is necessary that the front chamber and the rear chamber communicate with each other so that the ink levels of the front chamber and the rear chamber correspond to each other. At that time, even when the front chamber and the rear chamber communicate with each other vertically above the background plate 330, the ink levels in the two spaces do not match unless the ink liquid level exceeds the height of the background plate 330. That is, the front chamber and the rear chamber communicate with each other in at least one of the left, right, and lower directions of the background plate 330. The left and right direction here is a direction orthogonal to a direction in which the background plate 330 is viewed from the sensor 190 and the vertical direction, for example, the ±X direction.

For example, the front chamber and the rear chamber in the ink tank 310 communicate with each other on at least one of the left and right sides of the background plate 330 in the left and right direction. In the example of FIG. 22, since the background plate 330 is in contact with the fourth ink tank wall 319 on the left side and not in contact with the third ink tank wall 318 on the right side, the front chamber and the rear chamber communicate with each other on the right side of the background plate 330. Further, by using the background plate 330 which is in contact with the third ink tank wall 318 on the right side and not in contact with the fourth ink tank wall 319 on the left side, the front chamber and the rear chamber may communicate with each other on the left side of the background plate 330. Regardless of which side the front chamber and the rear chamber communicate with each other, when the ink heights in the front chamber and the rear chamber are different, it is difficult to accurately measure the remaining amount of ink. Therefore, the front chamber and the rear chamber are communicated so that the heights of the inks are the same in the front chamber and the rear chamber.

As described above with reference to FIG. 14 and the like, the photoelectric conversion device 322 is specifically a linear image sensor in which a plurality of photoelectric conversion elements are arranged along the vertical direction. The photoelectric conversion device 322, which is a linear image sensor, is a sensor capable of reading a relatively wide range in the vertical direction, but has a narrow reading range in the left and right direction. Therefore, it is less necessary to increase the length of the background plate 330 in the left and right direction. By leaving the left or right side of the background plate 330, the front chamber and the rear chamber can be communicated with each other by an efficient configuration. Further, a background plate 330 that is not in contact with both the third ink tank wall 318 and the fourth ink tank wall 319 may be used.

Note that, considering that the ink IK flows smoothly between the front chamber and the rear chamber, it is not prevented that the front chamber and the rear chamber communicate with each other below the background plate 330. However, in consideration of suppressing blank printing in the print head 107, suppressing printing stoppage, and the like, it is very important to detect an ink end in ink amount detection. When the background plate 330 is not in contact with the lower wall of the ink tank 310, the ink liquid level cannot be detected near the bottom surface of the ink tank 310, and it may be difficult to detect an ink end. Therefore, the lower end of the background plate 330 of the ink tank 310 may be in contact with the lower wall of the ink tank. The lower wall is specifically an inner wall of a member constituting the bottom surface of the ink tank 310. In this way, it becomes possible to detect an area where the liquid level detection is highly important.

Figure 24:
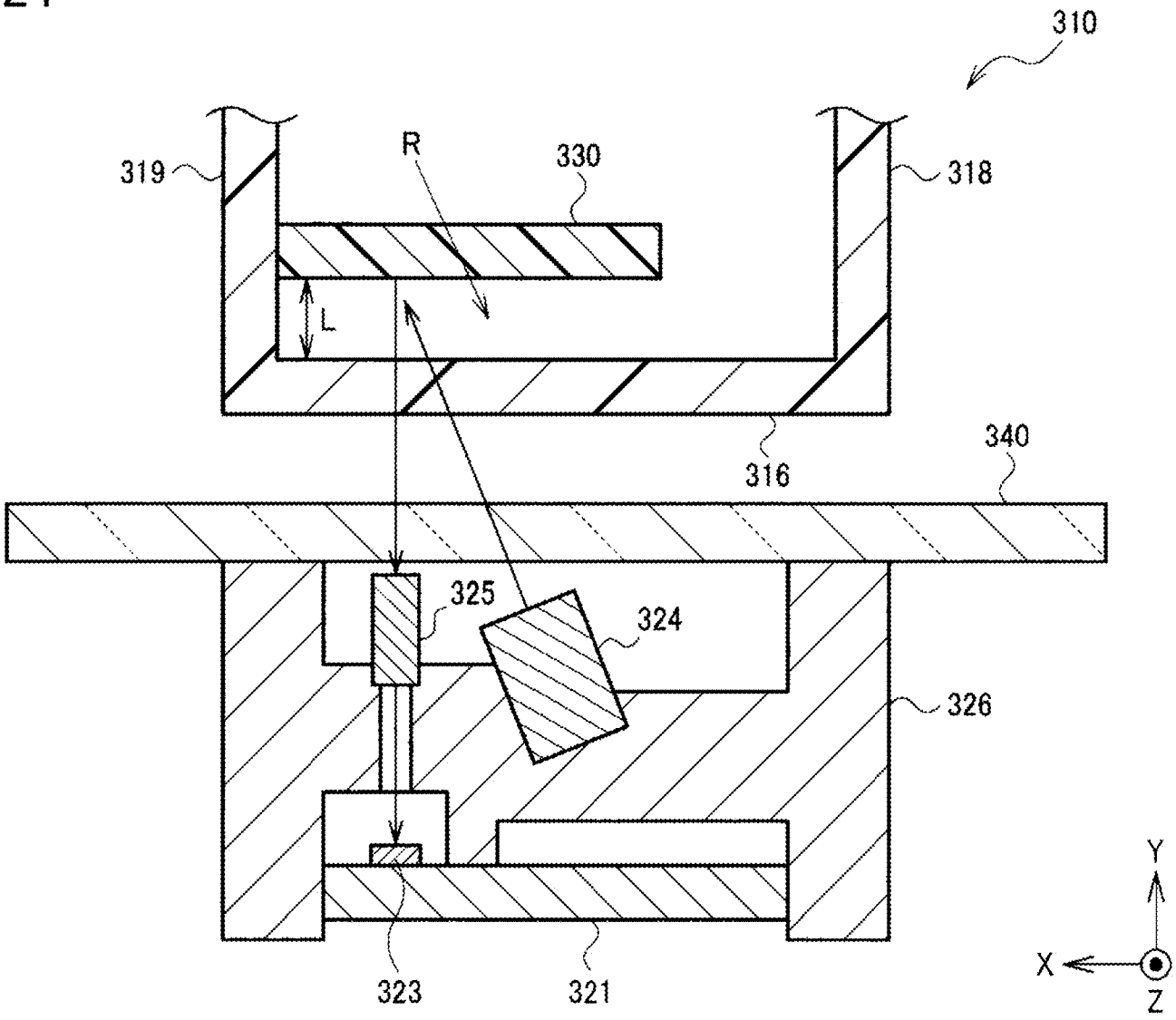
FIG. 24 is a diagram for explaining a cross-sectional configuration of a sensor unit and an ink tank.

FIG. 24 is a cross-sectional diagram illustrating a positional relationship between the sensor unit 320, the ink tank 310, and the background plate 330. As illustrated in FIG. 24, the light from the light source 323 is emitted to the ink tank 310 via the light guide 324. Hereinafter, with reference to FIG. 24, a specific light path from the light guide 324 to the photoelectric conversion device 322 and the transmittance of a substance on the path will be examined. In addition, the position where the background plate 330 is provided is also examined based on the transmittance.

As illustrated in FIG. 24, the printer of the present embodiment may include a transmission plate 340 provided between the light source 323 and the sensor 190, and the first ink tank wall 316, and facing the light source 323 and the sensor 190. The transmission plate 340 is, for example, a glass plate, but other members such as plastic may be used.

The transmission plate 340 here is a protective plate for protecting the sensor unit 320, or in a narrow sense, the lens array 325. Depending on the configuration of the printer, the distance between the sensor unit 320 and the print head 107 may become short, and the sensor unit 320 may become dirty with ink mist. Alternatively, as the printing medium P moves in the vicinity of the sensor unit 320, paper dust may adhere to the sensor unit 320. For example, when mist or paper dust adheres to the lens array 325, the value of the pixel data of the corresponding portion becomes small, so that the accuracy of ink amount detection is lowered. By providing the transmission plate 340, it becomes possible to protect the lens array 325 from mist and paper dust. For example, even when mist or the like adheres to the transmission plate 340, it can be wiped off by the user, so that the maintenance load can be reduced as compared with cleaning the lens array 325.

First, in the present embodiment, Pi>Ti, where Pi is a transmittance of the first ink tank wall 316 and Ti is a transmittance of the ink IK. By increasing the transmittance Pi of the first ink tank wall 316, it becomes possible to steeply change the pixel data as described above.

Gi≥Pi>Ti, where Gi is a transmittance of the transmission plate 340. As described above, the transmission plate 340 is mainly provided to protect the sensor unit 320. Considering the accuracy of ink amount detection, it is desirable that the transmission plate 340 has a small effect on the light for detecting the ink amount. For example, in comparison with the first ink tank wall 316, the attenuation of light by the transmission plate 340 can be reduced by setting Gi Pi.

As illustrated in FIG. 24, the light emitted from the light guide 324 passes through the transmission plate 340, an air layer between the sensor unit 320 and the ink tank 310, the first ink tank wall 316, an area R between the first ink tank wall 316 and the background plate 330, and then reaches the background plate 330. The light reflected by the background plate 330 passes through the area R between the background plate 330 and the first ink tank wall 316, the first ink tank wall 316, the air layer, and the transmission plate 340, and then reaches the lens array 325.

When the ink IK does not exist in the area R, the area R becomes an air layer. When the transmittance of the air layer is considered to be 1, a reflected light intensity I' is expressed by the following equation (1) by using the intensity I of the light emitted by the light guide 324 and the transmittance of each member. In the following equation (1), r is information representing the ratio of the intensity of the reflected light to the intensity of the light reaching the background plate 330. It is assumed that the reflected light here represents only light, of the light reflected by the background plate 330, reflected in a direction in which the light can be incident on the lens array 325.

$$I'=I\times Gi\times Pi\times r\times Pi\times Gi \quad (1)$$

On the other hand, when the ink IK exists in the area R, the area R is an area filled with the ink IK. When the transmittance of the ink IK filled in the area R is Ti, a reflected light intensity I" is expressed by the following equation (2). Here, Ti represents an intensity ratio of the light incident on the ink IK to light passing through the ink IK and reaching the background plate 330. Further, Ti represents an intensity ratio of light passing through the ink IK and reaching the first ink tank wall 316 to light reflected by the background plate 330.

$$I''=I\times Gi\times Pi\times Ti\times r\times Ti\times Pi\times Gi \quad (2)$$

The following equation (3) is derived from the above equations (1) and (2).

$$I''/I'=Ti^2 \quad (3)$$

That is, in the area where the ink IK exists, the intensity of the reflected light is attenuated to $Ti^2$ (<1) as compared with the area where the ink IK does not exist. As described above with reference to FIGS. 20 and 23, in the method of the present embodiment, the ink liquid level is detected based on a difference in pixel data depending on the presence or absence of the ink IK. Since the reflected light intensity and the value of the pixel data are correlated, when the difference between I" and I' is sufficiently large, the difference in the pixel data becomes large, thereby the ink amount can be detected accurately.

The longer a distance L between the first ink tank wall 316 and the background plate 330, the longer an optical path for passing through the ink IK, and the larger the amount of light attenuation by the ink IK. In other words, Ti is determined by the distance L. Therefore, the distance L between the first ink tank wall 316 and the background plate 330 is a distance at which the output of the sensor 190 becomes equal to or less than a predetermined value when the light from the light source 323 passes through the ink IK, is reflected by the background plate 330, and is incident on the sensor 190. The predetermined value here is, for example, a threshold when the processing section 120 determines that there is ink. As described above, when the ink IK exists, the accuracy of the ink amount detection can be improved by determining the position of the background plate 330 so that the reflected light intensity is sufficiently reduced by the ink IK.

$Ti^2$<(VT2/VT1) may be established, where VT1 is a threshold for determining that there is no ink by the processing section 120, and VT2 is a threshold for determining that there is ink by the processing section 120 in processing of detecting the amount of ink, VT2 being a number that satisfies VT2<VT1. VT1 and VT2 are digital data represented by, for example, 8 bits. VT1 is, for example, about 150, and VT2 is, for example, about 50. In this case, the processing section 120 detects the ink liquid level by setting a threshold Th, for example, between 50 and 150. However, the specific values of VT1 and VT2 can be modified in various ways.

When VT1=150 and VT2=50, $Ti^2$<⅓. That is, when the condition that the amount of light is attenuated to less than ⅓ by the ink IK between the ink tank 310 and the background plate 330 is satisfied, since the value of the pixel data in the area where the ink IK exists is small enough to be clearly distinguished from pixel data in the area where the ink IK does not exist, highly accurate liquid level detection becomes possible.

t"<(VT2/VT1) may be established, where L is a distance between the first ink tank wall 316 and the background plate 330, and t is a transmittance of the ink IK per unit length. For example, t is a transmittance of ink IK per meter, and the distance between the first ink tank wall 316 and the background plate 330 is L meter. When transmitting ink IK at a distance twice the unit length, light is reduced to t times and then further reduced to t times, so the transmittance of ink IK at a distance twice the unit length is $t^2$. As illustrated in FIG. 24, in the optical path from the light guide 324 to the lens array 325, the light travels in the ink IK by at least 2L of the reciprocating length. That is, the light is attenuated by $t^{2L}$ by the ink IK. By determining the distance L based on $t^{2L}$<(VT2/VT1), it is possible to sufficiently increase the amount of attenuation due to the ink IK. For example, since t is determined by determining the type of ink IK, the condition that L should satisfy is determined based on t, VT1, and VT2.

Since t<1 here, the above equation is a condition for determining a lower limit value of L. That is, by disposing the background plate 330 at a position distance from the first ink tank wall 316 to some extent, highly accurate liquid level detection becomes possible. Since there is no thickness of ink IK when the distance L is small, and reflected light having a certain intensity is returned from the background plate 330 even in the area where the ink IK exists, but such a situation can be suppressed.

Note that, strictly speaking, since light also moves in the ±X direction, the moving distance in the ink IK may be larger than 2L. In that case, since the amount of light is attenuated to a value smaller than $t^{2L}$ times, the condition of increasing the amount of attenuation by the ink IK is satisfied.

The surface of the background plate 330 facing the sensor 190 is, for example, white. By making the background plate 330 white, the amount of light reflected by the background plate 330 can be increased. In other words, by increasing the reflectance of the background plate 330, the value of the pixel data in the area where the ink IK does not exist becomes large. Since the dynamic range can be increased, the accuracy of ink amount detection can be improved. However, the background plate 330 of the present embodiment is not limited to white as long as it has a configuration capable of reflecting light of a certain intensity. For example, a background plate 330 of another color may be used.

Further, as illustrated in FIGS. 22 and 24, the background plate 330 may have a surface in a direction corresponding to a surface of the sensor 190. Specifically, the background plate 330 has a surface parallel to the surface of the sensor 190. The surface of the sensor 190 here is, for example, a surface on which a plurality of photoelectric conversion elements are provided, and in a narrow sense, is a substrate surface of the substrate 321. In this way, the light reflected by the background plate 330 can be appropriately incident on the photoelectric conversion device 322. In a narrow sense, the light reflected by the background plate 330 can be appropriately incident on the lens array 325.

Further, the transmittance of the plurality of wall surfaces of the ink tank 310 may be equal. For example, the ink tank 310 may be a member having a high transmittance such as a member made of acrylic as a whole. However, as described above with reference to FIG. 24, it is assumed that the light from the light source 323 passes through the first ink tank wall 316 and does not pass through the other wall surfaces of the ink tank 310 before reaching the photoelectric conversion device 322. Therefore, the first ink tank wall 316 may have a higher transmittance than the left and right wall surfaces of the ink tank 310. By increasing the transmittance of at least the first ink tank wall 316, even when the transmittance of the third ink tank wall 318 or the fourth ink tank wall 319 is relatively low, it is possible to detect the ink amount with high accuracy. Further, the transmittance of the first ink tank wall 316 may be high, and the first ink tank wall 316 may be realized by a transparent film or the like.

2.3 Calibration

Shading correction widely used in scanners and the like may be applied to the photoelectric conversion device 322 of the present embodiment. For example, before shipping the printer, a white reference value when a white reference subject is read, and a black reference value when a black reference subject is read are acquired. The processing section 120 performs correction processing using the white reference value and the black reference value on the pixel data output from the photoelectric conversion device 322. For example, the processing section 120 performs correction processing based on the white reference value and the black reference value so that the result obtained by reading the area where the ink IK does not exist is the maximum value of the digital data, and the result obtained by reading the area where the ink IK exists is the minimum value. Hereinafter, an example in which the maximum value is 255 and the minimum value is 0 will be described. In this way, it is possible to reduce the variation between the plurality of photoelectric conversion elements. Moreover, since the full range of digital data can be used, the accuracy of ink amount detection can be improved.

However, it is known that luminous intensity of the light source 323 such as an LED changes due to change with time. The luminous intensity here represents the intensity of the light emitted from the light source 323. For example, in the LED, even when the same current is supplied from a drive circuit, the output luminous intensity fluctuates with the passage of time.

For example, when the luminous intensity of the light source 323 is lowered, the result obtained by reading the area where the ink IK exists is lowered to a value lower than 255, for example, about 200. In this case, since the pixel data based on the photoelectric conversion device 322 fluctuates in the range of about 0 to 200, the resolution may decrease and the accuracy of the ink amount detection processing may decrease. Further, since the waveform of the pixel data also changes, when the threshold Th used for detecting the ink amount is not changed, an error may occur in the liquid level position. As described above, the shading correction is a correction using the information at the time of shipment, and cannot cope with the change with time of the light source 323.

Therefore, in the printer of the present embodiment, the luminous intensity of the light source 323 may be adjusted in the calibration. Specifically, the light source 323 is turned on by the amount of light based on the result of the sensor 190 detecting the light reflected from the area where the ink IK does not exist. Hereinafter, the area where the ink IK used for calibration does not exist is referred to as a calibration area CA.

The amount of light here is determined based on the luminous intensity and a lighting time. In the present embodiment, since a method using a photoelectric conversion element is assumed, the lighting time represents a lighting time in a period in which the photoelectric conversion element outputs one pixel signal. The adjustment of the amount of light described below may be an adjustment of the luminous intensity or an adjustment of the lighting time. The light source 323 may be turned on at the luminous intensity based on the reading result of the calibration area CA, may be turned on at a time based on the reading result of the calibration area CA, or both may be performed. For example, when the light source 323 is driven by the pulse signal, the adjustment of the lighting time may be an adjustment of a pulse width of a pulse signal. Specifically, the adjustment of the lighting time is an adjustment of a duty ratio.

As described above, in the ink amount detection processing of the present embodiment, the processing accuracy can be increased when the difference in pixel data depending on the presence or absence of ink IK is large. In the following description, in the ink amount detection processing, it is assumed that the maximum value of the pixel data acquired by using the sensor 190 is DAT1, and the minimum value is DAT2. DAT1 corresponds to a reading result of the area where the ink IK does not exist. DAT2 corresponds to a reading result of the area where the ink IK exists. When DAT1 is large and DAT2 is small, the accuracy of the ink amount detection processing can be improved. For example, when 8-bit digital data is used, the range can be fully used when DAT1=255 and DAT2=0.

Since the value of DAT2 is expected to decrease to some extent regardless of the amount of light of the light source 323, it is particularly important to bring the value of DAT1 closer to the maximum value of digital data. When DAT1 is smaller than 255, the range of pixel data becomes narrower and the processing accuracy decreases. Further, when the amount of light of the light source 323 is excessively large, it is easy to bring the DAT1 closer to 255, but this is also not preferable because the pixel data is saturated at the place where the value should be smaller than 255. Since it is not necessary to consider the absorption by the ink IK, the light reflected from the calibration area CA in which the ink IK does not exist becomes the amount of light corresponding to the irradiation light of the light source 323. That is, the amount of light of the light source 323 can be appropriately controlled by performing calibration based on the light reflected from the calibration area CA.

Figure 25:
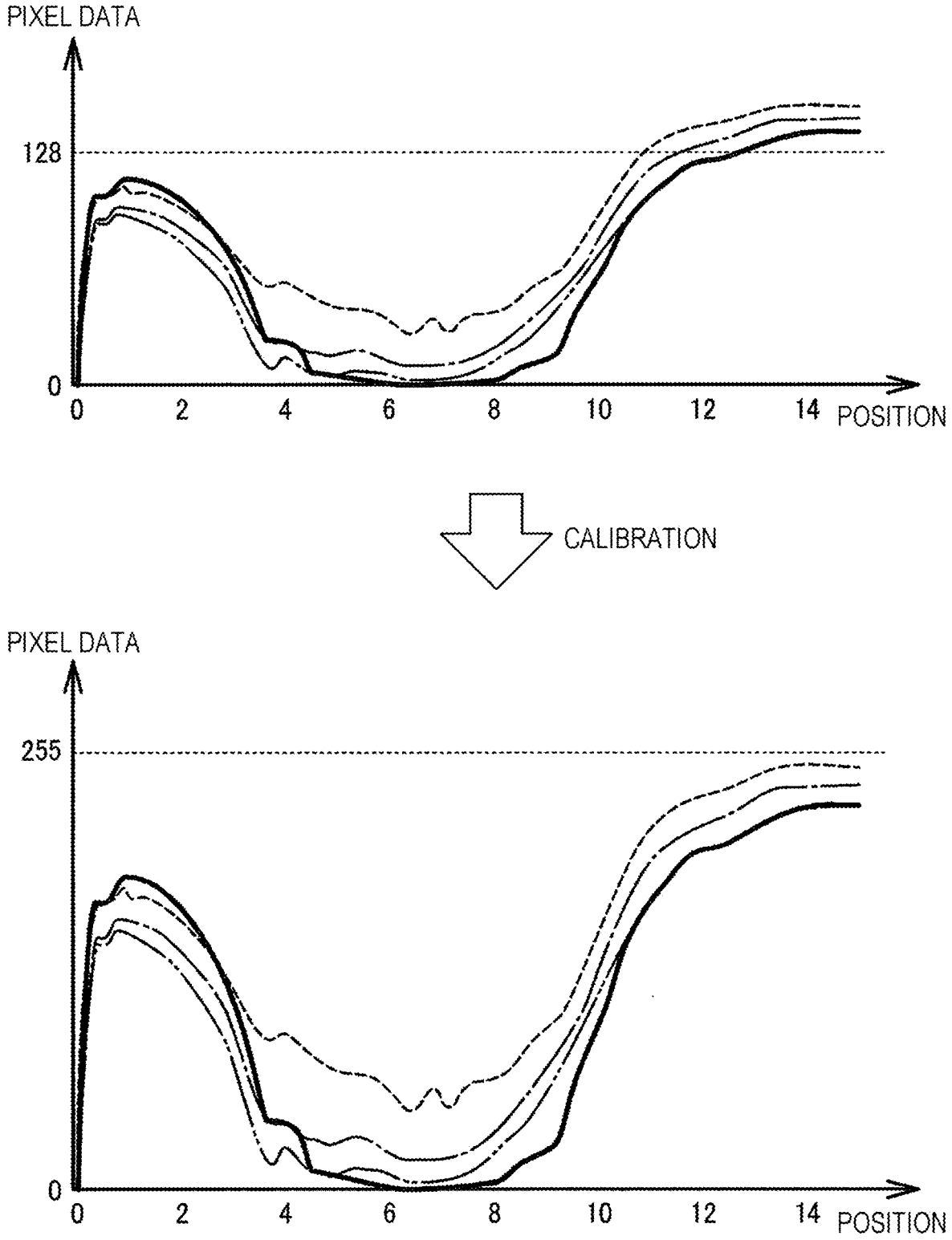
FIG. 25 is a diagram for explaining a change in waveform due to calibration.

FIG. 25 is a diagram illustrating an example of pixel data before and after calibration. Before calibration, for example, DAT1 is a value of around 150. In the present embodiment, as illustrated in FIG. 25, control is performed so that DAT1 after calibration approaches 255. As a result, the range of pixel data can be widened, and the accuracy of ink amount detection processing and the like can be improved.

The processing section 120 performs processing of adjusting the amount of light of the light source 323 so that the result obtained by reading the calibration area CA becomes an adjustment target value. The adjustment target value here is, for example, the maximum value of digital data as illustrated in FIG. 25, and is 255 in a narrow sense. However, as will be described later, the adjustment target value is changed depending on the situation.

Figure 26:
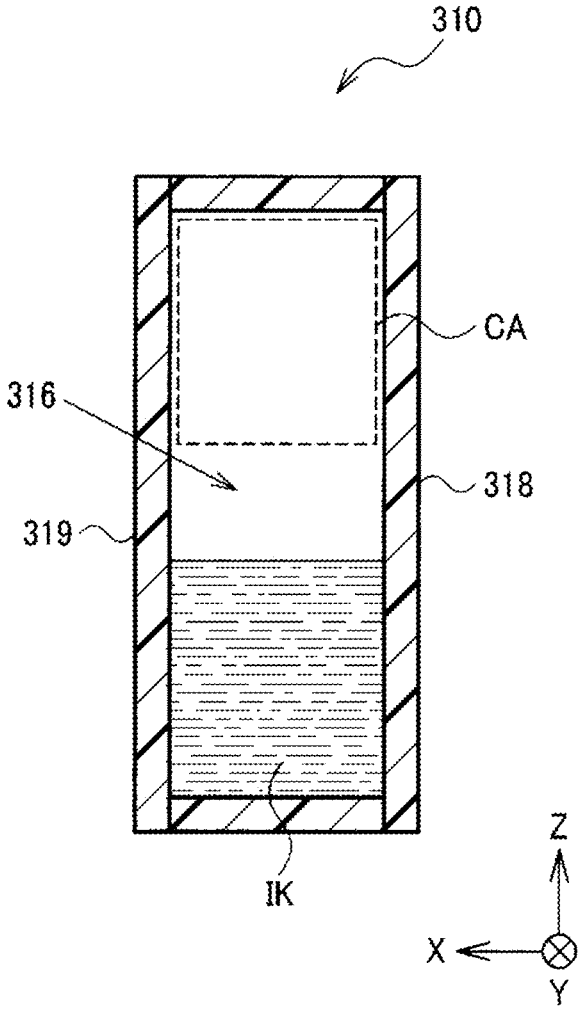
FIG. 26 is a diagram illustrating an example of a calibration area.

FIG. 26 is a diagram illustrating an example of a calibration area CA. As illustrated in FIG. 26, the calibration area CA is an area above the ink liquid level in the vertical direction. More specifically, calibration may be performed based on the pixel data of the area above the liquid level of the first ink tank wall 316, which is the wall surface of the ink tank 310 in the −Y direction.

For example, in a printer provided with a window portion for visually recognizing the ink in the ink tank 310, it is conceivable to provide a user with a guideline for an upper limit of an injection amount by providing a scale on the window portion. In this case, when the ink IK is replenished according to the scale, there is a high probability that the ink IK does not exist in the area above the scale.

Further, the calibration area CA may be an area above an opening provided on the upper surface of the ink tank 310 in the vertical direction. The opening here is, for example, the filling port 311 of the ink tank 310, but may be the discharging port 312, or may be another opening such as an air hole. The upper surface of the ink tank 310 is a wall surface in the +Z direction. When the opening is provided on the upper surface, in a case where the liquid level of the ink IK is located above the opening, the ink IK leaks from the opening. Depending on the form of the opening, it may be possible to seal using a cap or the like, but it is not preferable that the liquid level of the ink IK is located above the opening. Therefore, when the first ink tank wall 316 has an area above the opening, the area can be used as the calibration area CA.

Figure 27:
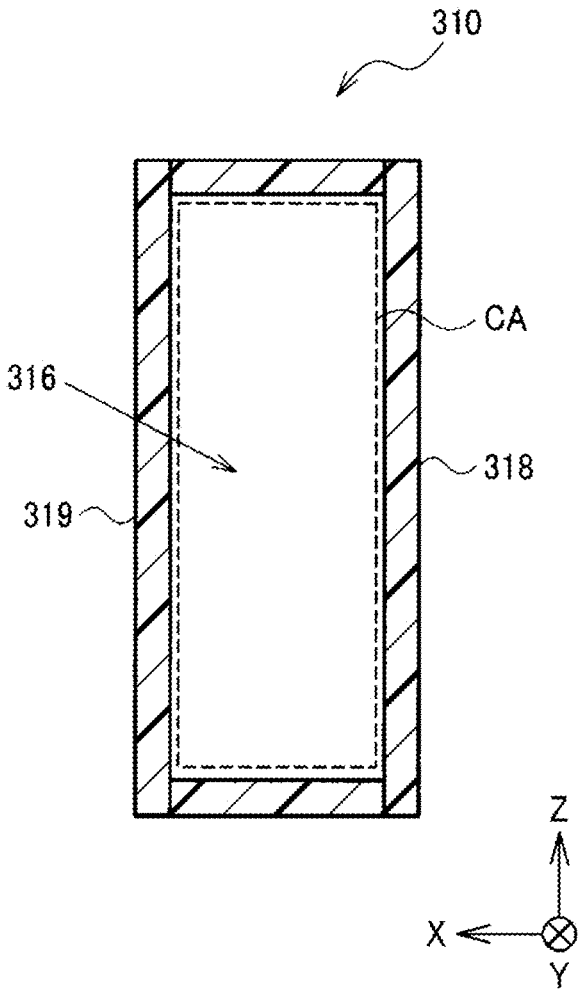
FIG. 27 is a diagram illustrating an example of a calibration area.

FIG. 27 is a diagram illustrating another example of the calibration area CA. As illustrated in FIG. 27, when the ink tank 310 is empty, a wide range of the first ink tank wall 316 can be used as the calibration area CA. For example, the processing section 120 detects and notifies an ink end by using the method of the present embodiment, the method of the related art of counting the number of times of ejection of ink IK, or both. When the ink end is notified, the user replenishes the ink tank 310 with ink IK from a bottle or the like, and resets the remaining amount of ink after the replenishment. In such a use case, it is assumed that the amount of ink in the ink tank 310 is very small after the notification of the ink end and before the reception of the reset operation. Therefore, as illustrated in FIG. 27, it is possible to consider a wide range of the first ink tank wall 316 as the calibration area CA.

In both FIGS. 26 and 27, the calibration area CA is a partial area of the first ink tank wall 316. Therefore, the pixel data which is the reading result of the calibration area CA corresponds to the above-described DAT1. In this case, the light source 323 is controlled so that the reading result of the calibration area CA is the maximum value of the digital data. For example, the amount of light of the light source 323 is increased by using the ratio of (255/pixel data of the calibration area CA). As described above, the control for increasing the amount of light can be realized by at least one of the control for increasing the luminous intensity and the control for increasing the duty ratio.

Depending on the light source 323, there is also a light source of which luminous intensity increases due to change with time. When the calibration is performed in advance so that DAT1=255, in a case where the luminous intensity becomes high due to change with time, the light with a light amount larger than the light amount corresponding to 255 is returned from the calibration area CA. Actually, in the A/D conversion circuit of the AFE circuit 130, a range of convertible analog voltage is set. When the luminous intensity increases due to change with time, since the output signal OS, which is the reading result of the calibration area CA, has a voltage value larger than the upper limit value Vmax of the conversion range, it is clipped to the upper limit value Vmax, and the pixel data value becomes 255. However, in the area where the pixel data is not saturated originally, since the pixel data becomes larger than the desired value, the accuracy of ink amount detection also deteriorates in this case as well.

For example, when the reading result of the calibration area is 255, the processing section 120 may perform control to temporarily reduce the amount of light. Appropriate calibration is possible by two-step control in which the amount of light is reduced to the extent that the reading result of the calibration area CA is not saturated, and then the amount of light is increased until the reading result of the calibration area CA approaches 255. As described above, since the adjustment target value is 255 when the reading result of the calibration area CA corresponds to DAT1, it is easy to set the adjustment target value and perform the calibration processing.

Figure 28:
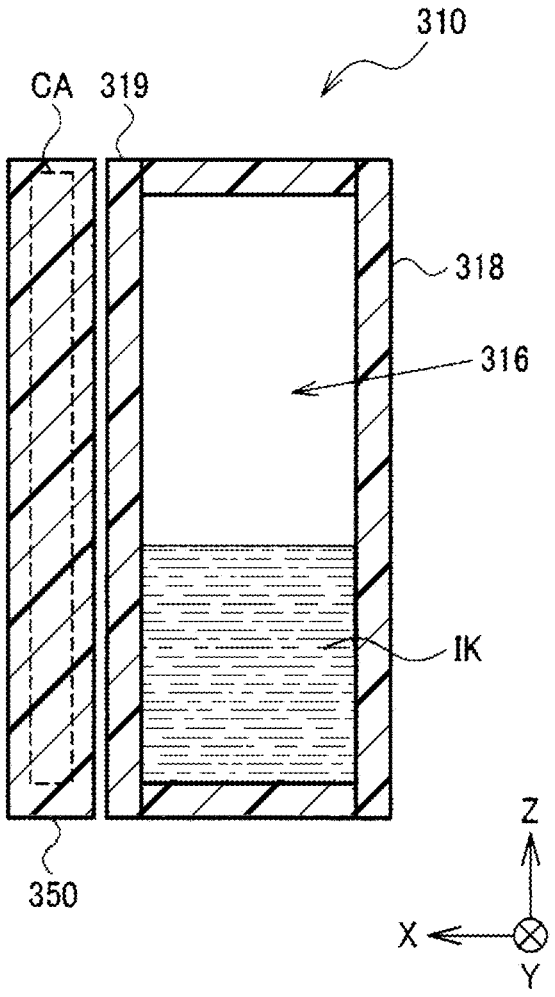
FIG. 28 is a diagram illustrating an example of a calibration area.

FIG. 28 is a diagram illustrating another example of the calibration area CA. As illustrated in FIG. 28, the calibration area CA is not limited to the first ink tank wall 316. For example, the area where the ink IK does not exist may be an area provided on a lateral outer side of the ink tank 310. In this way, since it is guaranteed that the ink IK does not exist in the calibration area CA, it is possible to suppress the influence of the ink IK on the calibration.

For example, in the printer, when the ink tank 310 and the sensor unit 320 move relatively to each other, a reflective member 350 may be provided on the lateral outer side of the ink tank 310. The calibration area CA is an area included in the reflective member 350. For example, the printer is an on-carriage type apparatus, the sensor unit 320 is provided outside the carriage 106, and the reflective member 350 is mounted on the carriage 106. The reflective member 350 is provided in the +X direction or the −X direction of the ink tank 310, and the carriage 106 reciprocates in the X-axis direction with respect to the sensor unit 320. In this way, the sensor unit 320 for detecting the ink amount can also be used for the calibration.

For example, the reflective member 350 is a member made of the same material as the ink tank 310. In a narrow sense, the reflective member 350 is the same member as the first ink tank wall 316. In this way, the reading result of the calibration area CA corresponds to DAT1 as in the examples of FIGS. 26 and 27. Therefore, the reading result of the calibration area CA may be brought closer to 255, and the adjustment target value can be easily set.

However, the calibration of the present embodiment is not limited to the example in which the reading result of the calibration area CA corresponds to DAT1. In other words, the adjustment target value is not limited to the maximum value of digital data.

Figure 29:
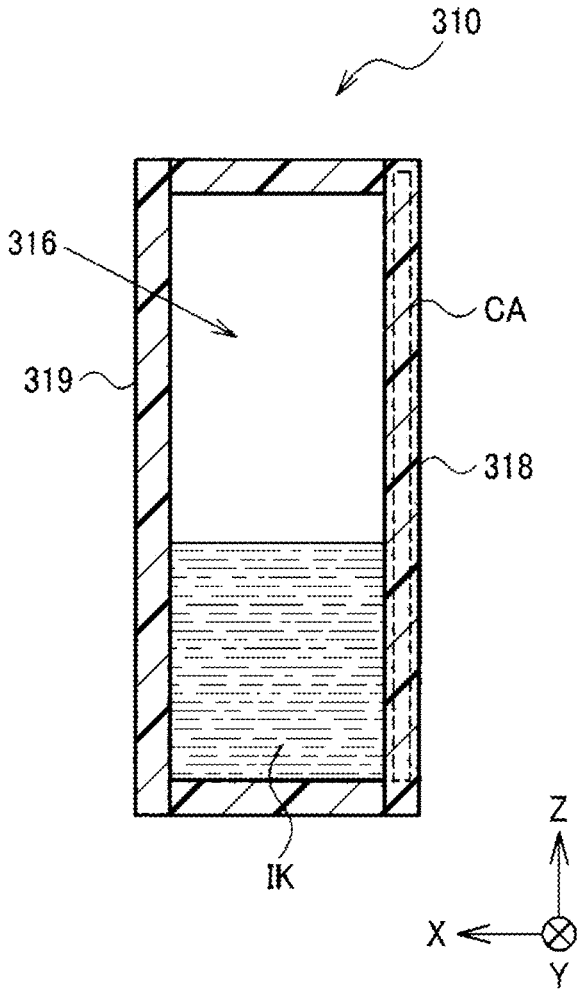
FIG. 29 is a diagram illustrating an example of a calibration area.

FIG. 29 is a diagram illustrating another example of the calibration area CA. As illustrated in FIG. 29, the calibration area CA may be an area of the end of the ink tank 310 in the horizontal direction. The horizontal direction here is ±X direction, and the area of the end in the horizontal direction is an end in the +X direction or an end in the −X direction in a plan view of the ink tank 310 observed from the sensor unit 320.

More specifically, the area of the end is an area corresponding to a thickness of the side wall of the ink tank 310. The side wall here is the third ink tank wall 318 which is a wall in the −X direction or the fourth ink tank wall 319 which is a wall in the +X direction. Specifically, the calibration area CA may be an area where the first ink tank wall 316 and the third ink tank wall 318 overlap, or an area where the first ink tank wall 316 and the fourth ink tank wall 319 overlap in a plan view of the ink tank 310 observed from the sensor unit 320. Alternatively, the calibration area CA may be an area where the third ink tank wall 318 or the fourth ink tank wall 319 is exposed.

The ink IK is stored in an area of the ink tank 310 surrounded by the inner surfaces of the first ink tank wall 316 to the fourth ink tank wall 319. Since the ink IK does not exist in the calibration area CA illustrated in FIG. 29, highly accurate calibration is possible. Further, unlike the example of FIG. 28, it is not necessary to separately provide a member dedicated to calibration.

However, while the thickness of the first ink tank wall 316 is relatively thin in the ±Y direction, the thickness of the calibration area CA in FIG. 29 is relatively thick in the ±Y direction. When the ink tank 310 is a milky white member having a relatively low transmittance, the whiteness becomes stronger in the thick portion in the ±Y direction, so that the value of the pixel data as the reading result becomes larger.

In this case, the pixel data that is the reading result of the calibration area CA is larger than that of DAT1. Therefore, even when the calibration is performed so that the reading result of the calibration area CA is 255, DAT1 is smaller than 255.

The relationship between the reading result of the calibration area CA and DAT1 is known from the design. The relationship here is, for example, the ratio of digital values that are the reading results. Therefore, for example, it is possible to determine X in advance that satisfies the condition that DAT1 is 255 when the reading result of the calibration area CA is X (X≠255). Therefore, the processing section 120 acquires X as an adjustment target value, and adjusts the amount of light of the light source 323 so that the reading result of the calibration area CA becomes the adjustment target value.

However, in the example illustrated in FIG. 29, it is assumed that X>255. For example, when X=300 and the value of the reading result of the calibration area CA is 300, DAT1 can be brought closer to 255. However, when the A/D conversion circuit of the AFE circuit 130 performs 8-bit A/D conversion, the digital value of 300 cannot be expressed. For example, when the upper limit voltage value to be A/D converted is Vmax, the voltage value equal to or more than Vmax is clipped to Vmax, then A/D conversion is performed, and 255 is output.

For example, the A/D conversion circuit may have a configuration capable of performing A/D conversion with a larger number of bits than when performing the ink amount detection processing. For example, the A/D conversion circuit may be a 9-bit A/D converter capable of converting the above Vmax to 255 and outputting a digital value in a range of 0 to 511. In this case, the analog voltage up to twice Vmax is not clipped. Therefore, it is possible to set a digital value larger than 255 as the adjustment target value and control the value of the reading result of the calibration area CA to approach the adjustment target value.

However, the calibration of the present embodiment is not limited to this. For example, the A/D conversion circuit may have a variable voltage range for A/D conversion. By making the upper limit voltage value larger than Vmax, the reading result of the calibration area CA is not clipped, and appropriate calibration becomes possible.

Further, in the configuration using the reflective member 350 illustrated in FIG. 28, the reflective member 350 may be a member made of a material different from that of the ink tank 310. Also in this case, the adjustment target value can be determined in advance from the relationship between the reflectance of the reflective member 350 and the reflectance of the ink tank 310. The adjustment target value may be a value larger than the maximum value of the digital data as described above or a value smaller than the maximum value of the digital data. The processing section 120 adjusts the amount of light of the light source 323 so that the result obtained by reading the calibration area CA becomes the adjustment target value.

Further, the calibration area CA may be a portion thicker than other portions in the wall of the ink tank 310. For example, the calibration area CA illustrated in FIG. 29 is also a wall of the ink tank 310, and is a portion thicker than other portions, for example, a portion of the first ink tank wall 316 that does not overlap the third ink tank wall 318. However, the calibration area CA is not limited to this.

Figure 30:
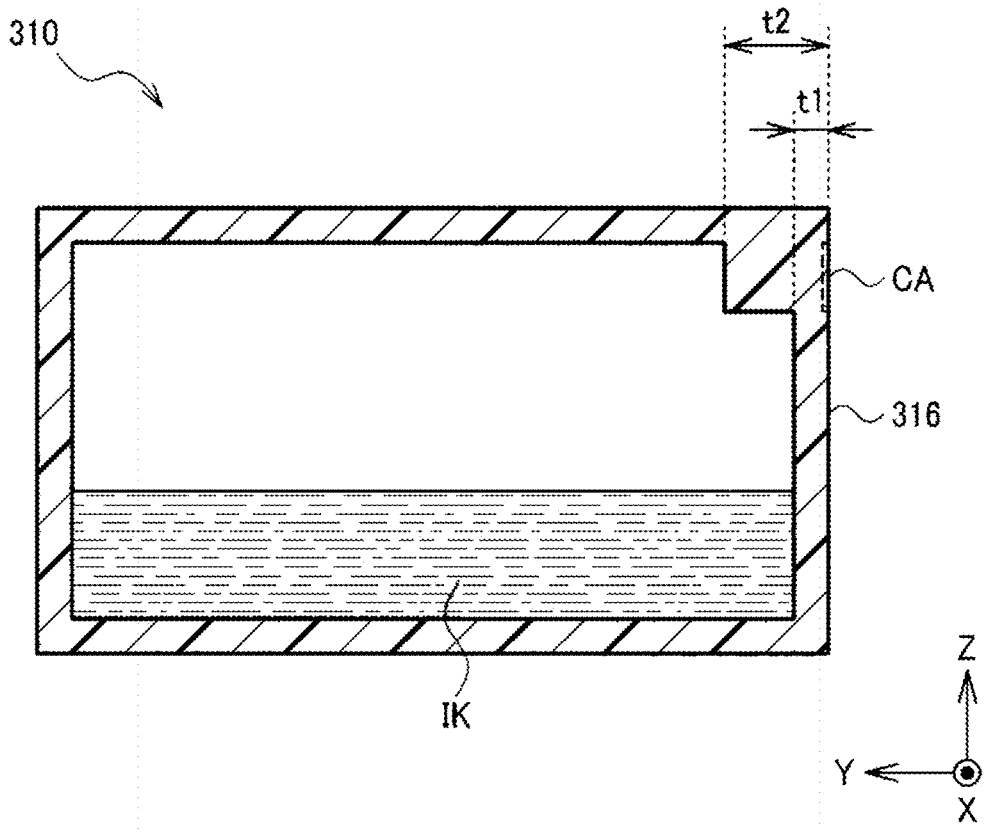
FIG. 30 is a diagram illustrating an example of a calibration area.

FIG. 30 is a diagram illustrating another example of the calibration area CA. For example, the first ink tank wall 316 of the ink tank 310 may have a different thickness depending on the position on the Z-axis as illustrated in FIG. 30. In the example of FIG. 30, a thickness t1 of the area where a Z coordinate value is equal to or less than a given threshold and a thickness t2 of the area where a Z coordinate value is larger than the threshold satisfy t2>t1. The calibration area CA is set in a portion of the first ink tank wall 316 of which a thickness satisfies t2. In this case, there is a possibility that the ink IK exists on the inner side of the calibration area CA, specifically, on the +Y direction side when viewed from the sensor unit 320. However, when the transmittance of the ink tank 310 is low to some extent, scattering and absorption inside the first ink tank wall 316 become large. Therefore, since the intensity of the reflected light on the first ink tank wall 316 is sufficiently stronger than the intensity of the light reaching the ink IK, the influence of the ink IK on the calibration can be suppressed. That is, the area where the ink IK does not exist in the present embodiment is not limited to the area where the ink IK does not exist at all in the +Y direction from the sensor unit 320 to the ink tank 310, and includes an area where sufficient light does not reach the ink IK even when the ink IK exists on the inner side.

Note that, the processing section 120 may adjust the output of the sensor 190 by using a gain based on the result obtained by reading the calibration area CA. In this way, in addition to controlling the light source 323, it is possible to adjust the range of the pixel data by using a magnitude of a gain with respect to the pixel data. The light amount adjustment of the light source 323 is superior to the gain adjustment in that a resolution of the pixel data is improved or an amplification of noise is suppressed. However, the gain adjustment is effective when the range cannot be expanded by adjusting only the light source 323. For example, the result obtained by reading the calibration area CA may be a value after gaining the output of the sensor 190. That is, the amount of light and the gain are adjusted so that the value after the gain is applied becomes the adjustment target value. By acquiring the output of the sensor 190 by using the adjusted light amount and applying the adjusted gain to the output, it is possible to bring DAT1 closer to the maximum value of the digital data.

Figure 31:
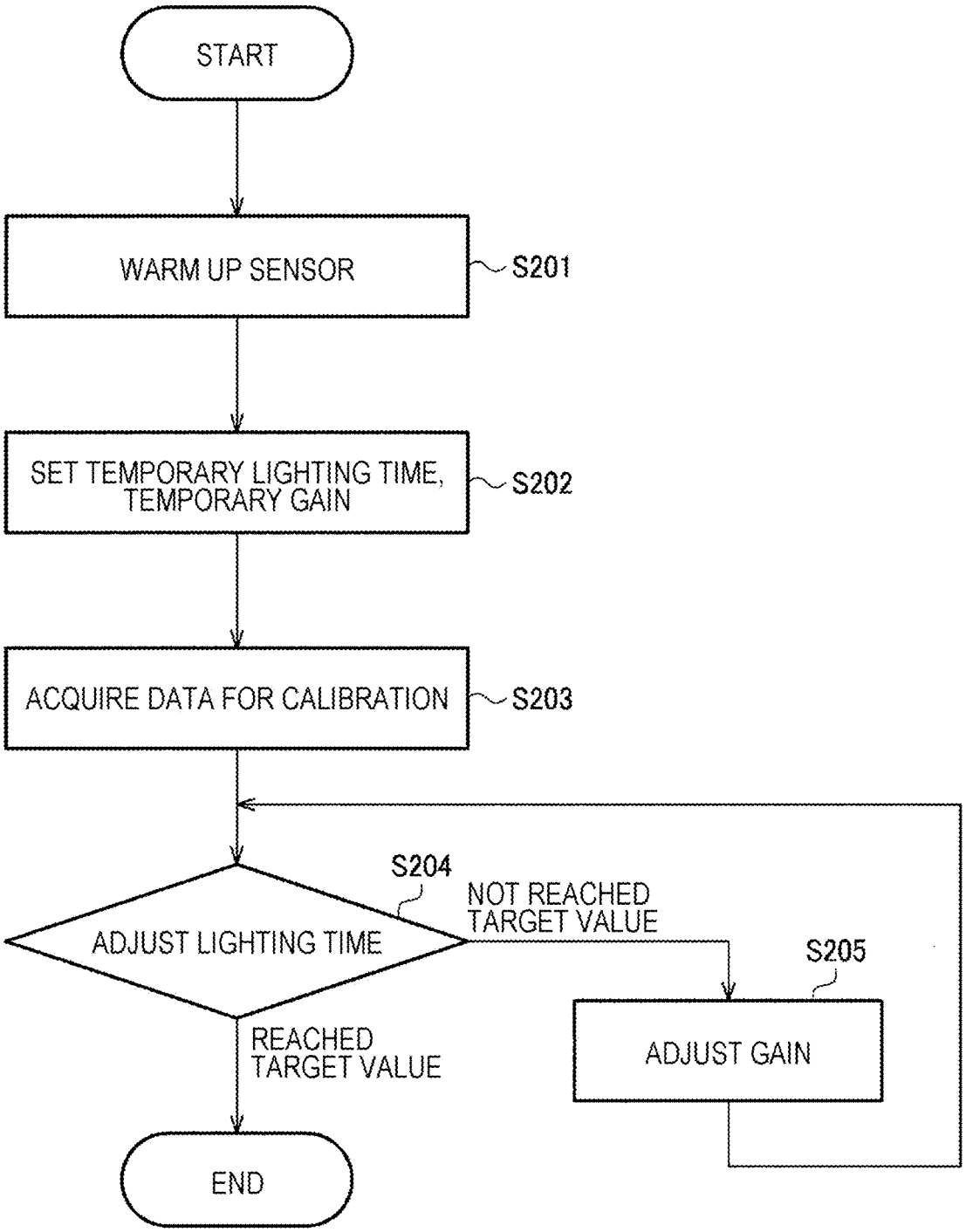
FIG. 31 is a flowchart for explaining calibration processing.

FIG. 31 is a flowchart for explaining calibration. The processing of FIG. 31 is executed, for example, when the printer is started. When the processing is started, the photoelectric conversion device 322 is first warmed up (step S201). Next, the processing section 120 sets a light amount and a gain to initial values (step S202). Note that, an example in which the amount of light is adjusted by using the lighting time of the light source 323 will be described below.

Next, the processing section 120 acquires the reading result of the calibration area CA by using the light amount and the gain set in step S202 by controlling the sensor unit 320 (step S203). The processing section 120 controls the lighting time so that the result acquired in step S203 becomes the adjustment target value (step S204).

When the reading result reaches the adjustment target value by adjusting the lighting time, the processing section 120 ends the calibration and executes the ink amount detection processing or the like by using the adjusted lighting time.

On the other hand, when the reading result does not reach the adjustment target value only by adjusting the lighting time, the processing section 120 repeats the re-adjustment of the lighting time (step S204) and the gain adjustment (step S205) until the reading result reaches the adjustment target value. Note that, the lighting time adjustment and the gain adjustment are not limited to those performed alternately. For example, the lighting time may be adjusted preferentially, and the gain may be adjusted when the reading result does not reach the adjustment target value only with the lighting time adjustment.

3. Ink Type Determination Processing

Further, in the present embodiment, the processing section 120 may determine the ink type of the ink IK in the ink tank 310 based on the output of the sensor 190.

3.1 Outline of Ink Type Determination Processing

As described above with reference to FIGS. 2 and 3, the electronic apparatus 10 may include a plurality of ink tanks 310 filled with different kinds of ink IK. In this case, there is a possibility that the user erroneously fills the other ink tank 310 such as the ink tank 310*b* with the ink IKa to be filled in the ink tank 310*a*. Even when the electronic apparatus 10 is a monochrome printer having one ink tank 310, when the user uses printers of different models together, there is a possibility that the ink IK used for another printer is erroneously filled. Furthermore, even when the user uses only one monochrome printer, since many different inks IK are distributed in the market depending on the model, the possibility that the user erroneously purchases and fills ink for the different model cannot be denied.

When the ink tank 310 to be filled with yellow ink is filled with magenta ink, the color as the printing result largely deviates from the desired color. That is, in order to perform appropriate printing, it is necessary to appropriately detect the error of the color of the ink IK. Therefore, the processing section 120 determines the ink color as the ink type.

The sensor 190 of the present embodiment detects light of a plurality of colors incident from the ink tank 310 during a period in which the light source 323 emits light. The processing section 120 estimates the ink type in the ink tank 310 based on the output of the sensor 190, at the position corresponding to the meniscus portion of the ink IK.

The light of the plurality of colors in the present embodiment may be R light corresponding to a red wavelength band, G light corresponding to a green wavelength band, and B light corresponding to a blue wavelength band. A signal corresponding to R light is referred to as an R signal, a signal corresponding to G light is referred to as a G signal, and a signal corresponding to B light is referred to as a B signal.

For example, the printer includes a red LED 323R, a green LED 323G, and a blue LED 323B, and the photoelectric conversion device 322 outputs an R signal, a G signal, and a B signal based on the light emission of each LED. Alternatively, the printer may include a white light source and a plurality of filters having different pass bands, and the photoelectric conversion device 322 may output an R signal, a G signal, and a B signal based on the transmitted light of the filters. However, the plurality of light in the present embodiment are not limited to RGB, and some of the light may be omitted or light in another wavelength band may be added.

Figure 32:
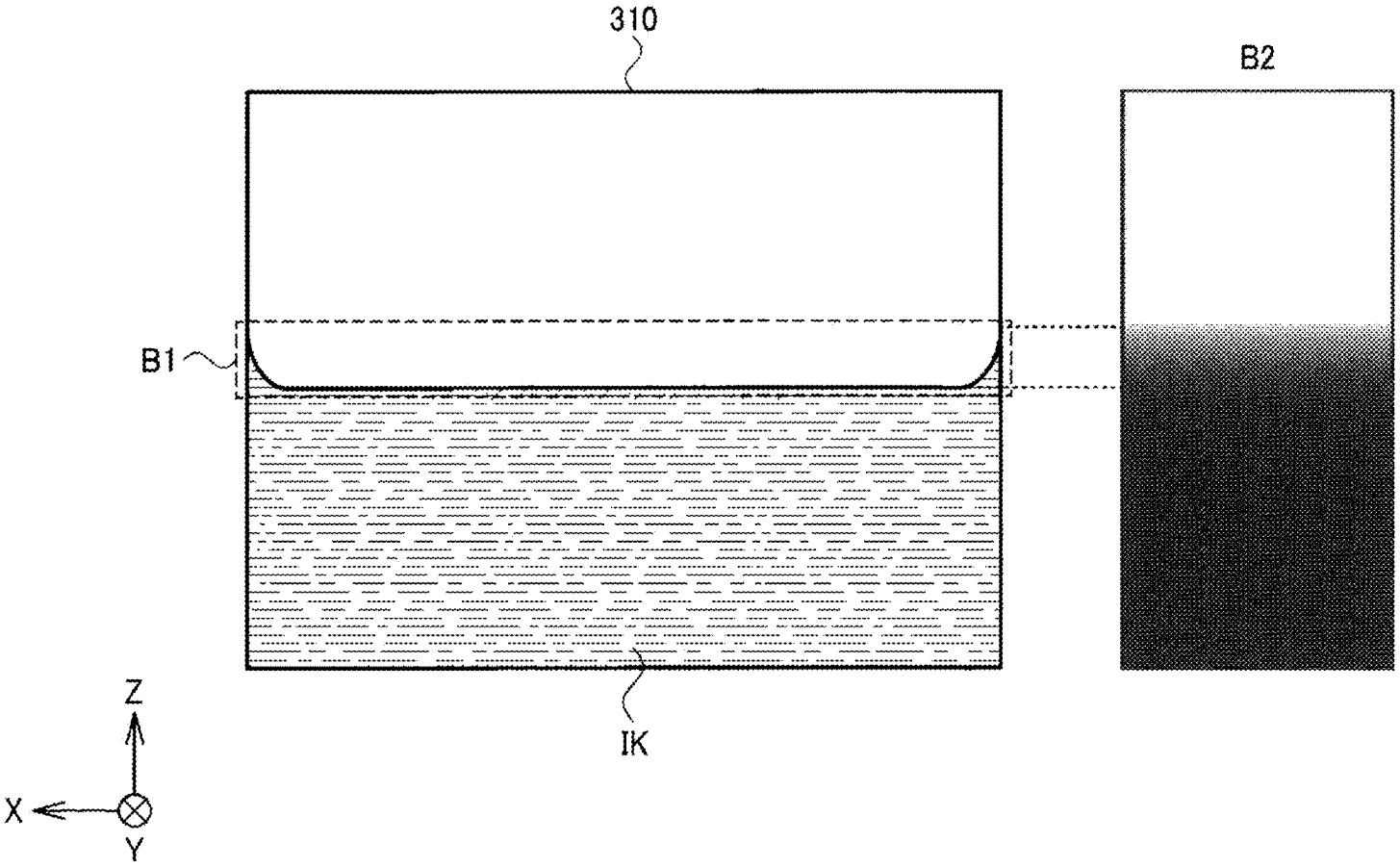
FIG. 32 is a diagram illustrating an example of a meniscus and an example of an image as a reading result.

FIG. 32 is a diagram for explaining the meniscus portion and the reading result of the meniscus portion. The meniscus represents the bending of the ink liquid level caused by an interaction between the ink tank 310 and the ink IK. The meniscus portion is a portion where the ink liquid level is bent. For example, the range indicated by B1 of FIG. 32 is the meniscus portion. As illustrated in FIG. 32, in the meniscus portion, the thickness of the ink IK is thinner than that in the area vertically below the meniscus portion. Specifically, the length of the area where the ink IK exists is short in the ±Y direction. Therefore, the degree of light absorption by the ink IK is relatively low.

The ink IK easily absorbs light, and the dye ink IK has a particularly high absorbance. Therefore, when the thickness of the ink IK in the observation direction is thick to some extent, the area where the ink IK exists is observed in a color close to black. When the signal from the ink tank 310 is detected by using the photoelectric conversion device 322, the observation direction is ±Y direction. Therefore, in a portion below the meniscus portion, the color is close to black regardless of the ink color, and it is often difficult to determine the ink type.

B2 of FIG. 32 represents the reading result by the sensor 190. The reading result is, for example, image data formed by using the output of the photoelectric conversion device 322. As illustrated in FIG. 32, the reading result is close to black below the meniscus portion and close to white above the meniscus portion. The meniscus portion is illustrated in FIG. 32 as a gradation from black to white for convenience, but when an actual ink IK is targeted, a color peculiar to the ink IK appears in the portion where the density is low. For example, the area corresponding to the meniscus portion of the image data has a tint such as cyan, magenta, and yellow depending on the ink color.

Therefore, the processing section 120 may estimate the ink type based on the color that is the reading result of the meniscus portion. For example, the sensor 190 acquires an R signal, a G signal, and a B signal as a reading result. Then, the processing section 120 determines the color based on at least one of an R pixel value, a G pixel value, and a B pixel value. As described above, the portion other than the meniscus portion is close to white or black, so that the saturation is very low. Therefore, the processing section 120 determines, for example, an area having a saturation equal to or higher than a predetermined threshold as a meniscus portion.

For example, when the color that is the reading result of the meniscus portion is blue, the processing section 120 determines that the color of the ink IK is cyan or black. Further, when the color that is the reading result of the meniscus portion is red, the processing section 120 determines that the color of the ink IK is magenta or yellow. In this way, the ink color can be determined based on which component of RGB has a higher contribution. Note that, when it is necessary to distinguish between cyan and black, and magenta and yellow, different color components may be compared. Further, the processing section 120 may calculate the hue based on each pixel value of RGB, for example, and determine the ink color based on the hue value.

Alternatively, the determination of the meniscus portion and the determination of the ink color may be performed based on the waveforms of the R signal, the G signal, and the B signal. Details will be described later with reference to FIG. 33 and the like.

Note that, since there are inks IK such as magenta pigment ink and yellow pigment ink that have a color that can be clearly distinguished from black even in the area where the thickness of the ink IK is thick, in distinguishing such an ink IK from other ink IKs, the reading result of the area below the meniscus portion may be used.

3.2 Ink Color Determination of Dye Ink

The processing section 120 may determine the color of the dye ink as the ink type. Dye ink has a higher degree of light absorption than pigment ink. Therefore, when the ink IK is thick, it is difficult to determine the ink color because the ink area becomes close to black regardless of the ink color. In that respect, by using the meniscus portion for the determination as described above, the ink color can be appropriately determined.

Figure 33:
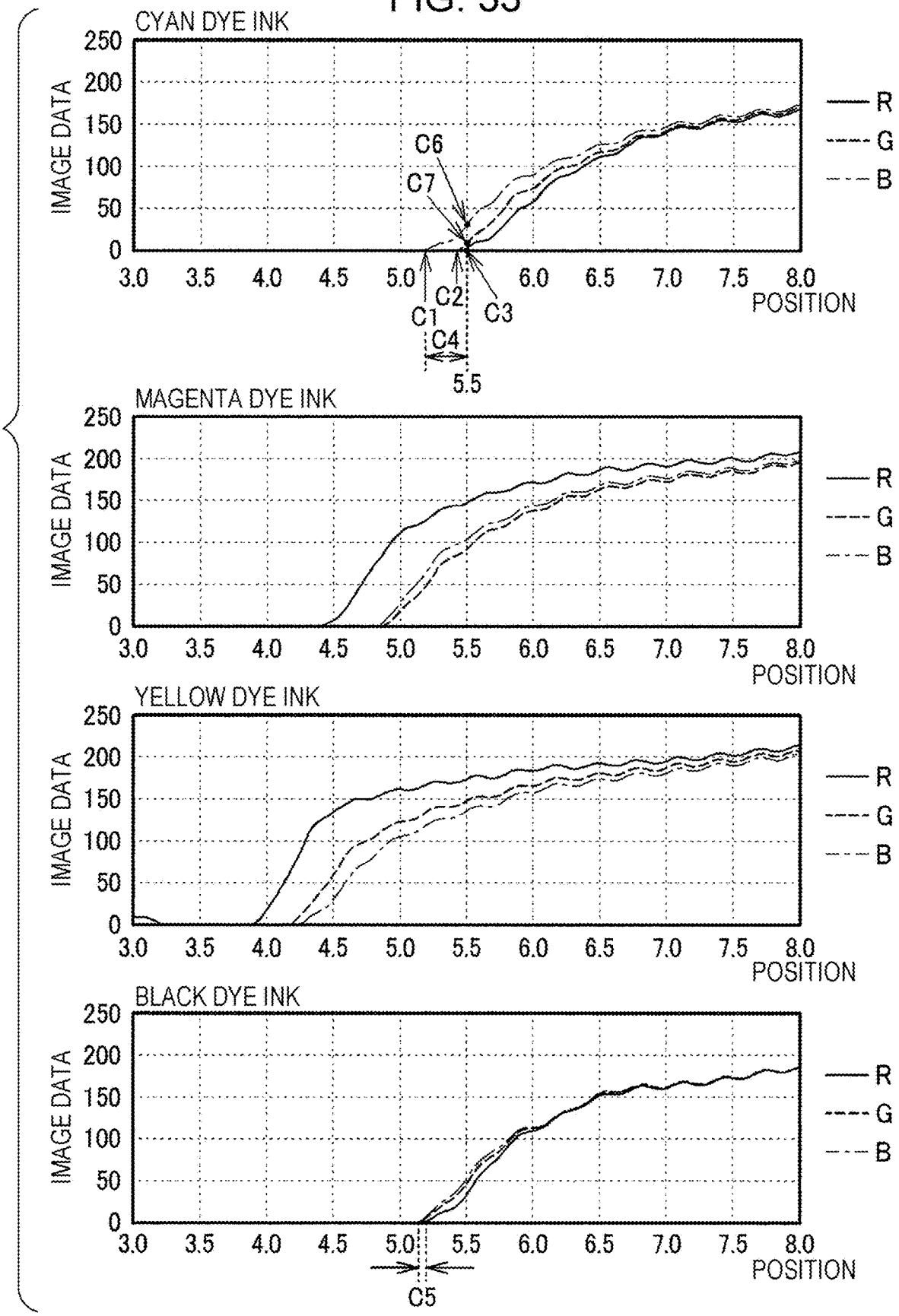
FIG. 33 is a diagram illustrating an example of reading results for dye ink.

FIG. 33 is a graph representing the reading results of each of cyan dye ink, magenta dye ink, yellow dye ink, and black dye ink. As illustrated in FIG. 33, each reading result includes an R signal, a G signal, and a B signal. The horizontal axis of each graph in FIG. 33 represents a position of the photoelectric conversion element, and the vertical axis represents a signal value. The signal value is, for example, 8-bit digital data. Note that, although the pixel value in an ink non-detection area is a value of about 150 to 200 here, the value may be corrected to about 255 by performing calibration. Further, here, the height of the ink liquid level differs for each ink IK.

As described above, the dye ink absorbs a large amount of light, and the reflected light from the portion where the ink IK exists in a sufficient thickness is very small. Therefore, the processing section 120 determines that the area where the value of each RGB signal is close to the minimum value is the area where the ink IK exists. In the meniscus portion, since the thickness of the ink IK becomes thin as described above, a color component corresponding to the ink color is observed. This is detected as a rising edge of each RGB signal, for example, as indicated by C1 to C3 of FIG. 33. The rising edge here represents that the signal value starts to increase from the minimum value or a value in the vicinity of the minimum value in the direction from vertically downward to upward. In a case of the cyan dye ink, C1 is a rising edge of the B signal, C2 is a rising edge of the G signal, and C3 is a rising edge of the R signal.

The processing section 120 sets the signal in the range including the rising edge of the reading result as the reading result of the meniscus portion. For example, the processing section 120 determines the ink type based on the signal including the range indicated by C4 in the reading result for the cyan dye ink.

For example, the processing section 120 may estimate the ink type based on how the signals of a plurality of color components corresponding to a plurality of light having different wavelength bands rise in a direction from with ink to without ink in the meniscus portion. The direction from with ink to without ink is, for example, a direction from vertically downward to upward, and in a narrow sense, the +Z direction. The rising edge is a point where the signal value starts to rise at a position above the lower wall of the ink tank 310 as described above, so that there is an advantage that detection is easy.

The specific rising order is as illustrated in FIG. 33. For example, the processing section 120 determines that the color of ink IK is cyan or black when the rising order in the meniscus portion is an order of the B signal, the G signal, and the R signal. When the rising order in the meniscus portion is an order of the R signal, the B signal, and the G signal, the processing section 120 determines that the color of ink IK is magenta. When the rising order in the meniscus portion is an order of the R signal, the G signal, and the B signal, the processing section 120 determines that the color of the ink IK is yellow.

Note that, the cyan ink here includes ink having a color similar to cyan, such as light cyan ink. Similarly, the magenta ink includes ink having a color similar to magenta, such as light magenta ink and red ink. The yellow ink includes ink having a color similar to yellow, such as light yellow ink. The black ink includes ink having a color similar to yellow, such as light black ink.

In this way, it is possible to determine the ink color of the dye ink by using the meniscus portion. Note that, it is desirable that the transmittance of the ink tank 310 is high in consideration of clarifying a difference in a signal waveform for each ink color and accurately determining the position of the rising edge. For example, when the ink type determination processing is performed by using the reading result of the meniscus portion, the ink tank 310 may have a configuration including a background plate 330 therein, as illustrated in FIG. 22.

As described above, the cyan ink and the black ink have the same rising order of signals. In the present embodiment, it is not necessary to distinguish between cyan ink and black ink. Even in this case, it is possible to identify three ink types of cyan or black, magenta, and yellow. Therefore, for example, it can be detected that a given ink tank 310 is filled with ink IK of an erroneous color.

Note that, the processing section 120 may distinguish between the cyan ink and the black ink based on the difference in the rising position between the signals. The difference in the rising position represents, for example, a distance between a rising position of the B signal and a rising position of the R signal on the Z-axis. As illustrated in FIG. 33, a difference in a rising position in the cyan ink is C4, that is larger than C5 which is a difference in a rising position in the black ink. Therefore, the processing section 120 can determine whether the ink IK to be processed is cyan ink or black ink by performing comparison processing between the difference in rising position and a given threshold.

Further, the ink type determination processing using the reading result of the meniscus portion is not limited to the one using the rising order. For example, when a signal intensity in the meniscus portion is B signal>G signal>R signal, the processing section 120 determines that the color of the ink IK is cyan or black. When the signal intensity in the meniscus portion is R signal>B signal>G signal, the processing section 120 determines that the color of the ink IK is magenta. When the signal intensity in the meniscus portion is R signal>G signal>B signal, the processing section 120 determines that the color of the ink IK is yellow.

The intensity of each signal is specifically a value of digital data after A/D conversion. However, as illustrated in FIG. 33, signals of a plurality of colors are sequentially raised in the meniscus portion. Therefore, when two or more signals are before rising, the signal intensities cannot be appropriately compared. Therefore, the signal intensity in the meniscus portion may be, for example, the signal intensity at the position where the last signal rises in the +Z direction. When cyan ink is targeted, the rising position of the last signal is C3, which is the rising position of the R signal. The intensity of the B signal at the position corresponding to C3 is C6, the intensity of the G signal is C7, and the intensity of the R signal is 0. Therefore, the signal intensity of the cyan ink is B signal>G signal>R signal. However, since the intensity can be compared when all the signals are raised, the ink type may be determined by using the signal intensity at a position in the +Z direction rather than C3. For example, the processing section 120 may obtain an end point on the +Z side of the meniscus portion by using a condition that the saturation is equal to or higher than a predetermined threshold as described above. Then, the processing section 120 may obtain the signal intensity of each signal at an optional position between the point where all the signals rise and the end point on the +Z side.

3.3 Ink Color Determination of Pigment Ink

Further, the processing section 120 may determine a color of pigment ink as the ink type. Pigment ink has a lower degree of light absorption than dye ink. Therefore, for example, when the ink tank 310 having a relatively high transmittance is used by providing the background plate 330, the intensity of the reflected light is increased to some extent even in the area where the ink IK exists.

Figure 34:
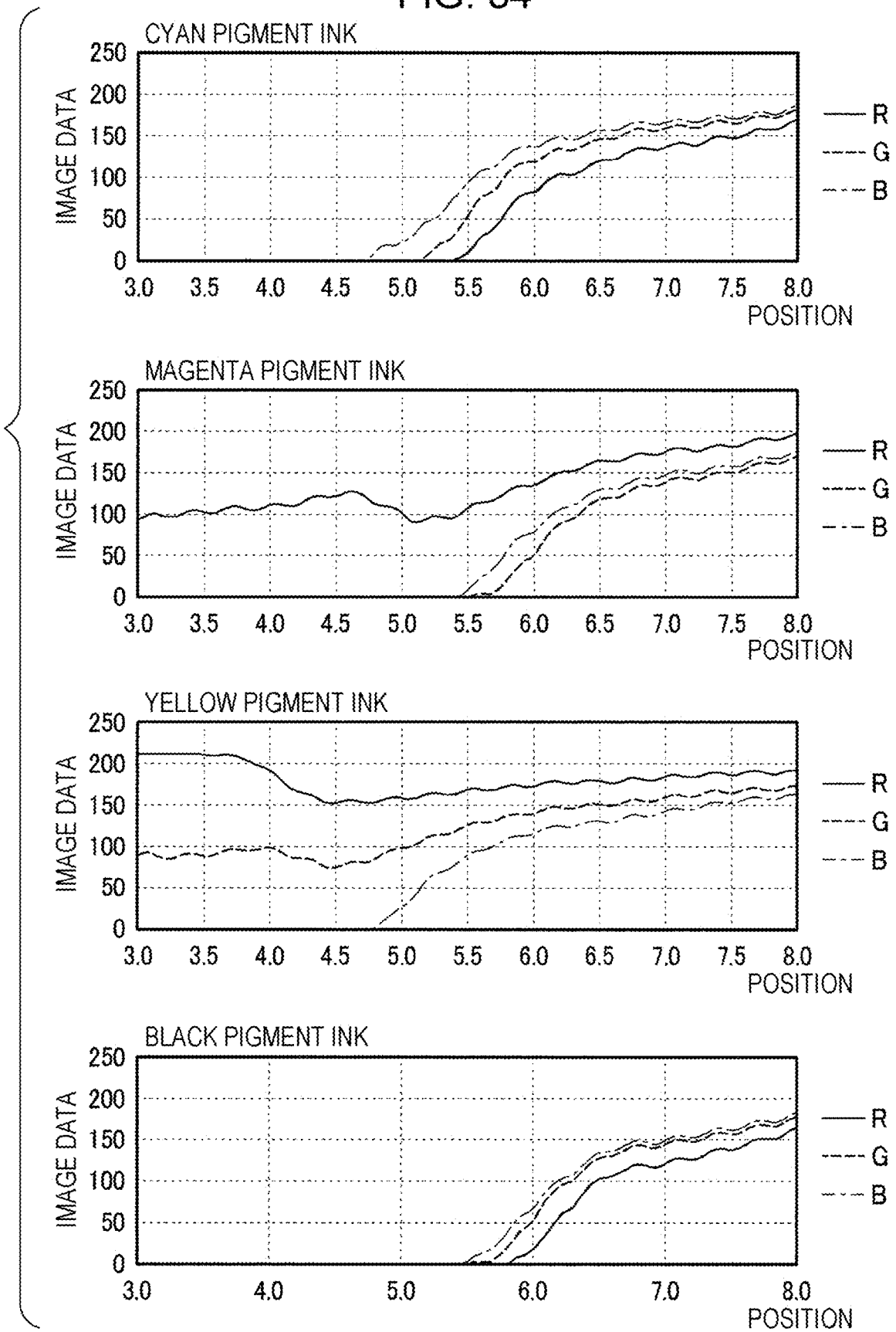
FIG. 34 is a diagram illustrating an example of reading results for pigment ink.

FIG. 34 is a graph representing the reading results of each of the cyan pigment ink, magenta pigment ink, yellow pigment ink, and black pigment ink. Similar to FIG. 33, each reading result includes an R signal, a G signal, and a B signal. The horizontal axis of each graph represents a position of the photoelectric conversion element, and the vertical axis represents a signal value.

Black ink and cyan ink indicate the same tendency as dye ink. That is, in the meniscus portion, the B signal, the G signal, and the R signal rise in this order. Further, a difference in the rising position between the signals is larger in the cyan ink than in the black ink.

As illustrated in FIG. 34, in the magenta pigment ink, the R signal has a sufficiently large value as compared with the minimum value even in the area where the ink IK exists. For example, when 8-bit digital data is used, the signal value in the area where the ink IK of the R signal exists is a sufficiently large value of about 100. As for the R signal, the rising edge is not detected because the value does not start increasing from the vicinity of the minimum value in the +Z direction. On the other hand, the values of the B signal and the G signal are sufficiently small in the area where the ink IK exists, and the rising edge of the B signal and the G signal is detected in this order in the meniscus portion.

As illustrated in FIG. 34, in the yellow pigment ink, the values of the R signal and the G signal are sufficiently larger than the minimum values even in the area where the ink IK exists. For example, in the area where the ink IK exists, the signal value of the R signal is about 200, and the signal value of the G signal is about 100. Therefore, the rising edge is not detected for the R signal and the G signal. On the other hand, the value of the B signal is sufficiently small in the area where the ink IK exists, and the rising edge is detected in the meniscus portion.

The processing section 120 may determine the ink type based on the signal intensity in the meniscus portion. When the signal intensity in the meniscus portion is B signal>G signal>R signal, the processing section 120 determines that the color of ink IK is cyan or black. When the signal intensity in the meniscus portion is R signal>B signal>G signal, the processing section 120 determines that the color of the ink IK is magenta. When the signal intensity in the meniscus portion is R signal>G signal>B signal, the processing section 120 determines that the color of the ink IK is yellow.

As illustrated in FIG. 34, since the rising edge of the R signal is not detected for the magenta pigment ink, the rising position of the G signal is determined to be the position where the last signal rises in the +Z direction. Since the rising edges of the R signal and the G signal are not detected for the yellow pigment ink, the rising position of the B signal is determined to be the position where the last signal rises in the +Z direction. In this way, it is possible to determine the ink color of the pigment ink by using the reading result of the meniscus portion. At that time, since it is possible to use the same determination criteria as that in the dye ink, the processing can be standardized. However, the magenta pigment ink and the yellow pigment ink can be identified based on the presence or absence of the rise of each signal, and the ink color determination processing of the pigment ink is not limited to the above.

3.4 Relationship with Ink Amount Detection

Further, the processing section 120 may perform processing of estimating the ink type and processing of detecting the ink amount based on the output of the sensor 190 at the position corresponding to the meniscus portion of the ink 1K. In this way, the ink type can be determined by using the sensor unit 320 for detecting the ink amount. As described above, the meniscus portion is useful for determining the ink type, but since the meniscus corresponds to the ink liquid level, it is also useful for detecting the ink amount. That is, by appropriately specifying the meniscus portion in the reading result, both the ink amount detection processing and the ink type determination processing can be appropriately executed.

Further, the processing section 120 may detect the ink amount based on the color detection result obtained by detecting the ink surface at the rising start position when the signal value rises in the direction from with ink to without ink, in the detection result of the sensor 190 corresponding to each color of a plurality of colors.

As described above, when a configuration capable of detecting signals of a plurality of colors, for example, a configuration capable of acquiring each signal of RGB is used, the ink amount detection may be performed by using any one signal, or the ink amount detection may be performed by combining a plurality of signals. However, as described above, in the meniscus portion, each signal rises in the order corresponding to the ink color. Therefore, the position of the liquid level, which is the detection result, may change depending on which signal is used for ink amount detection. Since the ink IK exists in the meniscus portion although the thickness of the ink IK is thin, the signal in the wavelength band that is easily absorbed by the ink IK has a gentle rise. In other words, in the +Z direction, when the thickness of the ink IK changes thinly from the area where the ink IK sufficiently exists, a signal having high sensitivity to the change is suitable for detecting the ink amount.

The rising start position represents a position where the rising occurs for the first time in the direction from with ink to without ink, and the detection of the ink surface represents that the signal value starts to increase from the minimum value. For example, in the cyan dye ink and the black dye ink, the ink amount is detected based on the B signal. In the magenta dye ink and the yellow dye ink, the ink amount is detected based on the R signal. For the pigment ink, the rising edge can be detected, and the signal that rises earliest is the B signal for any color. Therefore, in the pigment ink, the ink amount is detected based on the B signal.

The method of the present embodiment may be applied to a printer that detects the ink amount based on the color detection result obtained by detecting the ink surface at the rising start position and does not perform the ink type determination processing.

4. Multifunction Peripheral

Figure 35:
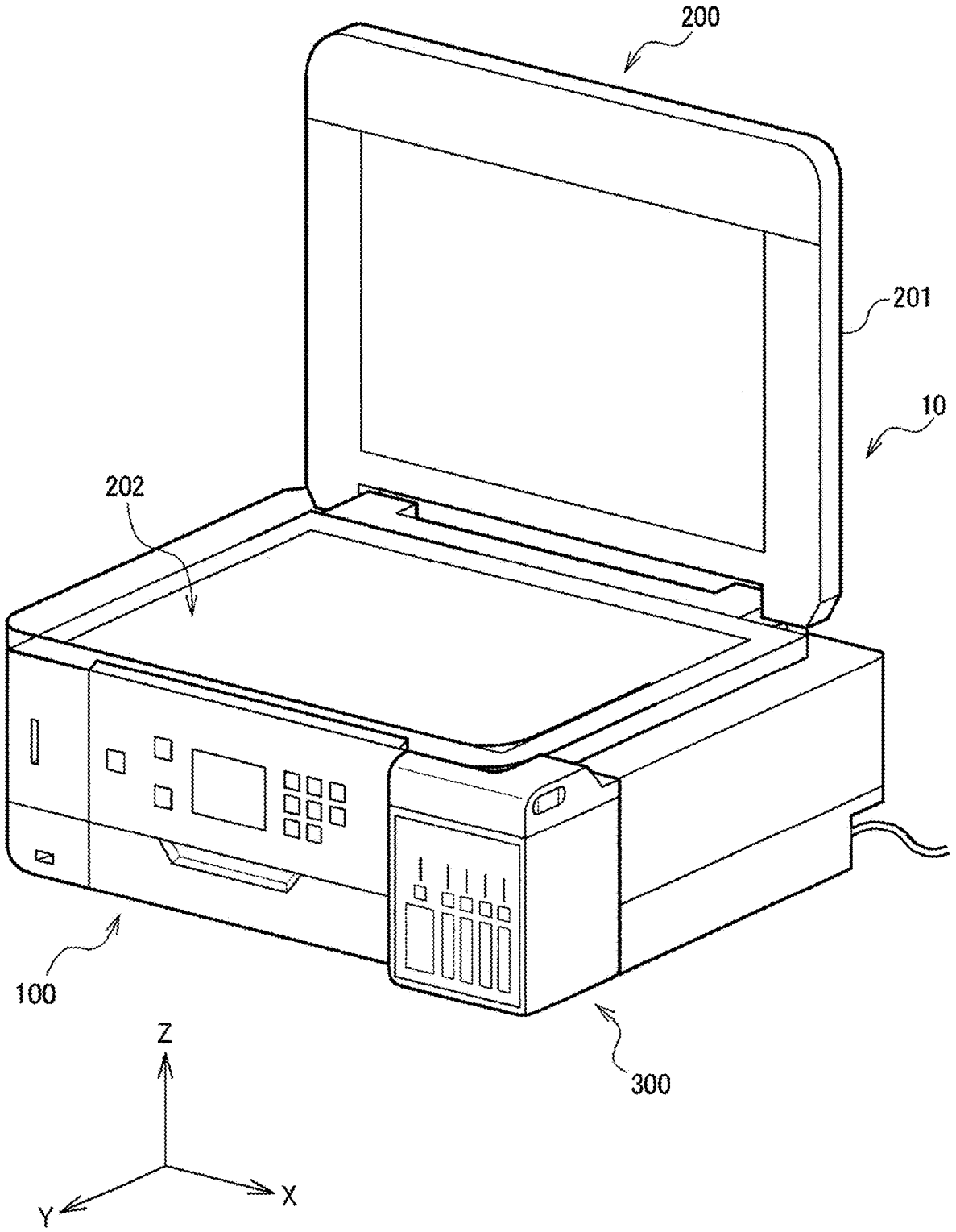
FIG. 35 is a perspective diagram of an electronic apparatus when used as a scanner unit.

The electronic apparatus 10 according to the present embodiment may be a multifunction peripheral having a printing function and a scanning function. FIG. 35 is perspective diagram illustrating a state in which the case 201 of the scanner unit 200 is rotated with respect to the printer unit 100 in the electronic apparatus 10 of FIG. 1. In the state illustrated in FIG. 35, a document table 202 is exposed. The user sets a document to be read on the document table 202, and then instructs the execution of scanning by using the operation section 160. The scanner unit 200 reads an image of the document by performing the reading processing while moving the image reading section (not illustrated) based on an instruction operation by the user. The scanner unit 200 is not limited to a flat bed type scanner. For example, the scanner unit 200 may be a scanner having an auto document feeder (ADF) (not illustrated). The electronic apparatus 10 may be an apparatus having both the flat bed type scanner and a scanner having the ADF.

The electronic apparatus 10 includes the image reading section including a first sensor module, the ink tank 310, the print head 107, the second sensor module, and the processing section 120. The image reading section reads the document by using a first sensor module including m, m being an integer of two or more, linear image sensor chips. The second sensor module includes n, n being an integer of 1 or more and n<m, linear image sensor chips, and detects light incident from the ink tank 310. The processing section 120 detects the amount of ink in the ink tank based on the output of the second sensor module. The first sensor module is a sensor module used for scanning an image in the scanner unit 200, and the second sensor module is a sensor module used for the ink amount detection processing in the ink tank unit 300.

Both the first sensor module and the second sensor module include a linear image sensor chip. The specific configuration of the linear image sensor chip is the same as that of the photoelectric conversion device 322 described above, and a plurality of photoelectric conversion elements are arranged side by side in a predetermined direction. Since the linear image sensor used for the image reading and the linear image sensor used for the ink amount detection processing can be used in common, it is possible to improve the manufacturing efficiency of the electronic apparatus 10. Of course, it is also possible to make the linear image sensor used for image reading and the linear image sensor used for the ink amount detection processing different linear image sensors specialized respectively.

However, the first sensor module needs to have a length corresponding to the document size to be read. Since the length of one linear image sensor chip is about 20 mm, for example, the first sensor module needs to include at least two linear image sensor chips. On the other hand, the second sensor module has a length corresponding to the target range of ink amount detection. The target range of ink amount detection can be variously modified but is generally shorter than that of the image reading. That is, as described above, m is an integer of 2 or more, n is an integer of 1 or more, and m>n. Thus, the number of linear image sensor chips can be appropriately set according to the application.

The difference between the first sensor module and the second sensor module is not limited to the number of linear image sensor chips. In the m linear image sensor chips of the first sensor module, the longitudinal direction is provided along the horizontal direction. In the n linear image sensor chips of the second sensor module, the longitudinal direction is provided along the vertical direction. Since the second sensor module needs to detect the liquid level of the ink IK as described above, the longitudinal direction thereof is the vertical direction.

On the other hand, in consideration of reading the image of the document, the longitudinal direction of the first sensor module needs to be the horizontal direction. This is because when the longitudinal direction of the first sensor module is set to the vertical direction, it is difficult to stably set the document on the document table 202, or it is difficult to stabilize the document posture when the document is transported by the ADF. By setting the longitudinal direction of the linear image sensor chip in accordance with the application, the ink amount detection processing and the image reading can be performed appropriately.

The first sensor module operates at a first operating frequency, and the second sensor module operates at a second operating frequency lower than the first operating frequency. In image reading, it is necessary to continuously acquire signals corresponding to many pixels and to form image data by performing A/D conversion processing, correction processing, or the like of the signals. Therefore, it is desirable to perform reading by the first sensor module at high speed. On the other hand, the ink amount detection is less likely to be a problem even when the number of photoelectric conversion elements is small and it takes a certain amount of time to detect the ink amount. By setting the operating frequency for each sensor module, each sensor module can be operated at an appropriate speed.

Although the present embodiment is described in detail as described above, a person skilled in the art can easily understand that many modifications that do not substantially depart from the novel matters and effects of the present embodiment are possible. Accordingly, all such modifications are intended to be included within the scope of the present disclosure. For example, a term described at least once together with a different term having a broader meaning or the same meaning in the specification or the drawings can be replaced with the different term anywhere in the specification or the drawings. All combinations of the present embodiment and the modifications are also included in the scope of the present disclosure. The configurations and operations of the electronic apparatus, printer unit, scanner unit, ink tank unit, and the like are not limited to those described in the present embodiment, and various modifications can be made.

For example, in the photoelectric conversion device, the linear image sensors may be arranged in the horizontal direction or obliquely from the horizontal direction. In this case, by arranging a plurality of linear image sensors in the vertical direction or moving them in the vertical direction relative to the ink tank, the same information as when the linear image sensors are arranged in the vertical direction can be obtained. The photoelectric conversion device may be one or more area image sensors. In this way, one image sensor may be straddled across a plurality of ink tanks.

Further, for example, the photoelectric conversion device and the ink tank may be prepared one-to-one and fixed to each other, but one photoelectric conversion device and a plurality of ink tanks may be relatively moved. In a case of relatively moving the one photoelectric conversion device and a plurality of ink tanks, the photoelectric conversion device may be mounted on the carriage and the ink tank may be provided outside the carriage, or conversely, the ink tank may be mounted on the carriage and the photoelectric conversion device may be provided outside the carriage.

What is claimed is:

1. A printer comprising:

an ink tank;

a print head performing printing by using ink in the ink tank;

a light source irradiating an inside of the ink tank with light;

a sensor detecting light incident from the ink tank during a period in which the light source emits light; and a processing section detecting an amount of ink in the ink tank based on an output of the sensor, wherein the processing section is configured to control the printer to reflect the light from an area where the ink does not exist, and turn on the light source by an amount of light based on a result of the sensor detecting the light reflected from the area where the ink does not exist.

2. The printer according to claim 1, wherein the area is an area above an ink liquid level in a vertical direction.

3. The printer according to claim 2, wherein
the area is an area above a filling port of the ink tank in the vertical direction.

4. The printer according to claim 1, wherein
the area is an area of an end of the ink tank in a horizontal direction intersecting the vertical direction.

5. The printer according to claim 4, wherein
the area of the end of the ink tank is an area corresponding to a thickness of a side wall of the ink tank.

6. The printer according to claim 1, wherein
the area is an area provided on a lateral outer side of the ink tank.

7. The printer according to claim 6, further comprising:
a reflective member provided on the lateral outer side of the ink tank.

8. The printer according to claim 1, wherein
the area is a portion thicker than other portions in a wall of the ink tank.

9. The printer according to claim 1, wherein
the light source is turned on at a luminous intensity based on the result.

10. The printer according to claim 1, wherein
the light source is turned on at a time based on the result.

11. The printer according to claim 1, wherein
the processing section adjusts an output of the sensor by using a gain based on the result.

12. The printer according to claim 1, wherein
the processing section performs processing of adjusting the amount of light of the light source so that the result becomes an adjustment target value.

13. The printer according to claim 1, wherein
the sensor includes a photoelectric conversion device and an analog front end circuit coupled to the photoelectric conversion device.

14. The printer according to claim 13, wherein
the photoelectric conversion device is a linear image sensor.

15. The printer according to claim 14, wherein
the linear image sensor is provided so that a longitudinal direction thereof is a vertical direction.

* * * * *